US010513807B2

(12) United States Patent
Fukui

(10) Patent No.: US 10,513,807 B2
(45) Date of Patent: Dec. 24, 2019

(54) KNITTING MACHINE CAPABLE OF CHANGING PILE LENGTH AND MANUFACTURING METHOD OF KNITTED FABRIC HAVING DIFFERENT PILE LENGTHS

(71) Applicant: OKAMOTO CORPORATION, Kitakatsuragi-gun, Nara (JP)

(72) Inventor: Takao Fukui, Nara (JP)

(73) Assignee: OKAMOTO CORPORATION, Nara (JP)

( * ) Notice: Subject to any disclaimer, the term of this patent is extended or adjusted under 35 U.S.C. 154(b) by 685 days.

(21) Appl. No.: 13/767,289

(22) Filed: Feb. 14, 2013

(65) Prior Publication Data

US 2013/0205837 A1 Aug. 15, 2013

(30) Foreign Application Priority Data

Feb. 15, 2012 (JP) ..... 2012-031153

(51) Int. Cl.
*D04B 9/12* (2006.01)
*D04B 15/06* (2006.01)

(52) U.S. Cl.
CPC ..... *D04B 9/12* (2013.01); *D04B 15/06* (2013.01)

(58) Field of Classification Search
CPC ..... D04B 9/12; D04B 9/025; D04B 15/06; D04B 15/68; D04B 15/322; D04B 1/02
See application file for complete search history.

(56) References Cited

U.S. PATENT DOCUMENTS 4,040,276 A * 8/1977 Koegel ..... 66/107
4,537,048 A * 8/1985 Gutschmit et al. ..... 66/93
5,010,744 A * 4/1991 Kawase ..... D04B 15/06 66/107
5,109,680 A * 5/1992 Pernick ..... 66/93
(Continued)

FOREIGN PATENT DOCUMENTS

EP 0 757 124 A1 2/1997
EP 0757124 A1 * 5/1997
(Continued)

OTHER PUBLICATIONS

Official Communication issued in corresponding European Patent Application No. 14173503.5, dated Nov. 13, 2014.
(Continued)

*Primary Examiner* — Megan E Lynch
(74) *Attorney, Agent, or Firm* — Keating & Bennett, LLP

(57) ABSTRACT

A knitting machine capable of changing a pile length includes a low-pile sinker and a high-pile sinker, a low-pile selector jack arranged on the rear end side of the low-pile sinker, a high-pile selector jack arranged on the rear end side of the high-pile sinker, an actuator operable to, when a pile yarn and a ground yarn are drawn in by a knitting needle, selectively perform the first control in which the actuator acts on the low-pile selector jack, the second control in which the actuator acts on the high-pile selector jack, and the third control in which the actuator does not act on any of the low-pile and high-pile selector jacks, and a cam operable to push out the selector jack subjected to the action of the actuator and the sinker which is in contact with the selector jack to an area between the knitting needles.

13 Claims, 34 Drawing Sheets

(56) References Cited

U.S. PATENT DOCUMENTS

| | | | | | |
|---|---|---|---|---|---|
| 5,167,133 | A * | 12/1992 | Schmidt | 66/9 R |
| 5,170,649 | A * | 12/1992 | Lonati | 66/217 |
| 5,186,025 | A * | 2/1993 | Neher | 66/9 R |
| 5,689,977 | A * | 11/1997 | Yorisue et al. | 66/219 |
| 5,862,681 | A * | 1/1999 | Schmidt | 66/9 R |
| 6,089,047 | A * | 7/2000 | Wang | 66/91 |
| 6,105,402 | A * | 8/2000 | Lee | 66/217 |
| 6,128,930 | A * | 10/2000 | Schmidt | 66/92 |
| 6,840,065 | B1 * | 1/2005 | Wang | 66/93 |
| 7,757,516 | B1 * | 7/2010 | Starbuck | 66/104 |
| 2003/0154747 | A1 * | 8/2003 | Plath et al. | 66/8 |
| 2005/0155391 | A1 * | 7/2005 | Wang | 66/104 |
| 2006/0277950 | A1 * | 12/2006 | Rock | 66/169 R |
| 2008/0041113 | A1 * | 2/2008 | Mori et al. | 66/54 |
| 2008/0189824 | A1 * | 8/2008 | Rock et al. | 2/69 |
| 2009/0095025 | A1 * | 4/2009 | Knight et al. | 66/19 |
| 2009/0249836 | A1 * | 10/2009 | Stingel | 66/104 |

FOREIGN PATENT DOCUMENTS

| | | | |
|---|---|---|---|
| EP | 1 813 159 | A1 | 8/2007 |
| GB | 2380203 | A * | 4/2003 |
| JP | 2001-146662 | A | 5/2001 |
| JP | 2004-316000 | A | 11/2004 |
| JP | 2005-060864 | A | 3/2005 |
| JP | 4502606 | B2 | 7/2010 |

OTHER PUBLICATIONS

Official Communication issued in corresponding European Patent Application No. 13155293.7, dated Nov. 25, 2013.
Official Communication issued in Korean Patent Application No. 10-2013-0016161, dated Sep. 18, 2018.

* cited by examiner

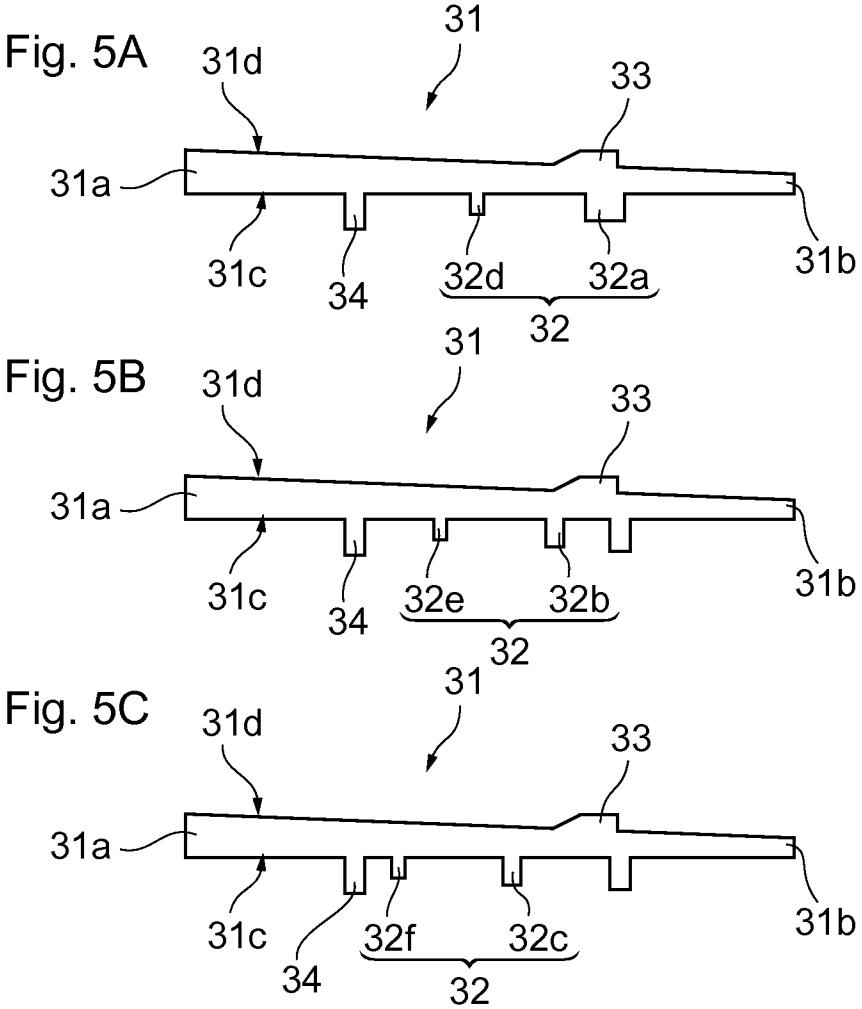
Fig. 5A
Fig. 5B
Fig. 5C
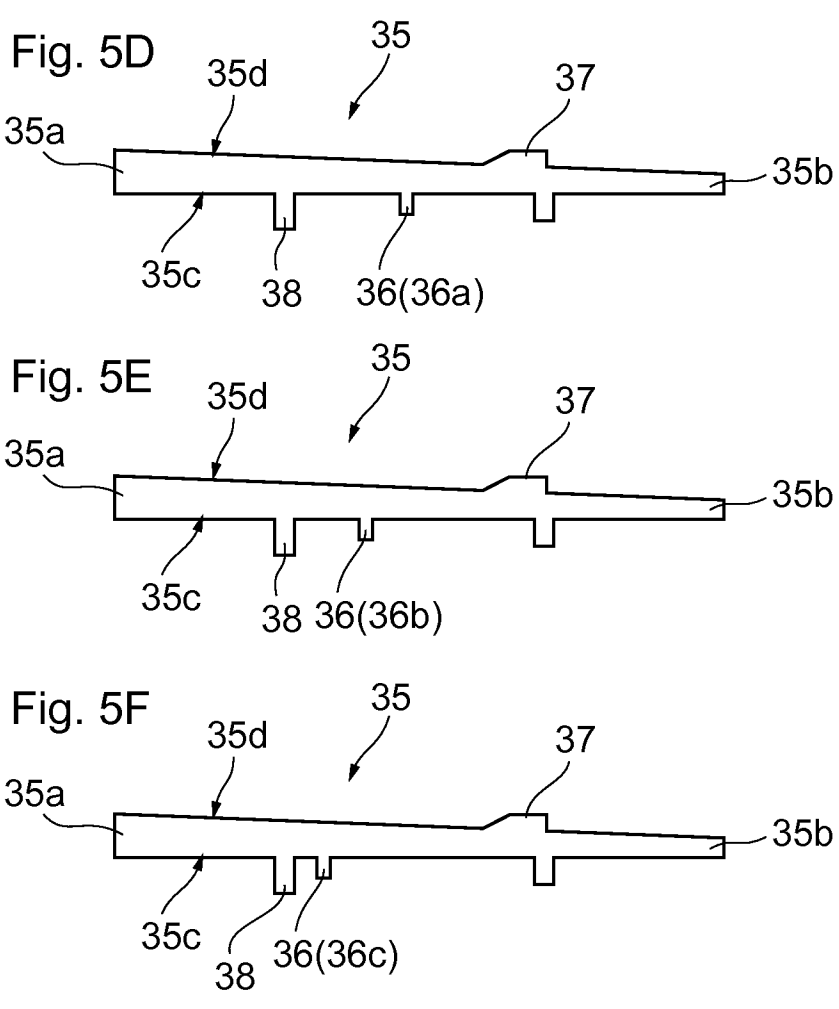
Fig. 5D
Fig. 5E
Fig. 5F

KNITTING MACHINE CAPABLE OF CHANGING PILE LENGTH AND MANUFACTURING METHOD OF KNITTED FABRIC HAVING DIFFERENT PILE LENGTHS

BACKGROUND OF THE INVENTION

1. Field of the Invention

The present invention relates to a knitting machine capable of changing a pile length, which is arranged to form a pile knitted fabric having a plurality of sinker loop lengths by moving a sinker into and out of an area between reciprocating knitting needles. The present invention also relates to a manufacturing method of a knitted fabric having different pile lengths.

2. Description of the Related Art

In a conventionally-known technique for forming a pile stitch and a plain stitch by a hosiery circular knitting machine, when the pile stitch is formed, a sinker having a pile nib is moved into and out of between knitting needles. By changing the moving distance of the sinker, whether or not a pile yarn is placed on the pile nib is switched.

Another conventional technique is described in JP 4502606 (B2). In that technique, a knitting structure in which a sinker loop length of a pile yarn is longer than that of a ground yarn (hereinafter, referred to as a "low-pile stitch"), a knitting structure in which the sinker loop length of the pile yarn (hereinafter, referred to as a "pile length") is even longer than in the low-pile stitch (hereinafter, also referred to as a "high-pile stitch"), and a knitting structure in which the sinker loop length of the ground yarn and that of the pile yarn are the same (hereinafter, referred to as a "plain stitch") are formed in the same knitted fabric by using two sinkers. In accordance with that technique, those three different knitting structures, i.e., the plain stitch, the low-pile stitch and the high-pile stitch can be distributed in a desired pattern in the same knitted fabric. Also, the high-pile stitch can be arranged among the low-pile stitches or the low-pile or high-pile stitch can be arranged among the plain stitches. Moreover, other knitting structures, e.g., a float stitch, a tuck stitch, and a cut-boss stitch as a varied stitch, can be arranged in place of the plain stitch in that technique.

In accordance with the technique described in JP 4502606 (B2), the three different knitting structures, i.e., the plain stitch, the low-pile stitch, and the high-pile stitch can be arranged in a desired pattern in the same knitted fabric. The thus formed knitted fabric can be used for a product which pursues fashionability and functionality. However, for making a product more fashionable and functional, those three knitting structures are often required to be arranged on a stitch-by-stitch basis in a knitted fabric. Because only one of a pair of sinkers is driven by an actuator in the technique described in JP 4502606 (B2), it is difficult to drive the other sinker to provide an action on a stitch-by-stitch basis precisely.

SUMMARY OF THE INVENTION

Preferred embodiments of the present invention provide a knitting machine capable of changing a pile length, which can form a knitted fabric in which at least three different knitting structures having different pile lengths are arranged on a stitch-by-stitch basis, and provide a manufacturing method of a knitted fabric having different pile lengths.

According to a preferred embodiment of the present invention, a knitting machine capable of changing a pile length is provided. The knitting machine includes a cylinder arranged to hold knitting needles so that the knitting needles extend in a vertical direction parallel or substantially parallel to an axis of the cylinder; a sinker bed including a disk-shaped horizontal surface arranged perpendicular or substantially perpendicular to the axis of the cylinder; a plurality of sinkers including a low-pile sinker and a high-pile sinker arranged on the sinker bed to radially extend and to be movable in a radial direction of the cylinder, the low-pile sinker and the high-pile sinker being opposed to each other, the low-pile sinker including a low-pile nib to hold a pile yarn when a low-pile stitch is formed, the high-pile sinker including a high-pile nib to hold the pile yarn when a high-pile stitch in which a sinker loop length of the pile yarn is longer than that in the low-pile stitch is formed; a plurality of selector jacks arranged on the sinker bed radially outside the sinkers to correspond thereto, respectively, and to extend radially, the selector jacks including a low-pile selector jack and a high-pile selector jack arranged to be opposed to each other and be selectively movable in the radial direction to act on the low-pile sinker and the high-pile sinker corresponding thereto, an actuator arranged to selectively act on the selector jacks so that, when one of the knitting needles draws in the pile yarn and a ground yarn, a first control in which the actuator acts on the low-pile selector jack, a second control in which the actuator acts on the high-pile selector jack, and a third control in which none of the low-pile selector jack and the high-pile selector jack is subjected to an action of the actuator are selectively performed; and a sinker cap arranged above the sinker bed to cover the sinker bed, the sinker cap including a cam arranged to act the sinkers and the selector jacks selectively. The cam is arranged to move at least one of the selector jacks which is subjected to the action of the actuator radially inward to bring the at least one selector jack into contact with a corresponding sinker so as to move the corresponding sinker to an area between the knitting needles. At least one of the low-pile sinker and the high-pile sinker includes a small nib to hold the ground yarn during stitch formation, a distance between the high-pile nib and the small nib being larger than a distance between the low-pile nib and the small nib in the vertical direction. A distance between the low-pile nib and the high-pile nib in the vertical direction preferably is from about 0.5 mm to about 2.5 mm, for example. When the low-pile sinker is pushed out by the first control, the pile yarn and the ground yarn are drawn in by one of the knitting needles while the pile yarn is held by the low-pile nib and the ground yarn is held by the small nib. When the high-pile sinker is pushed out by the second control, the pile yarn and the ground yarn are drawn in by one of the knitting needles while the pile yarn is held by the high-pile nib and the ground yarn is held by the small nib. When none of the low-pile sinker and the high-pile sinker is pushed out by the third control, the pile yarn and the ground yarn are drawn in by one of knitting needles while both the pile yarn and the ground yarn are held by the small nib.

According to another preferred embodiment of the present invention, a manufacturing method of a knitted fabric by a knitting machine capable of changing a pile length is provided. The knitting machine includes a cylinder arranged to hold knitting needles to extend in a vertical direction parallel or substantially parallel to an axis of the cylinder; a plurality of radially extending sinkers including a low-pile sinker and a high-pile sinker arranged to be movable in a radial direction of the cylinder, the low-pile sinker and the high-pile sinker being opposed to each other, the low-pile sinker including a low-pile nib to hold a pile yarn when a low-pile stitch is formed, the high-pile sinker including a high-pile nib to hold the pile yarn when a high-pile stitch in which a sinker loop length of the pile yarn is longer than that in the low-pile stitch is formed; a plurality of radially extending selector jacks arranged radially outside the sinkers to correspond thereto, respectively, the selector jacks including a low-pile selector jack and a high-pile selector jack arranged to be opposed to each other; an actuator arranged to, when one of the knitting needles draws in the pile yarn and a ground yarn, selectively act on the low-pile selector jack and the high-pile selector jack; and a cam arranged to move at least one of the selector jacks and at least one sinker which comes into contact therewith to an area between the knitting needles. The manufacturing method includes a first step of, when one of the knitting needles draws in the pile yarn and the ground yarn, selectively performing a first control in which the actuator acts on the low-pile selector jack, a second control in which the actuator acts on the high-pile selector jack, and a third control in which none of the low-pile selector jack and the high-pile selector jack is subjected to the action of the actuator; and a second step of making the cam act on one of the selector jack on which the actuator acts to bring the one of the selector jack into contact with a corresponding one of the sinkers so as to move the corresponding one of the sinkers to an area between the knitting needles. When the low-pile sinker is moved by the first control, the pile yarn and the ground yarn are drawn in by one of the knitting needles while the pile yarn is held by the low-pile nib and the ground yarn is held by the small nib. When the high-pile sinker is moved by the second control, the pile yarn and the ground yarn are drawn by one of the knitting needles in while the pile yarn is held by the high-pile nib and the ground yarn is held by the small nib. When none of the low-pile sinker and the high-pile sinker is moved by the third control, the pile yarn and the ground yarn are drawn in by one of the knitting needles while both the pile yarn and the ground yarn are held by the small nib.

According to the above, a difference between knitting structures, i.e., the sinker loop length is a distance from a contact point between the pile yarn and ground yarn and the sinker to a contact point between the pile yarn and the ground yarn and the knitting needle. Thus, by selecting which one of the two sinkers and/or which one of the nibs holds the pile yarn and the ground yarn by moving the respective sinkers forward/backward, different knitting structures (e.g., a low-pile stitch, a high-pile stitch, and a plain stitch). Moreover, in accordance with a preferred embodiment of the present invention, all the three types of control, i.e., the first control in which the low-pile sinker is moved radially inward or forward, the second control in which the high-pile sinker is moved forward or radially inward, and the third control in which both the low-pile sinker and the high-pile sinker are not moved forward can be performed by the actuator selectively. Consequently, a knitted fabric can be formed in which at least three knitting structures having different pile lengths are arranged on a stitch-by-stitch basis.

In the knitting machine according to a preferred embodiment of the present invention, each of the selector jacks may include selector butts arranged to be subjected to the action of the actuator. The selector butts may include common selector butts as common components which are provided in both the low-pile selector jack and the high-pile selector jack at the same radial position to be opposed to each other, and a single selector butt as a single component which is provided in the low-pile selector jack at a position different from the common selector butts. In the first control, the actuator may act on the single selector butt. In the second control, the actuator may act on the common selector butts or both the common selector butts and the single selector butt. In the third control, none of the common selector butts and the single selector butt may be subjected to the action of the actuator.

In this arrangement, in the second control, the actuator acts on both the selector butts as the common components and the selector butt as the single component. Therefore, an impact and/or a force applied to the low-pile selector butts are distributed. Thus, a burden applied to the low-pile selector jack can be reduced.

Moreover, in this arrangement, when the second control is performed, at least the selector butts as the common components are subjected to the action of the actuator. Therefore, the action of the actuator is applied to both the low-pile sinker and the high-pile sinker. Thus, it is not necessary to provide the small nib to hold the ground yarn in the high-pile sinker, enabling the structure of the high-pile sinker to be simplified.

In the knitting machine according to a preferred embodiment of the present invention, the selector jacks may include a plurality of groups of selector jacks. In each of the groups, the common selector butts of each of the selector jacks may be arranged at different radial positions from those of other selector jacks and the single selector butt of each of the selector jacks may be arranged at a different radial position from those of other selector jacks. The selector jacks are arranged so that the common selector butt at one radial direction repeatedly occurs and the single selector butt at one radial direction repeatedly occurs. The actuator may have a plurality of heads provided to correspond to the selector butts.

This arrangement can increase a rotation speed of the cylinder with a response speed of the actuator remaining unchanged. Therefore, production efficiency can be improved. Moreover, by setting an appropriate number of pairs of selector jacks in accordance with the response speed of the actuator corresponding to the rotation speed of the cylinder, the operation of the knitting machine can be stabilized.

In the knitting machine according to a preferred embodiment of the present invention, the low-pile selector jack may include a low-pile selector butt operable to be subjected to the action of the actuator, and the high-pile selector jack may include a high-pile selector butt operable to be subjected to the action of the actuator. In the first control, the actuator may act on the low-pile selector butt. In the second control, the actuator may act on the high-pile selector butt or both the low-pile selector butt and the high-pile selector butt. In the third control, none of the low-pile selector butt and the high-pile selector butt may be subjected to the action of the actuator.

This arrangement enables both the low-pile selector butt and the high-pile selector butt to be subjected to the action of the actuator in the second control. Thus, it is not necessary to provide the small nib to hold the ground yarn in the high-pile sinker, simplifying the structure of the high-pile sinker.

In the knitting machine according to a preferred embodiment of the present invention, the selector jacks may include a plurality of low-pile selector jacks and a plurality of high-pile selector jacks, a radial position of the low-pile selector butt of each of the low-pile selector jacks may be different from those of adjacent ones of the low-pile selector jacks, and a radial position of the high-pile selector butt of each of the high-pile selector jacks may be different from those of adjacent ones of high-pile selector jacks. The low-pile selector jacks may be arranged so that the low-pile selector butt at one radial position occurs repeatedly, and the high-pile selector jacks are arranged so that the high-pile selector butt at one radial position occurs repeatedly. The actuator may include a plurality of heads provided to correspond to the low-pile and high-pile selector butts.

This arrangement enables the rotation speed of the cylinder to be increased with the response speed of the actuator remaining unchanged. Moreover, by setting an appropriate number of pairs of sinkers in accordance with the response speed of the actuator corresponding to the rotation speed of the cylinder, the operation of the knitting machine can be stabilized.

In the arrangement of the knitting machine, the small nib may be provided in the low-pile sinker only.

In general, in a knitting machine capable of changing a pile length and including two sinkers, i.e., a low-pile sinker and a high-pile sinker, in a case of forming a stitch by using a nib of one of the sinkers, it is likely that a nib to hold the ground yarn formed in the other sinker disturbs the stitch formation. However, according to the arrangement of the knitting machine of a preferred embodiment of the present invention, the small nib is preferably provided only in the low-pile sinker. Therefore, it is unlikely that, when the low-pile sinker is selected, the nib of the high-pile sinker causes any trouble during stitch formation. For forming the high-pile stitch, only the high-pile sinker is not selected, but both the high-pile sinker and the low-pile sinker are selected. In this manner, the ground yarn can be held by the small nib provided in the low-pile sinker.

In the knitting machine according to a preferred embodiment of the present invention, a separating portion may be further arranged between the low-pile sinker and the high-pile sinker and between the low-pile selector jack and the high-pile selector jack to prevent the low-pile sinker and the low-pile selector jack from adhering to the high-pile sinker and the high-pile selector jack.

According to this arrangement, the separating portion can prevent the low-pile sinker and the high-pile sinker from coming into contact with each other and also can prevent the low-pile selector jack and the high-pile selector jack from coming into contact with each other. Therefore, each of the low-pile sinker and the high-pile sinker and each of the low-pile selector jack and the high-pile selector jack can be driven independently.

In the knitting machine according to a preferred embodiment of the present invention, the separating portion may be a plate-shaped separator.

In the knitting machine according to a preferred embodiment of the present invention, the actuator may be a plate-shaped head including a top end and be arranged to act on one of the selector jacks which is to be selected by bringing the top end of the head into contact with the one of the selector jacks. The head may include a main surface which is perpendicular or substantially perpendicular to the one of the selector jacks and symmetric with respect to a center line extending vertically.

According to this arrangement, both in a case of forward rotation in which the cylinder rotates in a counterclockwise direction when the knitting machine is seen from above, and in a case of reverse rotation in which the cylinder rotates in a clockwise direction, the actuator acts on the selector butt in the same manner. Thus, even in a case of reciprocating rotation of the cylinder in which one revolution of forward rotation and one revolution of reverse rotation are alternately performed, the same control can be performed as that for forward rotation only and that for reverse rotation only.

According to another preferred embodiment of the present invention, a knitting machine capable of changing a pile length is provided. The knitting machine includes a cylinder arranged to hold a plurality of knitting needles so that the knitting needles extend in a vertical direction parallel or substantially parallel to an axis of the cylinder; a sinker bed having a disk-shaped horizontal surface perpendicular or substantially perpendicular to the axis of the cylinder; a plurality of sinkers arranged on the sinker bed radially to be movable in a radial direction of the cylinder; a plurality of selector jacks arranged on the sinker bed radially outside the sinkers to extend radially and to act on the sinkers by moving radially inward and outward; an actuator arranged to act on the selector jacks; a disk-shaped sinker cap arranged above the sinker bed to cover the sinker bed. The sinker cap includes a cam operable to act on the sinkers and the selector jacks. Each of the sinkers extends radially and includes a small nib to hold a ground yarn during stitch formation, a low-pile nib to hold a pile yarn when a low-pile stitch is formed, and a high-pile nib to hold the pile yarn when a high-pile stitch is formed. A distance between the high-pile nib and the small nib is larger than a distance between the low-pile nib and the small nib in the vertical direction. Each of the selector jacks includes a low-pile selector butt operable to be subjected to an action of the actuator when the low-pile stitch is formed and a high-pile selector butt operable to be subjected to the action of the actuator when the high-pile stitch is formed. When the pile yarn and the ground yarn are drawn in by one of the knitting needles, the actuator selectively performs a first control in which the actuator acts on the low-pile selector butt, a second control in which the actuator acts on the high-pile selector butt, and a third control in which no action is applied to the low-pile selector butt and the high-pile selector butt. The cam includes a first pushing portion operable to push out one of the selector jacks which includes the low-pile selector jack subjected to the action of the actuator and one of the sinkers corresponding to the one of the selector jacks to an area between the knitting needles by a first distance, and a second pushing portion operable to push out one of the selector jacks which includes the high-pile selector jack subjected to the action of the actuator and one of the sinkers corresponding to the one of the selector jacks to an area between the knitting needles by a second distance different from the first pushed distance. When one of the sinkers is pushed out by the first control, the pile yarn and the ground yarn are drawn in by one of the knitting needles while the pile yarn is held by the low-pile nib and the ground yarn is held by the small nib. When one of the sinkers is pushed out by the second control, the pile yarn and the ground yarn are drawn in by one of the knitting needles while the pile yarn is held by the high-pile nib and the ground yarn is held by the small nib. When none of the sinkers is pushed out by the third control, the pile yarn and the ground yarn are drawn in by one of the knitting needles while both the pile yarn and the ground yarn are held by the small nib.

According to a further preferred embodiment of the present invention, a manufacturing method of a knitted fabric having different pile lengths by a knitting machine is provided. The knitting machine includes a sinker arranged to extend radially and including a small nib to hold a ground yarn during stitch formation, a low-pile nib to hold a pile yarn when a low-pile stitch is formed, and a high-pile nib to hold the pile yarn when a high-pile stitch is formed; a selector jack arranged radially outside the sinker to extend radially and including a low-pile selector butt used when the low-pile stitch is formed and a high-pile selector butt used when the high-pile stitch is formed; an actuator arranged to, when the pile yarn and the ground yarn are drawn in by one of knitting needles, selectively act on the low-pile selector butt and the high-pile selector butt; and a cam arranged to push out the selector jack and the sinker in contact therewith to an area between the knitting needles. The manufacturing method includes a first step of, when the pile yarn and the ground yarn are drawn in by one of the knitting needles, selectively performing a first control in which the actuator acts on the low-pile selector butt, a second control in which the actuator acts on the high-pile selector butt, and a third control in which none of the low-pile selector butt and the high-pile selector butt is subjected to an action of the actuator; and a second step of, when the low-pile selector butt is subjected to the action of the actuator, making a first pushing portion of the cam act on the selector jack to push out the sinker in contact therewith by a first distance and, when the high-pile selector butt is subjected to the action of the actuator, making a second pushing portion of the cam act on the selector jack to push out the sinker in contact therewith by a second distance different from the first distance. When the sinker is pushed out by the first control, the pile yarn and the ground yarn are drawn in by one of the knitting needles while the pile yarn is held by the low-pile nib and the ground yarn is held by the small nib. When the sinker is pushed out by the second control, the pile yarn and the ground yarn are drawn in by one of the knitting needles while the pile yarn is held by the high-pile nib and the ground yarn is held by the small nib. When no sinker is pushed out by the third control, the pile yarn and the ground yarn are drawn in by one of the knitting needles while both the pile yarn and the ground yarn are held by the small nib.

According to various preferred embodiments of the present invention, a difference between knitting structures, i.e., the sinker loop length corresponds to a distance from a contact point between the pile yarn and ground yarn and the sinker to a contact point between the pile yarn and the ground yarn and the knitting needle. Thus, by selecting which portion of the sinker holds the pile yarn and the ground yarn by adjusting the moved amount of the sinker which is moved forward/backward, different knitting structures (e.g., a low-pile stitch, a high-pile stitch, and a plain stitch) are formed. Moreover, according to various preferred embodiments of the present invention, all the three types of control, i.e., the first control in which the sinker is moved, the second control in which the sinker is moved farther than in the first control, and the third control in which the sinker is not moved can be performed by the actuator selectively. Consequently, a knitted fabric can be formed in which at least three knitting structures having different pile lengths are arranged on a stitch-by-stitch basis.

According to various preferred embodiments of the present invention, a knitted fabric can be formed in which at least three knitting structures having different pile lengths from one another are distributed on a stitch-by-stitch basis.

The above and other elements, features, steps, characteristics and advantages of the present invention will become more apparent from the following detailed description of the preferred embodiments with reference to the attached drawings.

BRIEF DESCRIPTION OF THE DRAWINGS

FIGS. 5A, 5B, 5C, 5D, 5E and 5F are side views of selector jacks, showing the kinds of the selector jacks used in the first preferred embodiment of the present invention.

DETAILED DESCRIPTION OF THE PREFERRED EMBODIMENTS

Figure 1:
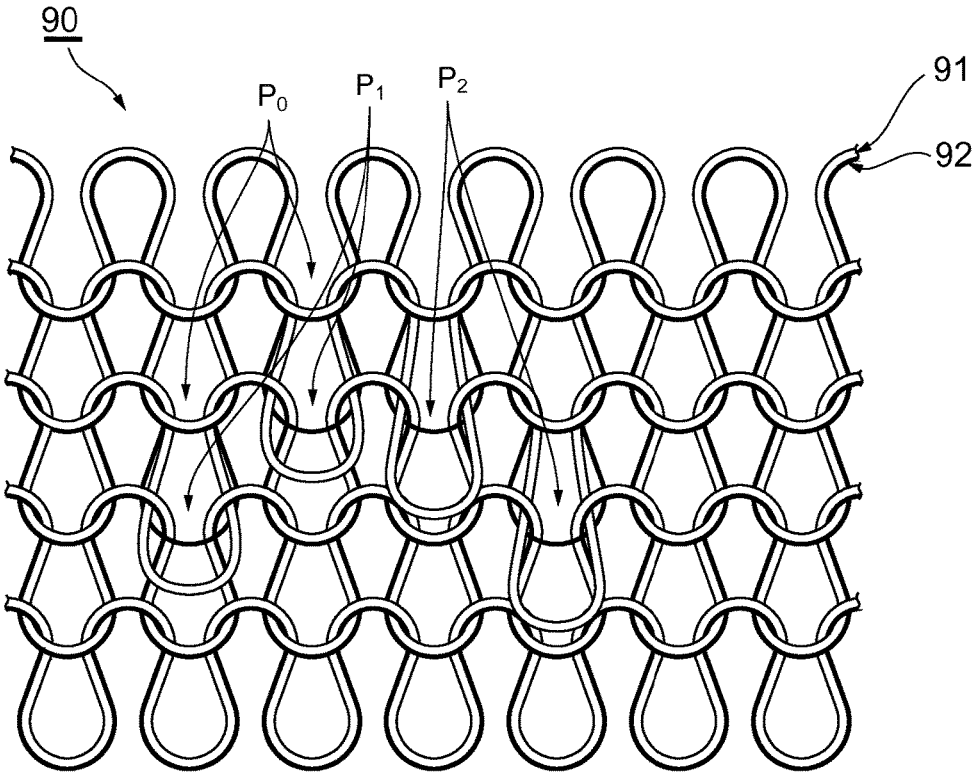
FIG. 1 shows exemplary knitting structures which can be knitted by a circular knitting machine according to a first preferred embodiment of the present invention.

Hereinafter, preferred embodiments of the present invention are described, referring to the figures in which the same reference signs refer to the same or equivalent elements. Please note that the dimension ratio is not coincident with that in the description. In the description, the term describing the direction such as "upper", "lower" or the like is used for convenience based on the state shown in the drawings.

A circular knitting machine capable of forming a knitted fabric in which three knitting structures, i.e., a plain stitch, a low-pile stitch, and a high-pile stitch are arranged on a stitch-by-stitch basis is described as an exemplary multi-pile knitting machine (i.e., a knitting machine capable of changing a pile length) in preferred embodiments of the present invention set forth below. First, the knitting structures are described.

FIG. 1 shows exemplary knitting structures which can be formed by circular knitting machines according to preferred embodiments of the present invention. The knitting structure in which a pile yarn 91 and a ground yarn 92 are knitted together so that a sinker loop length of the pile yarn 91 and that of the ground yarn 92 are the same is referred to as a plain stitch $P_0$. The knitting structure in which the sinker loop length of the pile yarn 91 is longer than that of the ground yarn 92 is referred to as a low-pile stitch $P_1$ (also referred to as a short-pile stitch). The knitting structure in which the sinker loop length of the pile yarn 91 is even longer than in the low-pile stitch $P_1$ is referred to as a high-pile stitch $P_2$ (also referred to as a long-pile stitch).

First Preferred Embodiment

Figure 2:
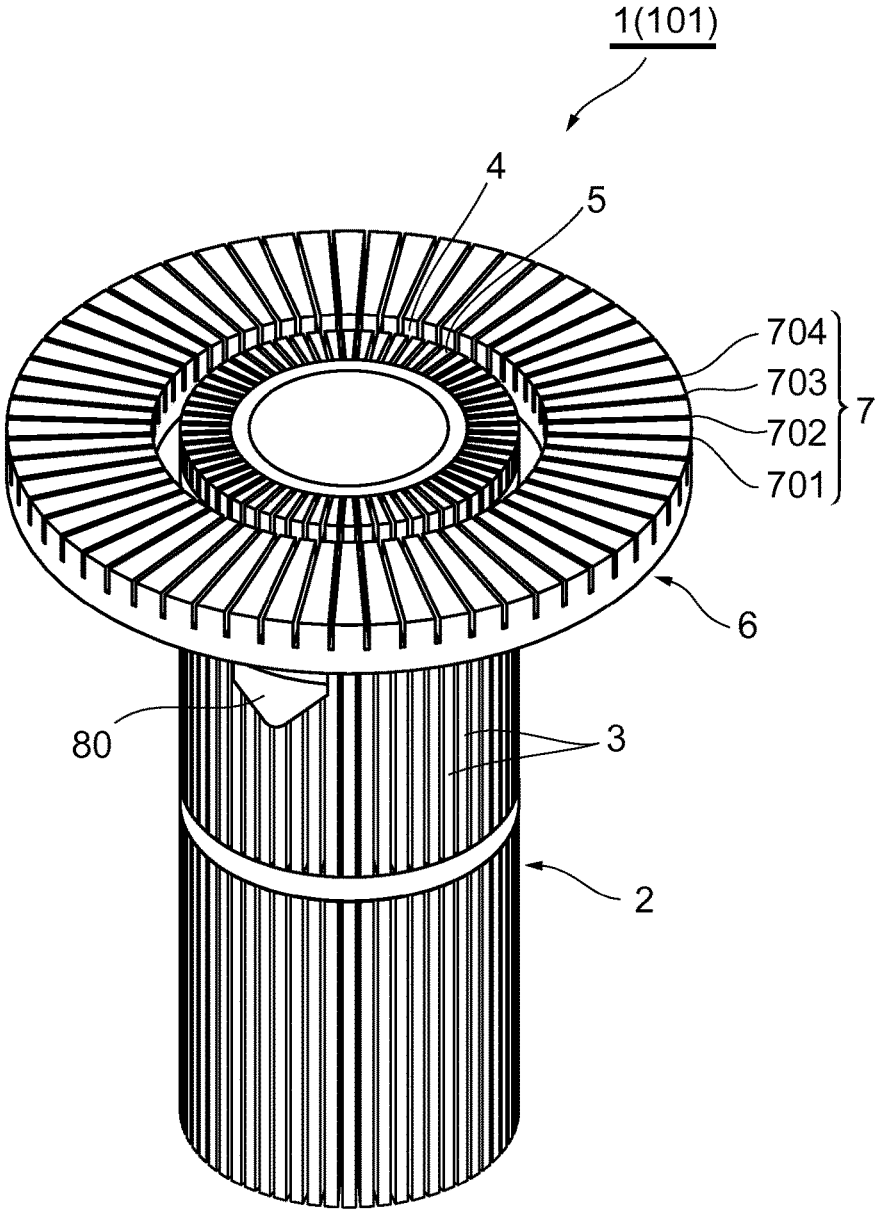
FIG. 2 is a perspective view of a portion of a stitch forming device included in the circular knitting machine according to the first preferred embodiment of the present invention.

A circular knitting machine 1 according to the first preferred embodiment of the present invention will be described. First, the arrangement of the circular knitting machine 1 is described referring to FIGS. 2 to 8. FIG. 2 is a perspective view of a portion of the circular knitting machine 1, including a stitch forming device. The circular knitting machine 1 includes a knitting-needle cylinder 2 supported by a machine table (not shown) to be rotatable, a top cylinder 4 attached to the inside of the upper portion of the knitting-needle cylinder 2, a substantially disk-shaped sinker bed 6 arranged outside the upper portion of the knitting-needle cylinder 2, and the stitch forming device 10 arranged to form a plurality of knitting structures by moving a pair of sinkers 20 into and out of between reciprocating knitting needles 11.

The knitting-needle cylinder 2 is a substantially tubular component arranged to accommodate the knitting needles 11. A number of vertical grooves 3 for allowing the knitting needles 11 to slide therein in a vertical direction are formed on the outer circumferential surface of the knitting-cylinder 2 at a regular circumferential interval. The arranged density of the vertical grooves 3 on the knitting-needle cylinder 2 preferably is from about 5 to about 24 per inch in the circumferential direction in this example.

The top cylinder 4 is arranged to be rotatable together with the knitting-needle cylinder 2 and is provided with a plurality of horizontal grooves 5 each of which can guide a pair of sinkers 20 described later. The horizontal grooves 5 are arranged to extend in the radial direction of the knitting-needle cylinder 2. When seen from above, the horizontal grooves 5 are arranged between the vertical grooves 3 of the knitting-needle cylinder 2. In other words, the horizontal grooves 5 and the vertical grooves 3 are alternately arranged when seen from above.

The sinker bed 6 is a substantially tubular component arranged to accommodate a plurality of pairs of sinkers 20, a plurality of pairs of selector jacks 30 and separators 40 all described later. The sinker bed 6 is arranged to be rotatable together with the knitting-needle cylinder 2 and is provided with a plurality of horizontal grooves 7 each arranging a pair of sinkers 20, a pair of selector jacks 30 and a separator 40 therein along the radial direction. The horizontal grooves 7 of the sinker bed 6 and the horizontal grooves 5 of the top cylinder 4 are preferably the same in number. Each horizontal groove 7 and a corresponding horizontal groove 5 are arranged on the same radially extending line.

The stitch forming device (see FIGS. 7A and 10A to 10C) includes a plurality of pairs of sinkers 20, a plurality of pairs of selector jacks 30, separators 40, an actuator 50, and a sinker cap 60. The sinkers 20 are operable to hold a pile yarn 91 and a ground yarn 92 when the pile yarn 91 and the ground yarn 92 forming a new loop are drawn into an old loop. Each pair of sinkers 20 includes a low-pile sinker 21 and a high-pile sinker 25. Each pair of selector jacks 30 includes a low-pile selector jack 31 and a high-pile selector jack 35 respectively corresponding to the low-pile sinker 21 and the high-pile sinker 25. The selector jacks 30 are arranged to move corresponding sinkers 20 forward (i.e., radially inward) selectively. The separator 40 is arranged to prevent the low-pile sinker 21 and the low-pile selector jack 31 from adhering to the high-pile sinker 25 and the high-pile selector jack 35. The actuator 50 is operable to selectively act on the respective selector jacks 30. The sinker cap 60 is provided with a group of cams including the first cam 62 to move one of the selector jacks 30 which is subjected to the action of the actuator 50 to an area between the knitting needles 11.

Figure 3A:
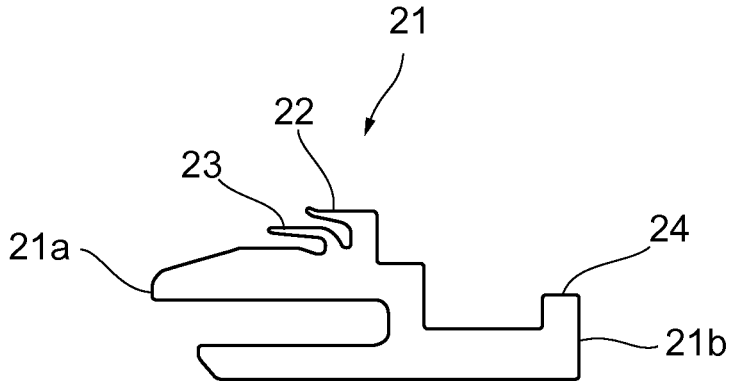
FIGS. 3A and 3B are side views of a low-pile sinker and a high-pile sinker of the circular knitting machine according to the first preferred embodiment of the present invention, respectively.
Figure 3B:
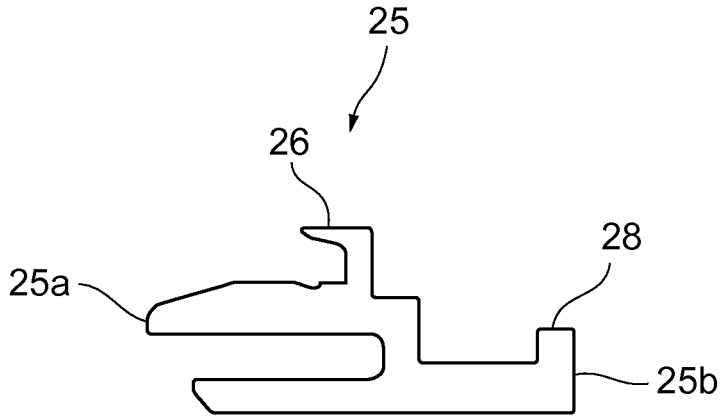

FIG. 3A is a side view of the low-pile sinker 21 and FIG. 3B is a side view of the high-pile sinker 25. A pair of sinkers 20 includes the low-pile sinker 21 including a low-pile nib 22 and a small nib 23 shown in FIG. 3A and the high-pile sinker 25 including a high-pile nib 26 shown in FIG. 3B. Both the low-pile sinker 21 and the high-pile sinker 25 are preferably plate-shaped members in this example. The low-pile nib 22 and the high-pile nib 26 are arranged to hold the pile yarn 91 during formation of a stitch, and the small nib 23 is arranged to hold at least the ground yarn 92. The low-pile sinker 21 and the high-pile sinker 25 preferably have a thickness of about 0.2 mm to about 0.8 mm in this example, and are formed of steel, for example.

Figure 4:
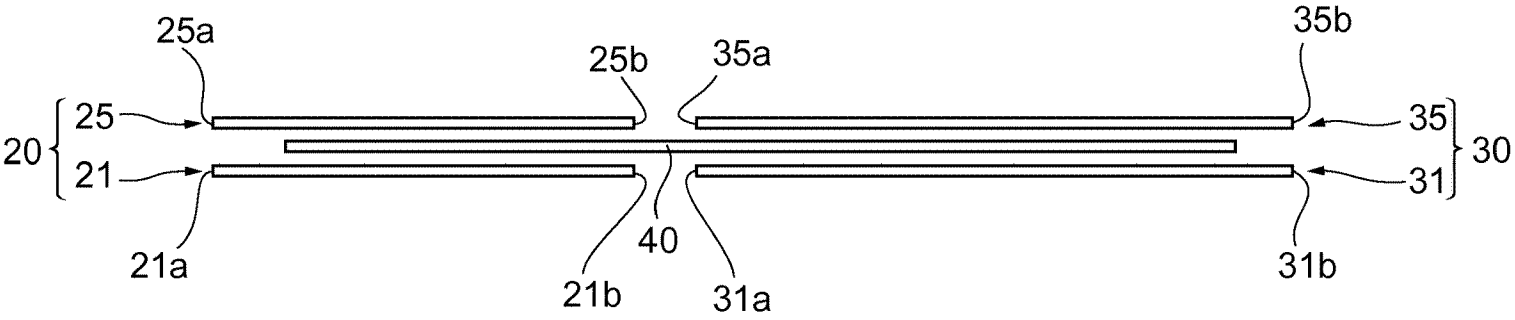
FIG. 4 shows an arrangement of sinkers, selector jacks and a separator according to the first preferred embodiment of the present invention.

FIG. 4 shows the arrangement of the sinkers, the selector jacks and the separator. The low-pile sinker 21 and the high-pile sinker 25 are accommodated in the horizontal groove 7 formed in the sinker bed 6. More specifically, the low-pile sinker 21 and the high-pile sinker 25 are arranged to extend along a direction in which the sinkers 21 and 25 are moved in and out and to be opposed to each other with the separator 40 arranged therebetween. The leading ends 21*a* and 25*a* of the low-pile sinker 21 and the high-pile sinker 25 are provided to be movable into and out from between the knitting needles 11. Returning to FIG. 3, the rear ends 21*b* and 25*b* of the low-pile sinker 21 and the high-pile sinker 25 are provided with butts 24 and 28 which are to be subjected to the action of the second cam 63 and the third cam 64 which will be described later. Please note that the horizontal direction in FIG. 4 is coincident with the radial direction of the sinker bed 6 in FIG. 2 and the left in FIG. 4 is coincident with the radially inside in FIG. 2.

A pair of selector jacks 30 includes a low-pile selector jack 31 arranged on the rear end 21*b* side (i.e., the radially outside) of the low-pile sinker 21 and a high-pile selector 35 arranged on the rear end 25*b* side (i.e., the radially outside) of the high-pile sinker 25. The low-pile selector jack 31 and the high-pile selector jack 35 are formed by plate-shaped members in this example. The thicknesses of the selector jacks 31 and 35 are preferably from about 0.2 mm to about 0.8 mm in this example as in the sinkers 20. The selector jacks 31 and 35 are formed of steel, for example.

The low-pile selector jack 31 and the high-pile selector jack 35 are accommodated in the horizontal groove 7 provided in the sinker bed 6 to extend along a direction in which they are moved in and out, as shown in FIG. 4. Also, the low-pile selector jack 31 and the high-pile selector jack 35 are arranged to be opposed with each other with the separator 40 provided therebetween.

FIGS. 5A to 5F show the types of the low-pile selector jack and the high-pile selector jack used in the present preferred embodiment. FIGS. 5A, 5B and 5C show the types of the low-pile selector jack 31, and FIGS. 5D, 5E and 5F show the types of the high-pile selector jack 35. The low-pile selector jack 31 includes two selector butts 32. More specifically, the low-pile selector jack 31 includes selector butts 32*a* and 32*d*, 32*b* and 32*e*, or 32*c* and 32*f*, as shown in FIGS. 5A, 5B and 5C. The high-pile selector jack 35 includes a selector butt 36, i.e., a selector butt 36*a*, 36*b*, or 36*c* as shown in FIGS. 5D, 5E and 5F. The selector butts 32 and 36 are portions arranged to be subjected to the action of the actuator 50.

The low-pile selector jack 31 includes the aforementioned selector butts 32, a leading end 31*a* which is arranged to push the low-pile sinker 21 arranged radially inside the low-pile selector jack 31, a rear end 31*b* opposite to the leading end 31*a*, and a butt 34 which is arranged to be subjected to the action of the fifth cam 66 described later. Similarly, the high-pile selector jack 35 includes the aforementioned butt 36, a leading end 35*a* which is arranged to push the high-pile sinker 25 arranged radially inside the high-pile selector jack 35, a rear end 35*b* opposite to the leading end 35*b*, and a butt 38 which is arranged to be subjected to the action of the fifth cam 66. The selector butts 32 are provided on the bottom 31*c* of an extending portion of the selector jack 31 to project downward. Similarly, the selector butt 36 is provided on the bottom 35*c* of an extending portion of the selector jack 35 to project downward. Selector bosses 33 and 37 are provided on the top of the extending portion of the corresponding selector jacks 31 and 35 to project upward. The selector bosses 33 and 37 are opposed to each other and to be subjected to the action of the first cam 62 described later.

In the first horizontal groove 7 (701) of the sinker bed 6 shown in FIG. 2, a pair of sinkers 20, the low-pile selector jack 31 including the first-step selector butt 32*a* and the fourth-step selector butt 32*d* shown in FIG. 5A, the high-pile selector jack 35 including the fourth-step selector butt 36*a* shown in FIG. 5D, and the separator 40 described later are accommodated. In the second horizontal groove 7 (702) of the sinker bed 6, a pair of sinkers 20, the low-pile selector jack 31 including the second-step selector butt 32*b* and the fifth-step selector butt 32*e* shown in FIG. 5B, the high-pile selector jack 35 including the fifth-step selector butt 36*b* shown in FIG. 5E, and the separator 40 are accommodated. In the third horizontal groove 7 (703) of the sinker bed 6, a pair of sinkers 20, the low-pile selector jack 31 including the third-step selector butt 32*c* and the sixth-step selector butt 32*f* shown in FIG. 5C, the high-pile selector jack 35 including the sixth-step selector butt 36*c* shown in FIG. 5F, and the separator 40 are accommodated.

After the fourth horizontal groove 7 (704) of the sinker bed 6, the arrangement for the first to third horizontal grooves 701 to 703 is repeated. In this preferred embodiment, an example is described where the number of steps of the selector butts preferably is three. However, the number of the steps may be one or two, or four or more as long as the rotation speed of the knitting-needle cylinder 2 corresponds to the response speed of the actuator 50 electronically controlled by a signal.

The selector butt 32*d* provided in the low-pile selector jack 31 shown in FIG. 5A and the selector butt 36*a* provided in the high-pile selector jack 35 shown in FIG. 5D are located at substantially the same radial position. When those selector jacks 31 and 35 are assumed to form a pair, the selector butt 32*d* and the selector butt 36*a* in that pair are opposed to each other and therefore can be referred to as selector butts as common components. This is the same for the selector butt 32*e* shown in FIG. 5B and the selector butt 36*b* shown in FIG. 5E, and the selector butt 32*f* shown in FIG. 5C and the selector butt 36*c* shown in FIG. 5F. Moreover, the selector butt 32*a* provided in the low-pile selector jack 31 shown in FIG. 5A has no corresponding selector butt in the high-pile selector jack 35 shown in FIG. 5D, and therefore can be referred to as a single component.

Figure 6:
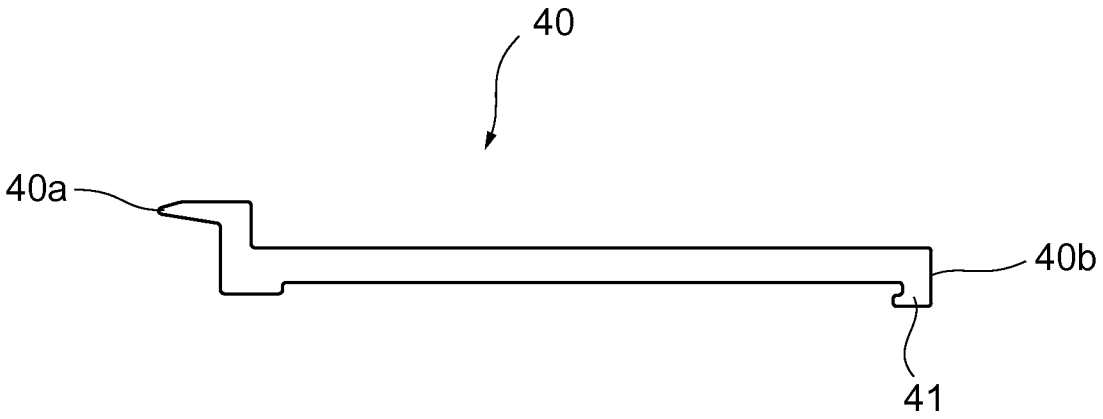
FIG. 6 is a side view of the separator used in the first preferred embodiment of the present invention.

Returning to FIG. 4, the separator 40 is arranged between the low-pile sinker 21 and the high-pile sinker 25 and between the high-pile sinker 25 and the high-pile selector jack 35. Referring to FIG. 6, the separator 40 has a leading end portion 40*a* having a shape corresponding to a portion of the low-pile sinker 21 and a portion of the high-pile sinker 25. At the bottom of a rear end portion 40*b* of the separator 40, a fixing butt 41 operable to fix the separator 40 to the horizontal groove 7 is provided. The separator 40 preferably has a thickness of about 0.15 mm to about 0.25 mm in this example, and is formed in a shape of a plate by steel or the like, for example. Because of the separator 40, the low-pile sinker and selector jack 21 and 31 can be prevented from adhering to the high-pile sinker and selector jack 25 and 35.

Figure 7A:
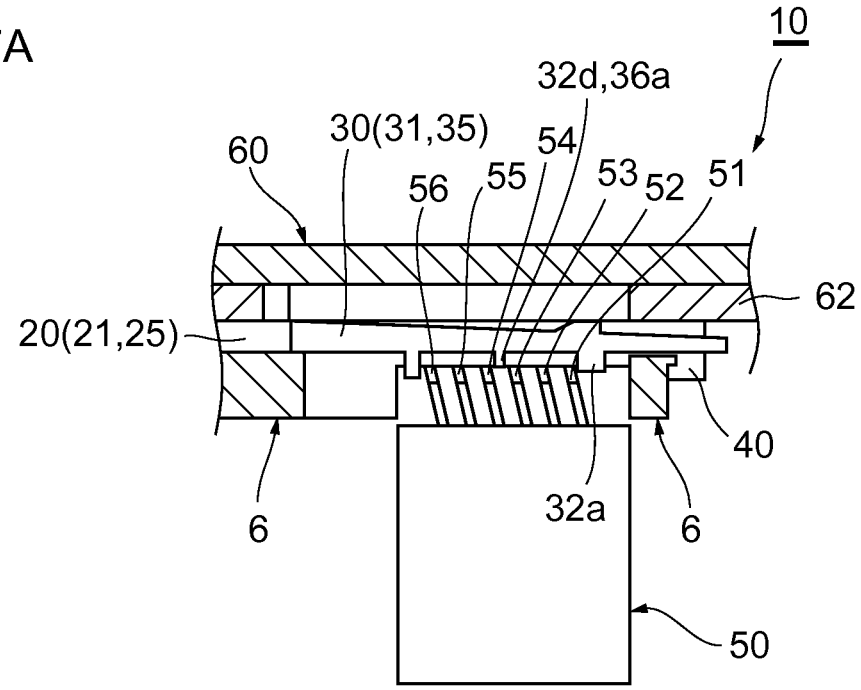
FIG. 7A is a cross-sectional view of a portion of the stitch forming device including an actuator.

FIG. 7A is a cross-sectional view of a portion of the stitch forming device 10 which includes the actuator 50, when the low-pile selector jack 31 shown in FIG. 5A and the high-pile selector jack 35 shown in FIG. 5D are located above the actuator 50. The actuator 50 is arranged below the sinker bed 6, as shown in FIG. 7A, to selectively act on the selector butts 32 and 36 of a pair of selector jacks 30. The actuator 50 includes heads 51, 52, and 53 corresponding to the selector butts 32*a*, 32*b*, and 32*c* as single components (see FIGS. 5A to 5C), respectively, and heads 54, 55, and 56 corresponding to the selector butts 32*d* and 36*a*, 32*e* and 36*b*, and 32*c* and 36*c* as common components (see FIGS. 5A to 5F), respectively.

Figure 7B:
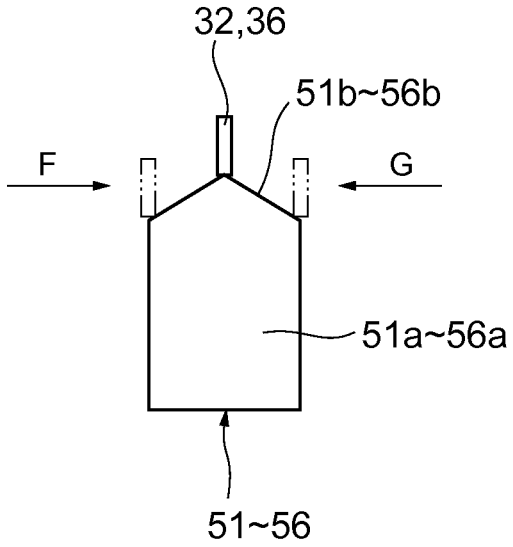
FIG. 7B is a front view of a head included in the actuator of FIG. 7A.

FIG. 7B is a view of one of the heads 51 to 56 of the actuator when seen from the radially inside. Please note that the heads 51 to 56 preferably have the same or substantially the same structure. The heads 51 to 56 include main surfaces 51*a* to 56*a*, respectively, which are perpendicular or substantially perpendicular to the extending direction of the low-pile selector jack 31 and the high-pile selector jack 35 which are movable in a direction F (reverse rotation direction) or a direction G (forward rotation direction) in accordance with rotation of the sinker bed 6. In this example, the heads 51 to are plate-shaped members including top ends 51*b* to 56*b*, respectively. The heads 51 to 56 are operable to act on those selector jacks 31 and 35 selectively by bringing the top ends 51*b* to 56*b* into contact with the selector butts 32 and 36 of the low-pile selector jack 31 and the high-pile selector jack 35.

Each of the top ends 51*b* to 56*b* is symmetrical about its center line extending in the vertical direction in FIG. 7B, for example. Thus, the actuator 5 can act on the selector butts 32 and 36 via the heads 51 to 56 in the same or substantially the same manner both in a case where the knitting-needle cylinder 2 rotates in a counterclockwise direction (hereinafter, this rotation is referred to as forward rotation) when the circular knitting machine 1 is seen from above and in a case where the knitting-needle cylinder 2 rotates in a clockwise direction (hereinafter, this rotation is referred to as reverse rotation). Consequently, even during a reciprocating rotation in which one revolution of the knitting-needle cylinder 2 in the direction of forward rotation and one revolution in the direction of the reverse rotation are alternately repeated, the same or substantially the same control as control for forward rotation only and control for reverse rotation only can be performed.

Figure 8:
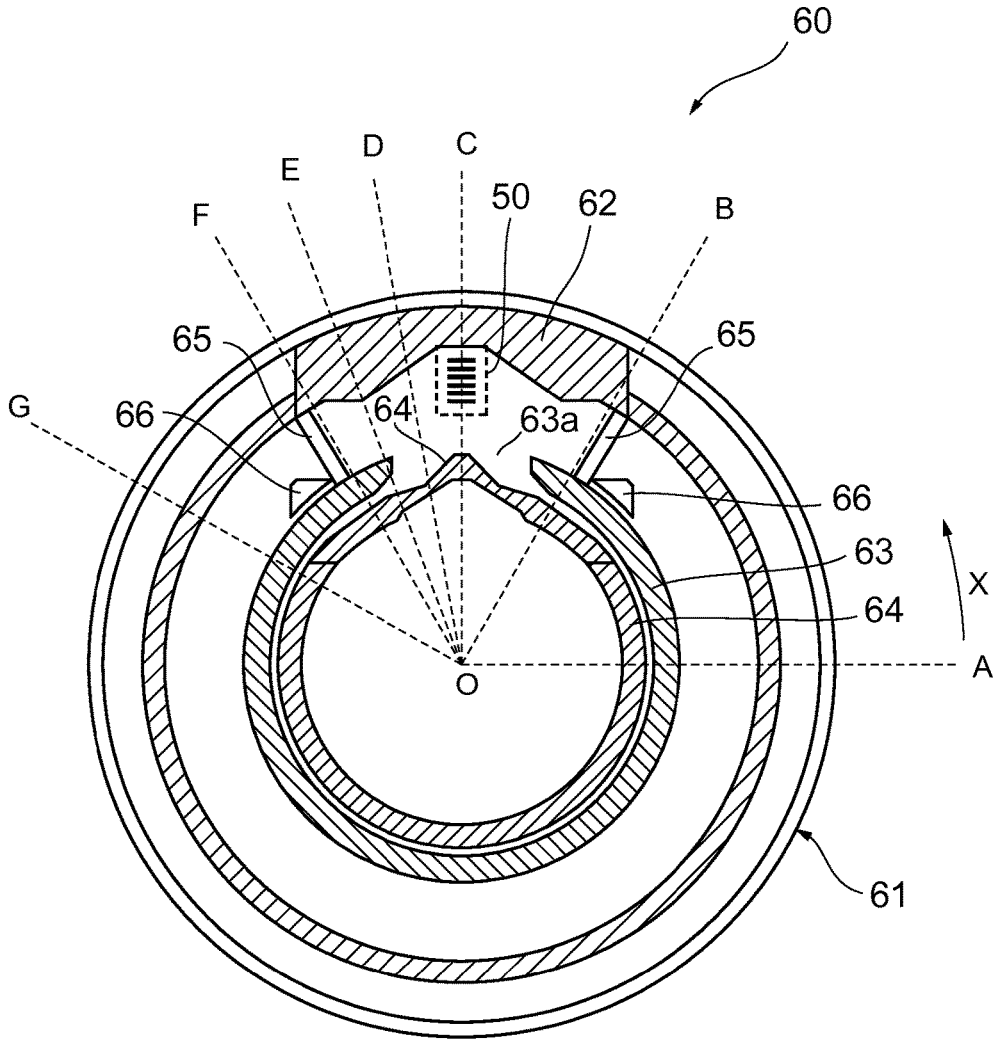
FIG. 8 is a plan view of a sinker cap, showing an arrangement of a group of cams provided in the sinker cap according to the first preferred embodiment of the present invention.

FIG. 8 is a plan view of a sinker cap 60 and shows the arrangement of a group of cams provided in the sinker cap 60. The disk-shaped sinker cap 60 is arranged above the sinker bed 6 (shown in FIG. 2) and is supported by a machine table (not shown) not to be rotatable with a cam-containing surface 61 facing down. The cams 62 to 66 are provided on the cam-containing surface 61 of the sinker cap 60. FIG. 8 shows the sinker cap 60 when seen from above, and the cams are shown with solid line although they are located on the bottom side of the sinker cap 60. Also, FIG. 8 shows the arrangement of the actuator 50 with broken line, when seen from above.

The group of cams includes at least the first cam 62 arranged at a radially outer position, the second cam 63 arranged radially inside the first cam 62 in form of a ring including an opening 63*a*, the third cam 64 arranged radially inside the second cam 63 in form of an approximate ring, the fourth cam 65 arranged between the first cam 62 and the second cam 63 in the radial direction near the opening 63*a* of the second cam 63, and the fifth cam 66 arranged between the first cam 62 and the second cam 63 in the radial direction adjacent to the fourth cam 65, as shown in FIG. 8.

The first cam 62 is operable to act on the outside of the selector busses 33 and 37 of the low-pile selector jack 31 and the high-pile selector jack 35. The second cam 63 is operable to act on the outside the butts 24 and 28 of the low-pile sinker 21 and the high-pile sinker 25. The third cam 64 is operable to act on the inside of the butts 24 and 28 of the sinkers 21 and 25. The fourth cam 65 is operable to act on the upper portions of the selector bosses 33 and 37 of the selector jacks 31 and 35. The fifth cam 66 is operable to act on the butts 34 and 38 of the selector jacks 31 and 35.

Figure 9:
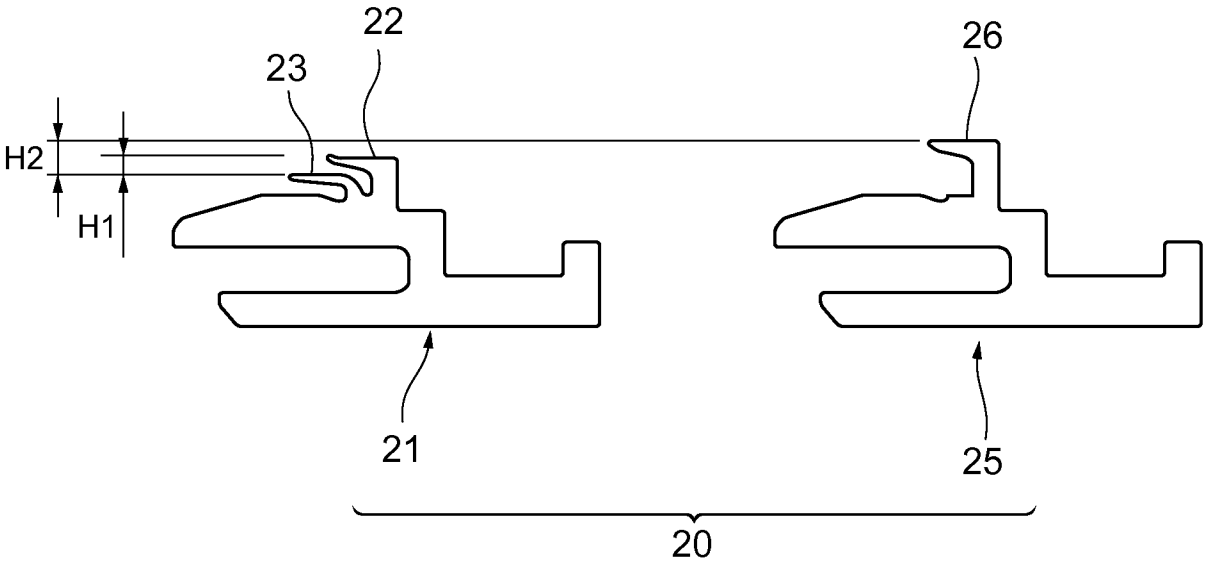
FIG. 9 shows a level difference between nibs provided in the low-pile sinker and a nib provided in the high-pile sinker shown in FIGS. 3A and 3B.

Next, the arrangement of the circular knitting machine 1 of this preferred embodiment which allows the plain stitch $P_0$, the low-pile stitch $P_1$, and the high-pile stitch P2 shown in FIG. 1 to be formed is described. FIG. 9 shows a level difference between the nibs of the low-pile sinker and the high-pile sinker opposed to each other. The low-pile nib 22 and the small nib 23 of the low-pile sinker 21 are different from the high-pile nib 26 of the high-pile sinker 25 in level (or position in the vertical direction), as shown in FIG. 9. The distance H2 between the small nib 23 and the high-pile nib 26 is longer than the distance H1 between the small nib 23 and the low-pile nib 22. The circular knitting machine 1 of this preferred embodiment can form different knitting structures by using this level difference (difference between the distances H1 and H2). The difference between the distances H1 and H2, i.e., (H2−H1) preferably is from about 0.5 mm to about 2.5 mm, for example.

Figure 10A:
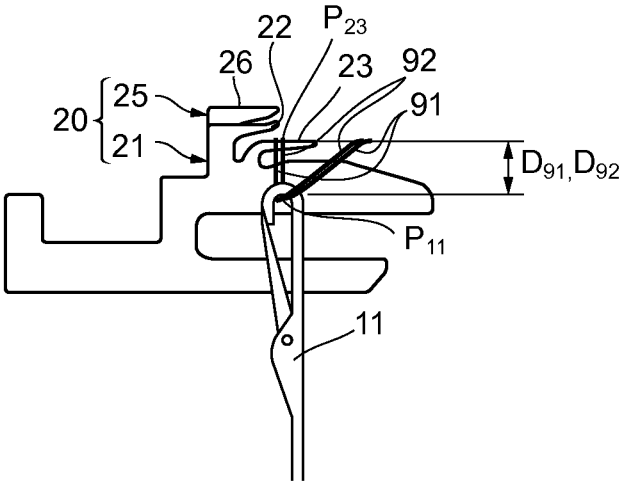
FIGS. 10A, 10B and 10C show how to hold a pile yarn and a ground yarn during formation of a plain stitch, a low-pile stitch, and a high-pile stitch, respectively.
Figure 10B:
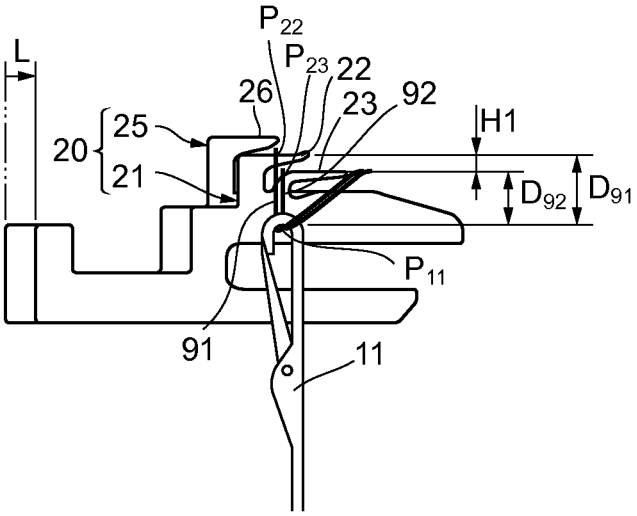
Figure 10C:
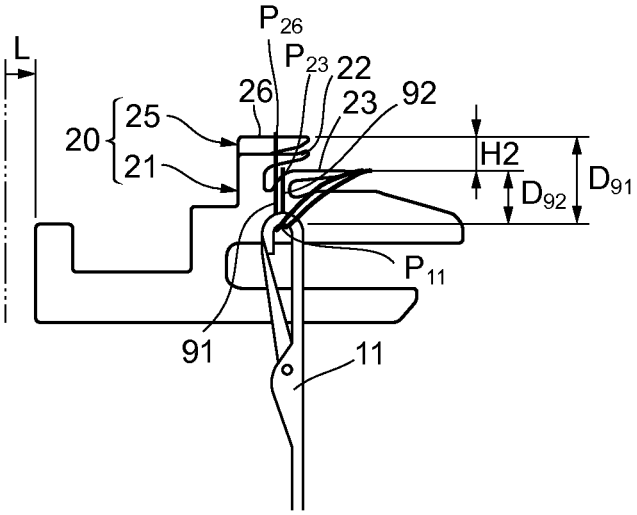

Sinker loop lengths during stitch formation are determined by distances from contact points $P_{22}$, $P_{23}$, and $P_{26}$ of the pile yarn 91 and the ground yarn 92 with the respective nibs 22, 23, and 26 to a contact point $P_{11}$ of the pile yarn 91 and the ground yarn 92 with the knitting needle 11, as shown in FIGS. 10A, 10B and 10C. In other words, when the knitting needle 11 draws the pile yarn 91 and the ground yarn 92 into an old loop, it is possible to select which one of the knitting structures is to be formed based on which one of the nibs is used to hold the pile yarn 91 and the ground yarn 92. Selection of the nib can be achieved by moving the low-pile sinker 21 and the high-pile sinker 25 forward selectively, as shown in FIGS. 10A to 10C.

In a case where the low-pile sinker 21 and the high-pile sinker 25 are not moved from predetermined positions with respect to the knitting needle 11, i.e., they are not moved forward, as shown in FIG. 10A, both the pile yarn 91 and the ground yarn 92 are held by the small nib 23 of the low-pile sinker 21. In this state, the distance $D_{91}$ from the contact point $P_{23}$ between the pile yarn 91 and the small nib 23 to the contact point $P_{11}$ between the pile yarn 91 and the knitting needle 11 is equal to the distance $D_{92}$ from the contact point $P_{23}$ between the ground yarn 92 and the small nib 23 to the contact point $P_{11}$ between the ground yarn 92 and the knitting needle 11. Therefore, when the knitting needle 11 draws the pile yarn 91 and the ground yarn 92 into an old loop in the state shown in FIG. 10A, a plain stitch $P_0$ in which the sinker loop length of the pile yarn 91 is the same as that of the ground yarn 92 is formed.

In a case where only the low-pile sinker 21 has been moved from the predetermined position toward the knitting needle 11 (i.e., moved forward) by a distance L, as shown in FIG. 10B, the pile yarn 91 is held by the low-pile nib 22 of the low-pile sinker 21 while the ground yarn 92 is held by the small nib 23 of the low-pile sinker 21. In this state, the distance $D_{91}$ from the contact point $P_{22}$ between the pile yarn 91 and the low-pile nib 22 to the contact point $P_{11}$ between the pile yarn 91 and the knitting needle 11 is different from the distance $D_{92}$ from the contact point $P_{23}$ between the ground yarn 92 and the small nib 23 to the contact point $P_{11}$ between the ground yarn 92 and the knitting needle 11 by the distance H1. Therefore, when the knitting needle 11 draws the pile yarn 91 and the ground yarn 92 into an old loop in the state shown in FIG. 10B, a low-pile stitch $P_1$ in which the sinker loop length of the pile yarn 91 is longer than that of the ground yarn 92 is formed. In this case, the difference between the sinker loop length of the pile yarn 91 and that of the ground yarn 92 is preferably twice or about twice the distance H1.

In a case where both the low-pile sinker 21 and the high-pile sinker 25 have been moved from the predetermined positions toward the knitting needle 11 (i.e., moved forward) by the distance L, as shown in FIG. 10C, the pile yarn 91 is held by the high-pile nib 26 of the high-pile sinker 25 and the ground yarn 92 is held by the small nib 23 of the low-pile sinker 21. In this state, the distance $D_{91}$ from the contact point $P_{26}$ between the pile yarn 91 and the high-pile nib 26 to the contact point $P_{11}$ between the pile yarn 91 and the knitting needle 11 is different from the distance $D_{92}$ from the contact point $P_{23}$ between the ground yarn 92 and the small nib 23 to the contact point $P_{11}$ between the ground yarn 92 and the knitting needle 11 by the distance H2. The distance H2 is longer than the distance H1. Therefore, when the knitting needle 11 draws the pile yarn 91 and the ground yarn 92 into an old loop in the state shown in FIG. 10C, a high-pile stitch $P_2$ in which the sinker loop of the pile yarn 91 is longer than that of the ground yarn 92 is formed. The difference between the sinker loop length of the pile yarn 91 and that of the ground yarn 92 is preferably twice or about twice the distance H2.

Next, operations of the circular knitting machine 1 of this preferred embodiment are described referring to FIGS. 11A to 18B showing the arrangement of a pair of sinkers 20, a pair of selector jacks 30 and the separator 40. Hereinafter, the sinkers 20 (the low-pile sinker 21 and the high-pile sinker 25), the selector jacks 30 (the low-pile selector jack 31 and the high-pile selector jack 35), and the separator 40 which are arranged in the same horizontal groove 7 are collectively referred to as a sinker unit 8.

The sinker unit 8 rotates together with the sinker bed 6. The sinker bed 6 is arranged to be opposed to the cam-containing surface 61 of the sinker cap 60. Therefore, the sinker unit 8 is moved from positions O-A to O-G on the sinker cap 60 in that order (see FIG. 8) when seen from above. In this description, the sinker unit 8 accommodated in the first horizontal groove 701 of the sinker bed 6, which includes the low-pile selector jack 31 shown in FIG. 5A and the high-pile selector jack 35 shown in FIG. 5D, is described as an example.

Figure 11A:
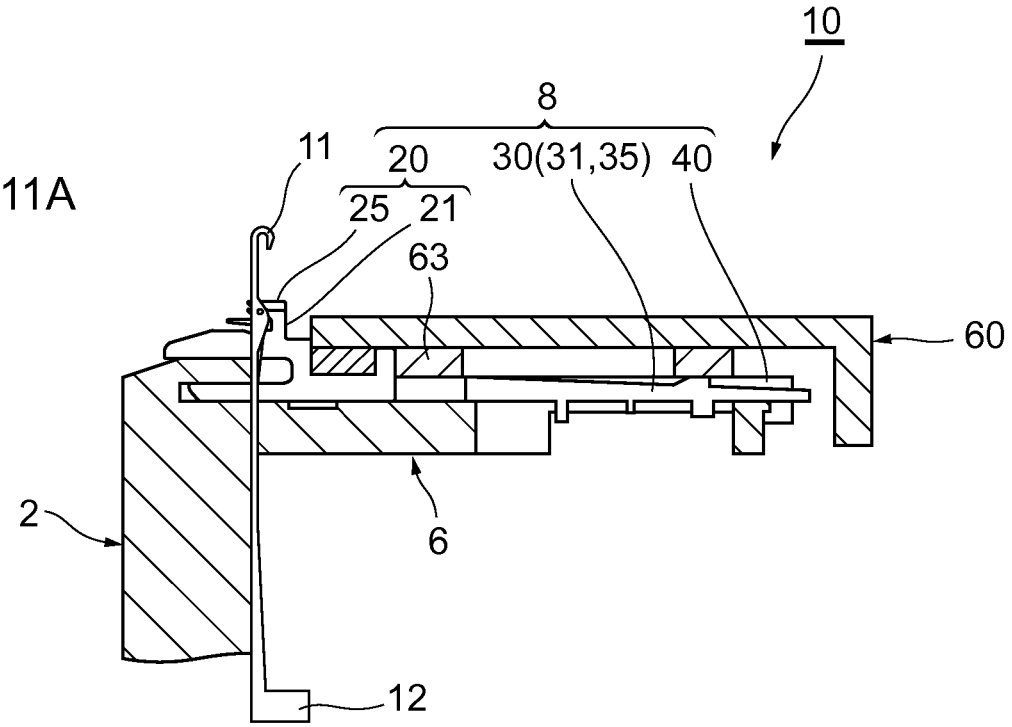
FIGS. 11A and 11B are cross-sectional views of a portion of the stitch forming device in the first preferred embodiment of the present invention, taken along line O-A and line O-B in FIG. 8, respectively.
Figure 11B:
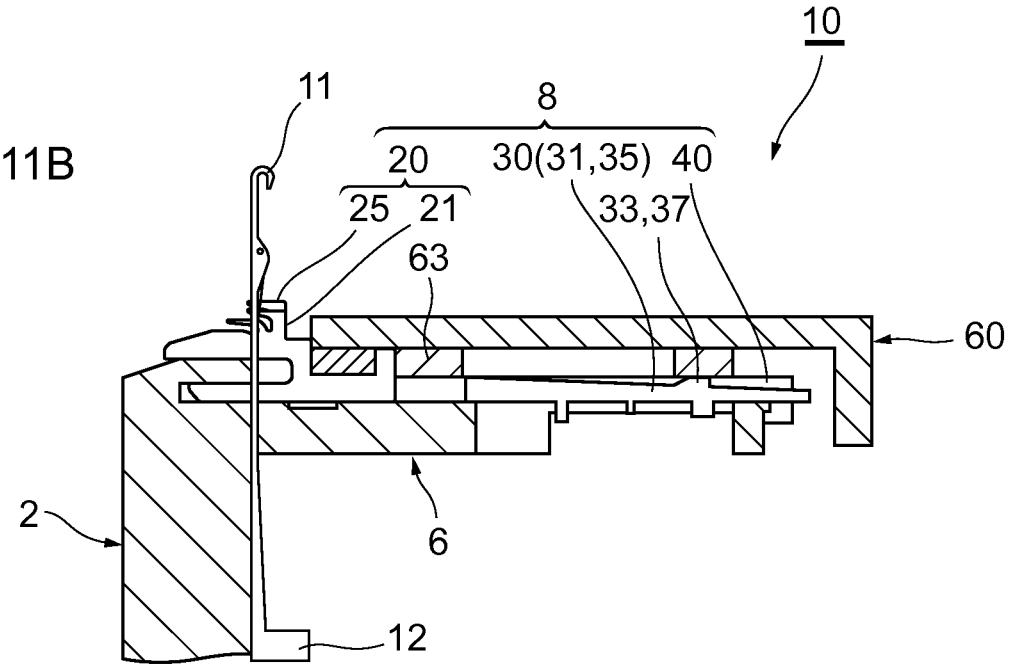

The operation of the circular knitting machine 1 for forming a low-pile stitch P1 will now be described. FIGS. 11A and 11B show states of the sinker unit 8 located at the positions O-A and O-B on the sinker cap 60, respectively.

At the position O-A, the sinkers 20 are spaced away from the selector jacks 30. With the rotation of the knitting-needle cylinder 2 (in a direction X shown in FIG. 8), the sinker unit 8 moves from the position O-A to the position O-B. During the movement, a knitting-needle butt 12 integrally formed with the knitting needle 11 is subjected to the action of a stitch cam 80 (see FIG. 2) so that the knitting needle 11 is moved upward. Thus, the pile yarn 91 and the ground yarn 92 forming a new loop, both of which are not shown in FIGS. 11A and 11B, are held by the knitting needle 11. When the sinker unit 8 has reached the position O-B, because of the action of the stitch cam 80 on the knitting butt 12, the knitting needle 11 holding the pile yarn 91 and the knitting yarn 92 starts moving down.

At the position O-B, the sinkers 20 are spaced away from the selector jacks 30, and the selector bosses 33 and 37 of the low-pile selector jack 31 and the high-pile selector jack 35 are located below the first cam 62. Therefore, the first cam 62 does not act on the selector bosses 33 and 37 at this time.

Figure 12A:
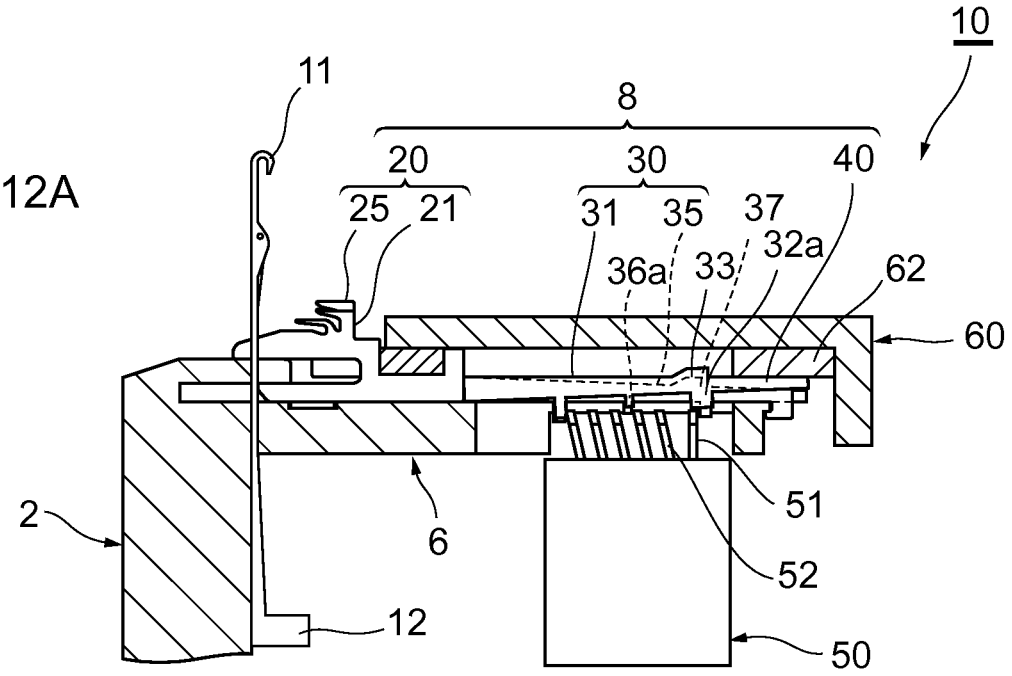
FIGS. 12A and 12B are cross-sectional views of a portion of the stitch forming device in the first preferred embodiment of the present invention, taken along line O-C and line O-D in FIG. 8, respectively.

FIG. 12A shows a state of the sinker unit 8 located at the position O-C. With the rotation of the knitting-needle cylinder 2, the sinker unit 8 moves closer to the position O-C. During this movement, the inside of the butts 24 and 28 of the low-pile sinker 21 and the high-pile sinker 25 are subjected to the action of the third cam 64 so as to move radially outward. Also, if a signal is input from a selection signal output device (not shown) to the actuator 50 at this time, the head 51 which is arranged to be pivotable is changed from an inclined state to a standing state. FIG. 12A shows the head 51 in the standing state and the head 52 on the left side of the head 51 in the inclined state.

When the sinker unit 8 has reached the position O-C, the selector butt 32*a* of the low-pile selector jack 31 is subjected to the action of the head 51 in the standing state (first step). The low-pile selector jack 31 thus subjected to the action of the head 51 is moved upward. On the other hand, the high-pile selector jack 35 does not have the selector butt 36*a* at the position which can be subjected to the action of the standing head 51. Therefore, the high-pile selector jack 35 is not subjected to the action of the head 51. At this time, the first cam 62 is located outside the selector bosses 33 and 37 of the low-pile selector jack 31 and the high-pile selector jack 35.

Figure 12B:
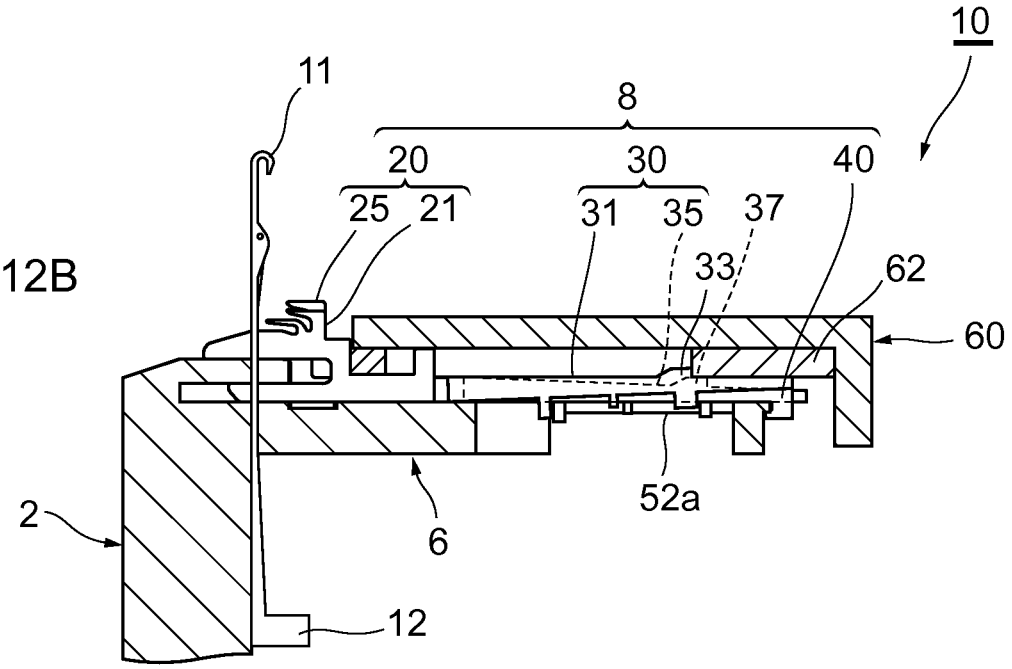

FIG. 12B shows a state of the sinker unit 8 located at the position O-D. When the sinker unit 8 has reached the position O-D, the first cam 62 engages with the outside of the selector boss 33 of the low-pile selector jack 31 which has been moved upward to act radially inward (second step). Thus, the low-pile selector jack 31 is pushed out radially inwardly. On the other hand, the high-pile selector jack 35 is not moved upward by the head 51 of the actuator 50. Thus, the outside of the selector boss 37 of the high-pile selector jack 35 cannot engage with the first cam 62. Therefore, the selector boss 37 is not subjected to the radially inward action of the first cam 62. In this manner, the low-pile selector jack 31 is placed at a radially inner position with respect to the high-pile selector jack 35, i.e., the low-pile selector jack 31 has moved forward or radially inward with respect to the high-pile selector jack 35.

Figure 13A:
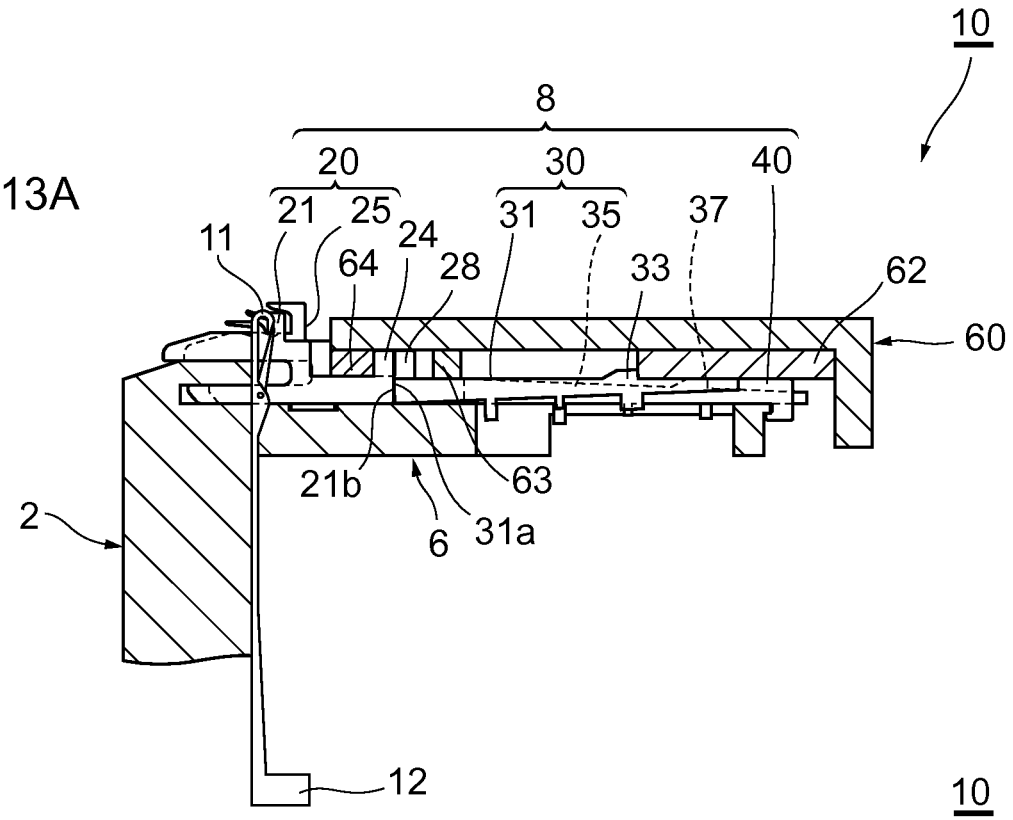
FIGS. 13A and 13B are cross-sectional views of a portion of the stitch forming device in the first preferred embodiment of the present invention, taken along line O-E and line O-F in FIG. 8, respectively.

FIG. 13A shows a state of the sinker unit 8 located at the position O-E. When the sinker unit 8 has reached the position O-E, the action of the first cam 62 on the selector boss 33 causes the leading end 31*a* of the low-pile selector jack 31 moved radially inward to come into contact with the rear end 21*b* of the low-pile sinker 21. Thus, the low-pile sinker 21 is moved radially inward. On the other hand, the high-pile sinker 25 is not moved radially inward by the high-pile selector jack 35, and therefore the high-pile sinker 25 remains unmoved. Consequently, the low-pile sinker 21 is placed at a radially inner position than the high-pile sinker 25 (i.e., the low-pile sinker 21 is moved forward), as shown in FIG. 13A.

Figure 13B:
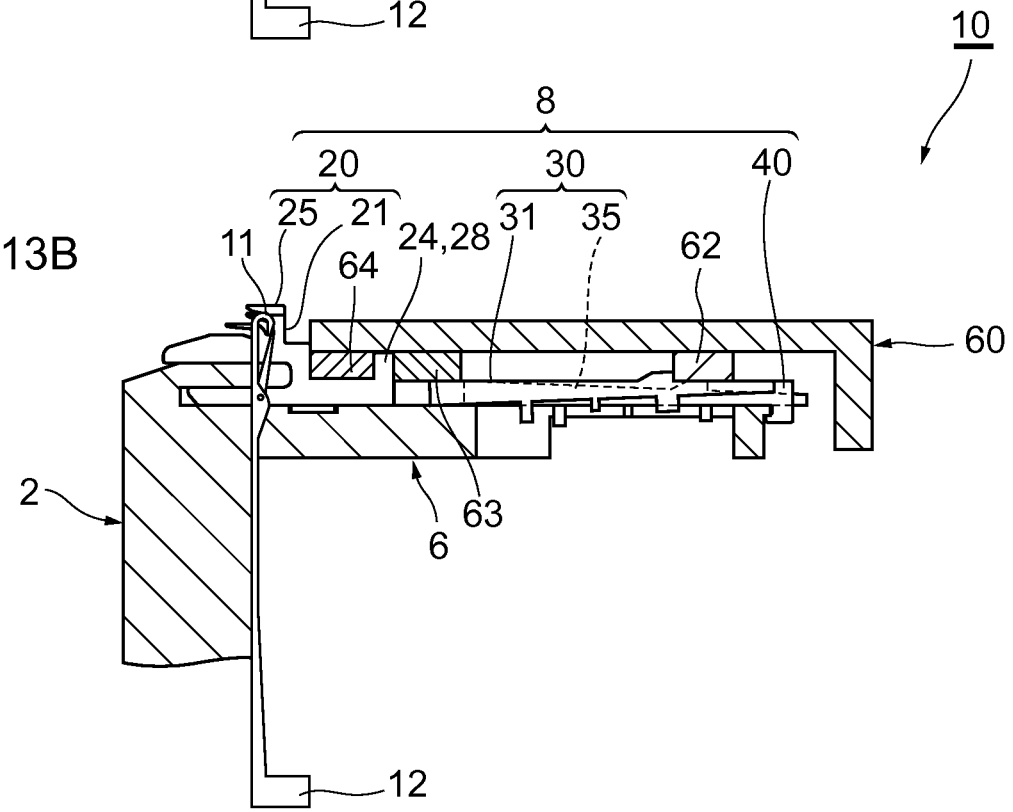

FIG. 13B shows a state of the sinker unit 8 located at the position O-F. During movement of the sinker unit 8 from the position O-D to the position O-E, the knitting needle 11 is subjected to the action of the stitch cam 80 (see FIG. 2) and is moved down, simultaneously with the aforementioned movement of the low-pile sinker 21. In this state, the low-pile sinker 21 has been moved forward (radially inward) with respect to the high-pile sinker 25. Thus, as shown in FIG. 10B, the pile yarn 91 is held by the low-pile nib 22 of the low-pile sinker 21 and the ground yarn 92 is held by the small nib 23. Then, while the sinker unit 8 is being moved from the position O-E to the position O-F, the knitting needle 11 is further moved down. As a result, while the pile yarn 91 is held by the low-pile nib 22 of the low-pile sinker 21 and the ground yarn 92 is held by the small nib 23, the pile yarn 91 and the ground yarn 91 are drawn into an old loop so as to form a low-pile stitch $P_1$.

During the movement of the sinker unit 8 from the position O-E to the position O-F, the butt 28 of the high-pile sinker 25 is subjected to the action of the second cam 62 from the outside. Therefore, the high-pile sinker 25 is moved radially inward. Consequently, the low-pile sinker 21 and the high-pile sinker 25 are placed at the same radial position, as shown in FIG. 13B.

Figure 14:
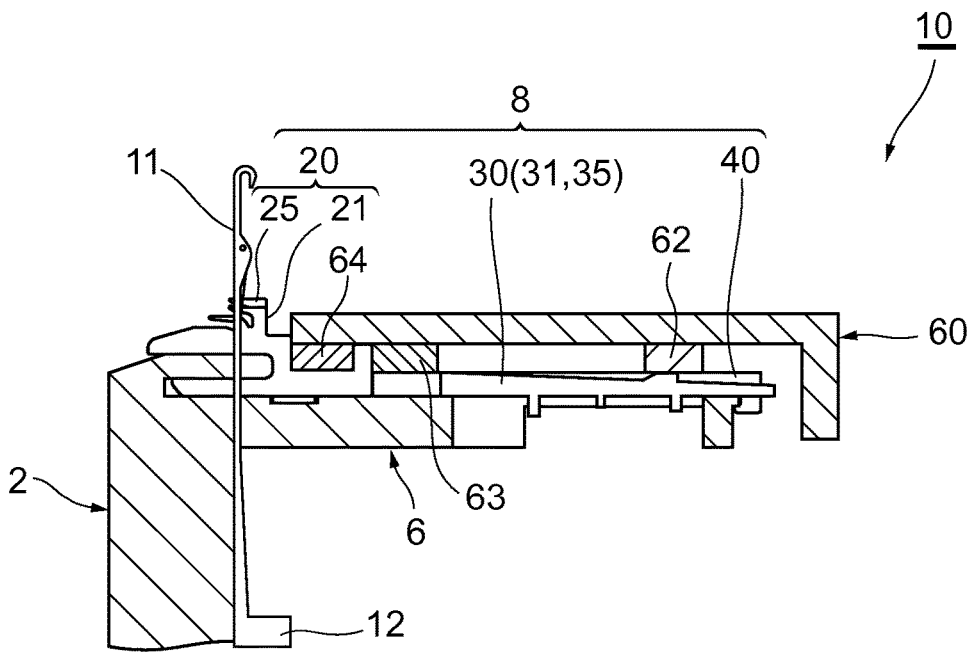
FIG. 14 is a cross-sectional view of a portion of the stitch forming device in the first preferred embodiment of the present invention, taken along line O-G in FIG. 8.

FIG. 14 shows a state of the sinker unit 8 located at the position O-G. During the movement of the sinker unit 8 from the position O-F to the position O-G, the selector boss 33 is subjected to the action of the fourth cam 65 (see FIG. 8), so that the low-pile selector jack 31 is moved down. Also, the butt 34 is subjected to the action of the fifth cam 66 (see FIG. 8), thus moving the low-pile selector jack 31 radially outward.

The operation of the circular knitting machine 1 for forming the low-pile stitch $P_1$ during the reverse rotation (rotation in the opposite direction to the direction X in FIG. 8) of the knitting-needle cylinder 2 is the same or substantially the same as the aforementioned operation during the forward rotation. That is, the same or substantially the same processes as those described for the forward rotation are performed for the reverse rotation of the knitting-needle cylinder 2.

The operation of the circular knitting machine 1 for forming a high-pile stitch $P_2$ will now be described. The states of the sinker unit 8 when it is located at the positions O-A and O-B are the same as those for forming the low-pile stitch $P_1$ described above. Therefore, the detailed description is omitted.

Figure 15A:
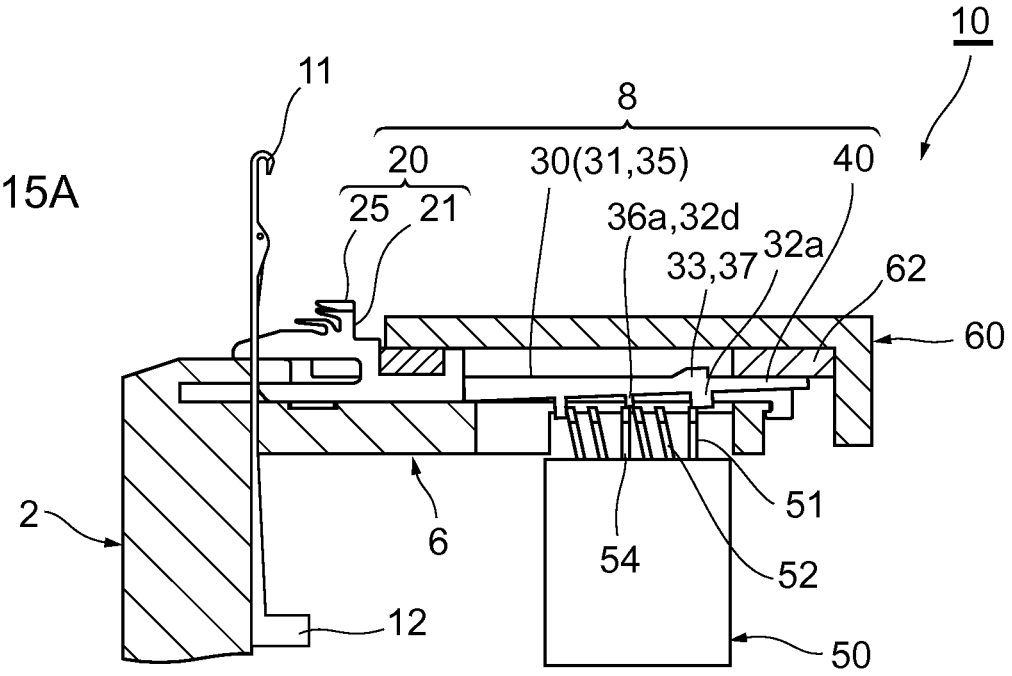
FIGS. 15A and 15B are cross-sectional views of the portion of the stitch forming device in the first preferred embodiment of the present invention, taken along line O-C and line O-D in FIG. 8, respectively.

FIG. 15A shows a state of the sinker unit 8 when it is located at the position O-C. With the rotation of the knitting-needle cylinder 2, the sinker unit 8 moves closer to the position O-C. During this movement, the inside of the butts 24 and 28 of the low-pile sinker 21 and the high-pile sinker 25 are subjected to the action of the third cam 64 so as to be moved radially outward. Also, if a signal is input to the actuator 50 from the selection signal output device (not shown) in this state, the heads 51 and 54 which are operable to be pivotable are changed from the inclined state to the standing state.

When the sinker unit 8 has reached the position O-C, the selector butt 32*a* of the low-pile selector jack 31 is subjected to the action of the head 51 in the standing state (first step). The low-pile selector jack 31 thus subjected to the action of the standing head 51 is moved upward. At the same time, the selector butt 36*a* of the high-pile selector jack 35 is subjected to the action of the head 54 in the standing state. The high-pile selector jack 35 thus subjected to the action of the head 54 is also moved upward.

When the head 54 acts on the selector butt 36*a* of the high-pile selector jack 35, it also acts on the selector butt 32*d* of the low-pile selector jack 31 arranged at the same radial position as the selector butt 36*a*. In other words, the head 54 acts on both the selector butts 32*d* and 36*a* as common components simultaneously. At this time, the first cam 62 is located outside the selector bosses 33 and 37 of the low-pile selector jack 31 and the high-pile selector jack 35.

Figure 15B:
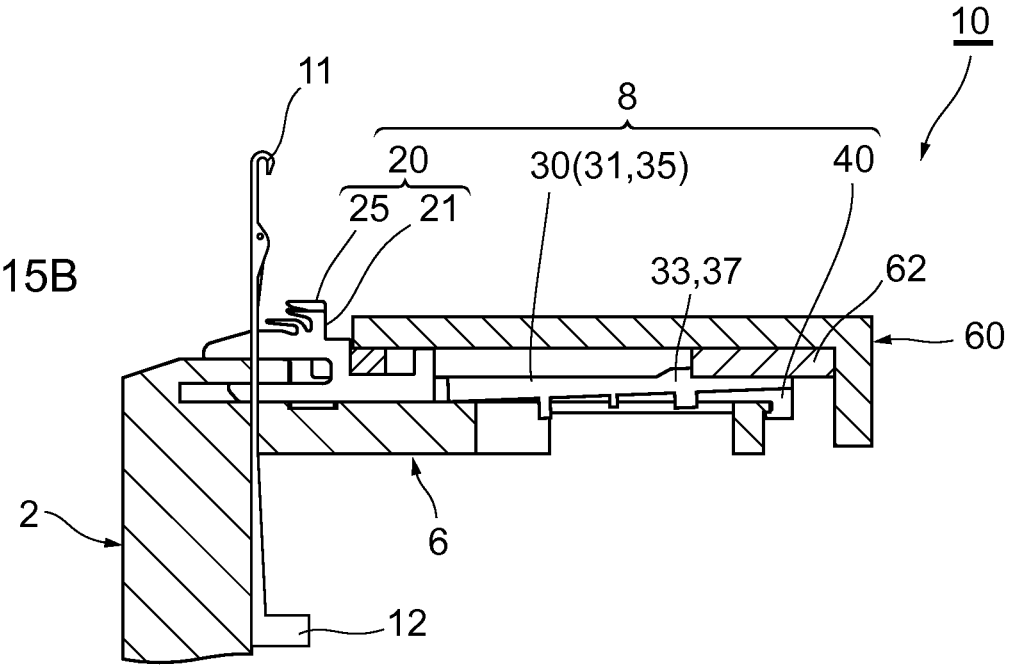

FIG. 15B shows a state of the sinker unit 8 when it is located at the position O-D. When the sinker unit 8 has reached the position O-D, the first cam 62 engages with the outside of the selector bosses 33 and 37 of the low-pile selector jack 31 and the high-pile selector jack 35 which have been moved upward so as to act on the selector bosses 33 and 37 radially inwardly (second step). Thus, the low-pile selector jack 31 and the high-pile selector jack 35 are moved radially inward. As a result, both the low-pile selector jack 31 and the high-pile selector jack 35 have been moved forward.

Figure 16A:
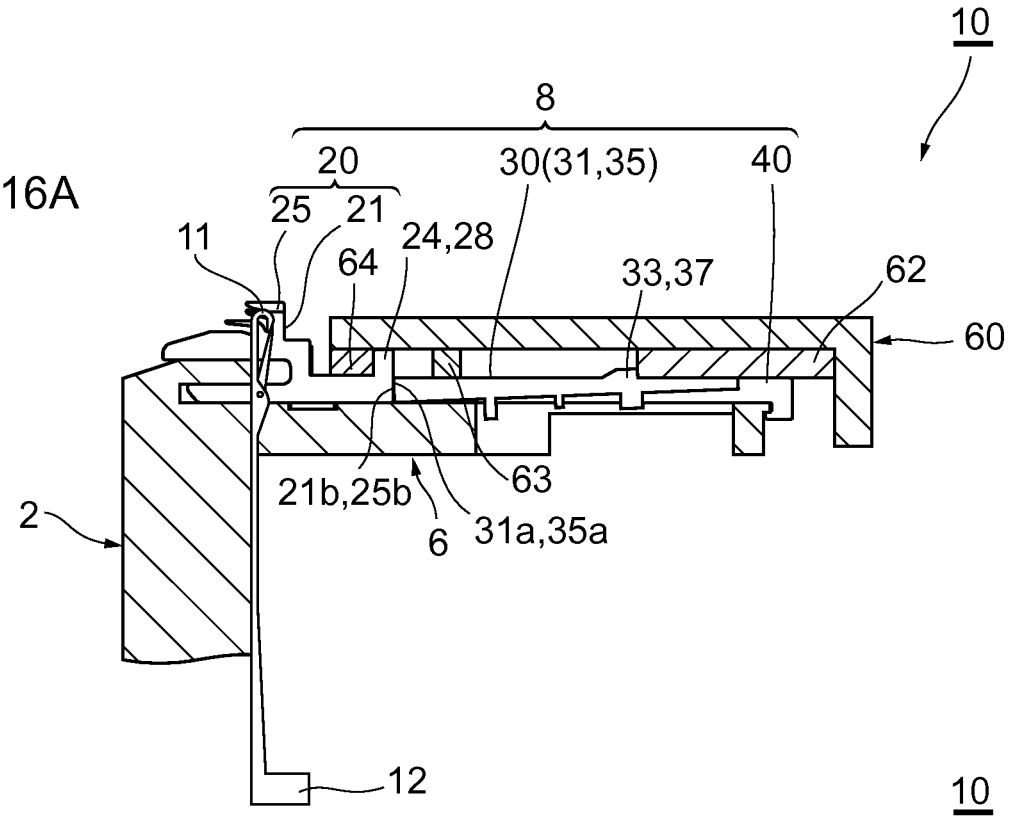
FIGS. 16A and 16B are cross-sectional views of the portion of the stitch forming device in the first preferred embodiment of the present invention, taken along line O-E and line O-F in FIG. 8, respectively.

FIG. 16A shows a state of the sinker unit 8 when it is located at the position O-E. When the sinker unit 8 has reached the position O-E, the leading ends 31*a* and 35*a* of the low-pile selector jack 31 and the high-pile selector jack 35 which have been moved forward come into contact with the rear ends 21*b* and 25*b* of the low-pile sinker 21 and the high-pile sinker 25 and move the low-pile sinker 21 and the high-pile sinker 25 radially inwardly, respectively. As a result, as shown in FIG. 16A, both the low-pile sinker 21 and the high-pile sinker 25 have been moved forward.

During the movement of the sinker unit 8 from the position O-D to the position O-E, the knitting needle 11 is moved down by the action of the stitch cam 80 (see FIG. 2) simultaneously with the aforementioned movement of the low-pile sinker 21 and the high-pile sinker 25. Because both the low-pile sinker 21 and the high-pile sinker 25 have been moved forward, the pile yarn 91 is held by the high-pile nib 26 of the high-pile sinker 25 and the ground yarn 92 is held by the small nib 23, as shown in FIG. 10C. Then, during the movement of the sinker unit 8 from the position O-E to the position O-F, the knitting needle 11 is further moved down. Thus, while the pile yarn 91 is held by the high-pile nib 26 of the high-pile sinker 25 and the ground yarn 92 is held by the small nib 23, the pile yarn 91 and the ground yarn 92 are drawn into an old loop so as to form a high-pile stitch $P_2$.

Figure 16B:
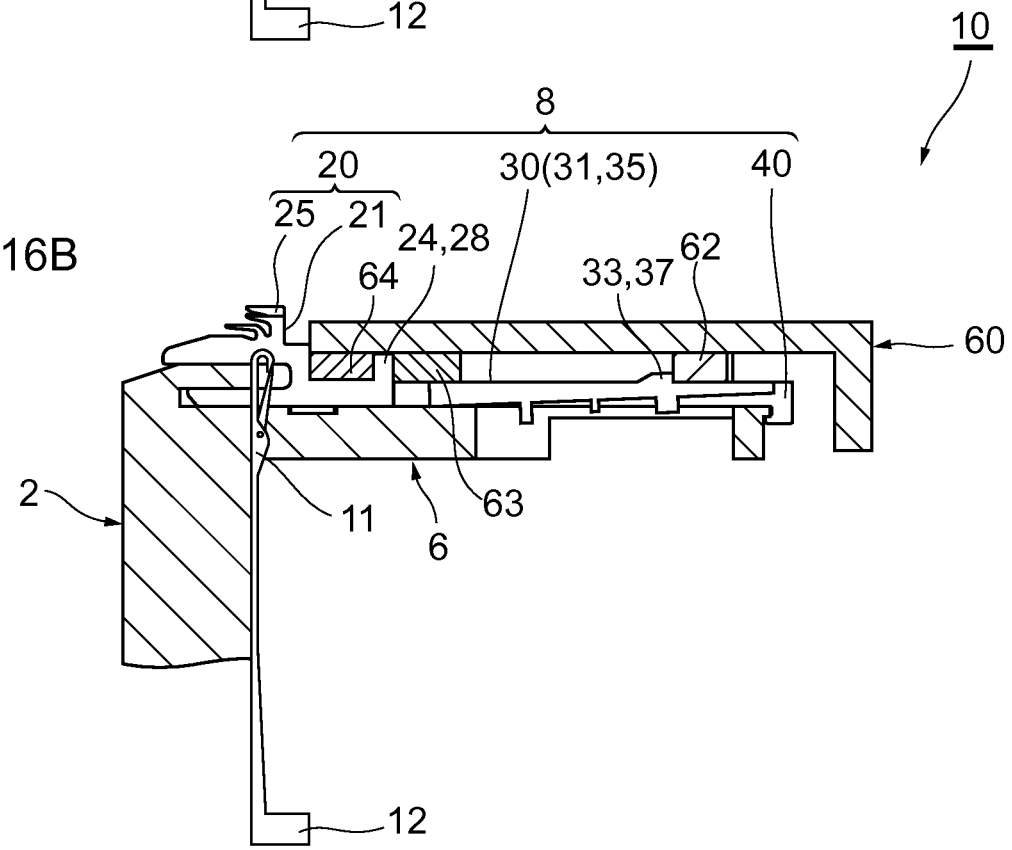

FIG. 16B shows a state of the sinker unit 8 when it is located at the position O-F. During the movement of the sinker unit 8 from the position O-E to the position O-F, the butts 24 and 28 of the low-pile sinker 21 and the high-pile sinker 25 are subjected to the action of the third cam 64 from the inside, so that the low-pile sinker 21 and the high-pile sinker 25 are moved radially outward. The processes during the movement of the sinker unit 8 from the position O-F to the position O-G are the same as those described for formation of the low-pile stitch $P_1$, and therefore the detailed description thereof is omitted.

The operation of the circular knitting machine 1 for forming the high-pile stitch $P_2$ during the reverse rotation (rotation in the opposite direction to the direction X in FIG. 8) of the knitting-needle cylinder 2 is the same as the above. That is, the processes described for the forward rotation are also performed during the reverse rotation of the knitting-needle cylinder 2.

The operation of the circular knitting machine 1 for forming a plain stitch $P_0$ will now be described. The states of the sinker unit 8 when it is located at the positions O-A and O-B are the same as those described for formation of the low-pile stitch $P_1$, and therefore the detailed description is omitted.

Figure 17A:
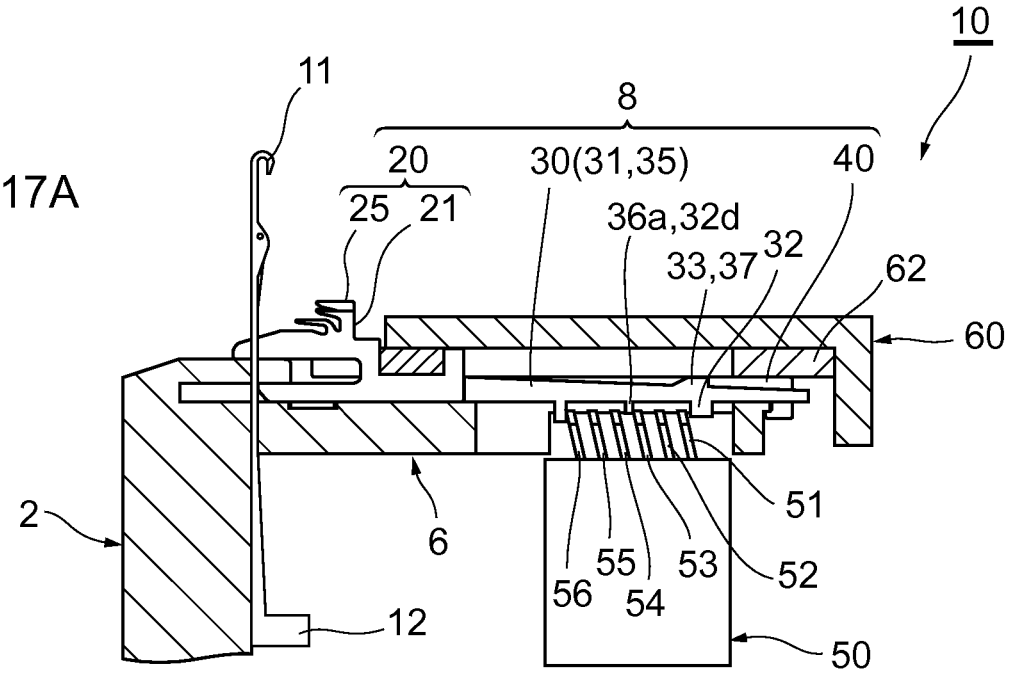
FIGS. 17A and 17B are cross-sectional views of the portion of the stitch forming device in the first preferred embodiment of the present invention, taken along line O-C and line O-D in FIG. 8, respectively.

FIG. 17A shows a state of the sinker unit 8 when it is located at the position O-C. The sinker unit 8 moves closer to the position O-C with the rotation of the knitting-needle cylinder 2. During this, the inside of the butts 24 and 28 of the low-pile sinker 21 and the high-pile sinker 25 are subjected to the action of the third cam 64, so that the sinkers 21 and 25 are moved radially outward. Also, if no signal is input to the actuator 50 from the selection signal output device (not shown) the heads 51 to 56 which are arranged to be pivotable remain inclined.

In this state, even if the sinker unit 8 has reached the position O-C, no action is applied to the selector butts 32*a*, 32*d* and 36*a* of the low-pile selector jack 31 and the high-pile selector jack 35 (first step). The first cam 62 is located outside the selector bosses 33 and 37 of the low-pile selector jack 31 and the high-pile selector jack 35 in this state.

Figure 17B:
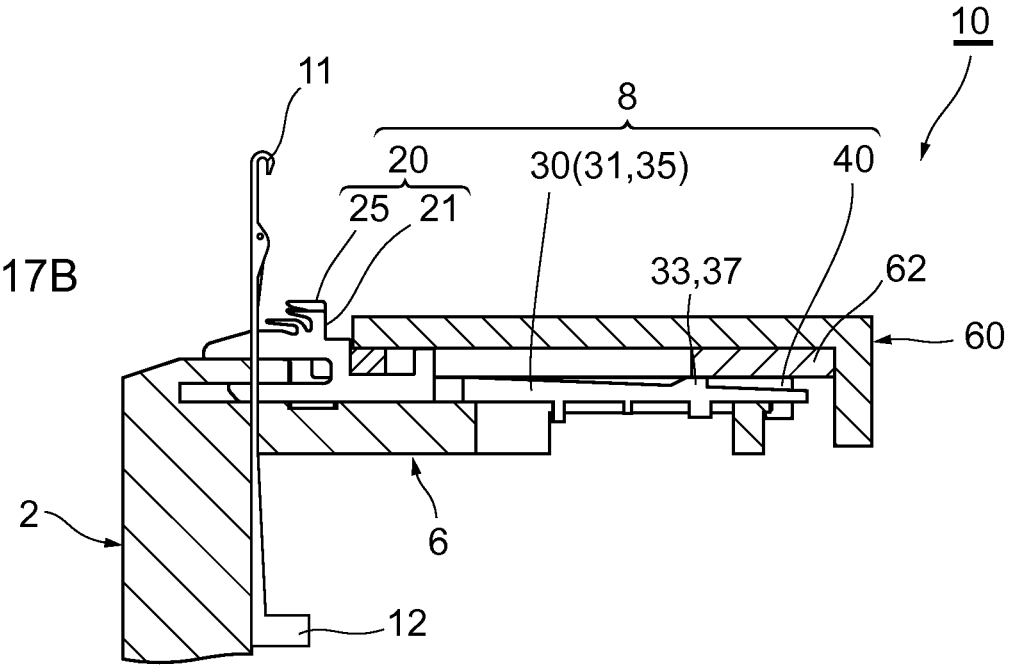

FIG. 17B shows a state of the sinker unit 8 when it is located at the position O-D. Even when the sinker unit 8 has reached the position O-D, the first cam 62 does not engage with the outside of the selector bosses 33 and 37 of the low-pile selector jack 31 and the high-pile selector jack 35. Also, no radially inward action is applied to the selector bosses 33 and 37 (second step). Thus, both the low-pile selector jack 31 and the high-pile selector jack 35 remain unchanged.

Figure 18A:
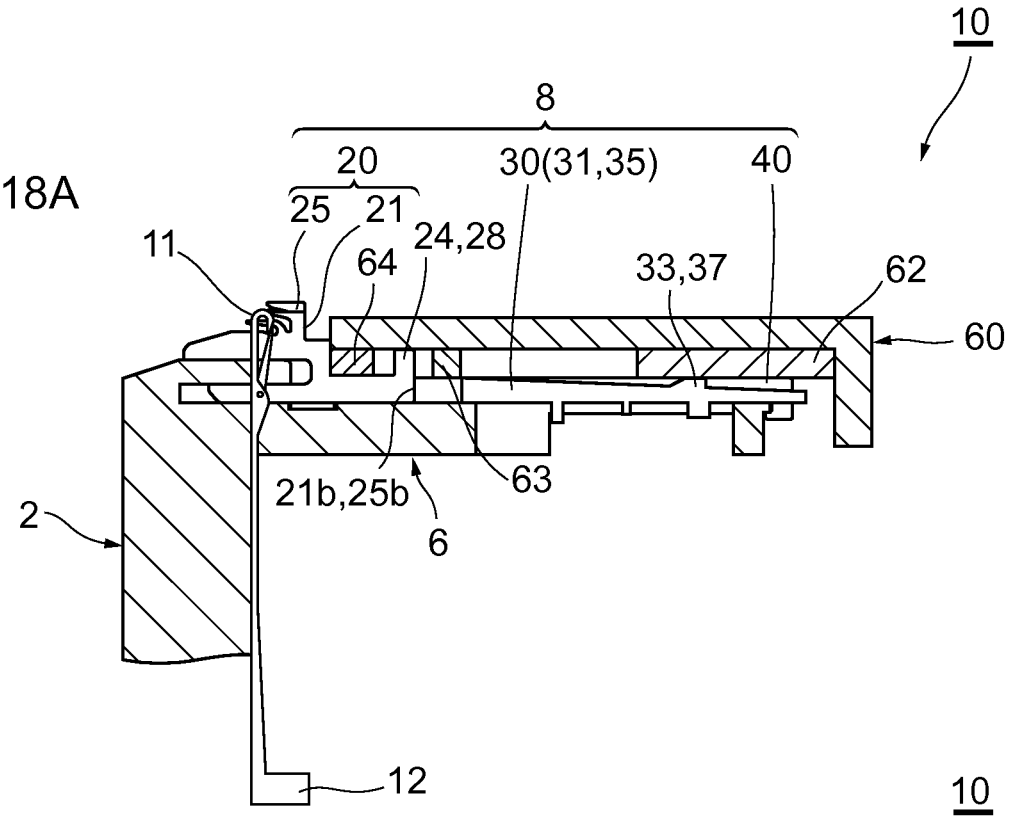
FIGS. 18A and 18B are cross-sectional views of the portion of the stitch forming device in the first preferred embodiment of the present invention, taken along line O-E and line O-F in FIG. 8, respectively.

FIG. 18A shows a state of the sinker unit 8 when it is located at the position O-E. Even when the sinker unit 8 has reached the position O-E, the first cam 62 does not engage with the selector bosses 33 and 37. Also, the low-pile selector jack 31 and the high-pile selector jack 35 are not moved radially inward. Therefore, no action is applied to the rear ends 21*b* and 25*b* of the low-pile sinker 21 and the high-pile sinker 25. Thus, as shown in FIG. 18A, both the low-pile sinker 21 and the high-pile sinker 25 remain unchanged.

During the movement of the sinker unit 8 from the position O-D to the position O-E, the knitting needle 11 is moved down by the action of the stitch cam 80 (see FIG. 20). Because the low-pile sinker 21 and the high-pile sinker 25 keep the original states thereof at this time, both the pile yarn 91 and the ground yarn 92 are held by the small nib 23 of the low-pile sinker 21, as shown in FIG. 10A.

Figure 18B:
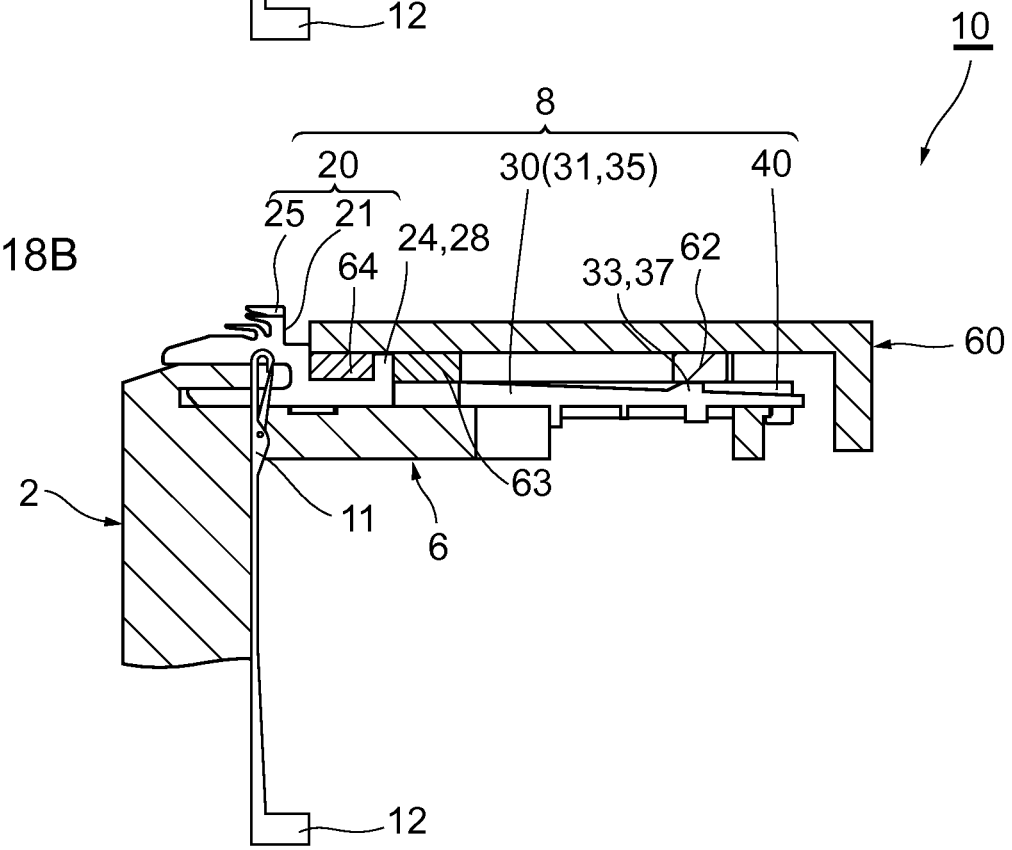

FIG. 18B shows a state of the sinker unit 8 when it is located at the position O-F. During the movement of the sinker unit 8 from the position O-E to the position O-F, the knitting needle 11 is further moved down. Thus, while the pile yarn 91 and the ground yarn 92 are held by the small nib 23 of the low-pile sinker 21, the pile yarn 91 and the ground yarn 92 are drawn into an old loop so as to form a plain stitch $P_0$.

Also during the movement of the sinker unit 8 from the position O-E to the position O-F, the inside of the butts 24 and 28 of the low-pile sinker 21 and the high-pile sinker 25 are spaced away from the rear end of the third cam 64. Therefore, the low-pile sinker 21 and the high-pile sinker 25 are not subjected to the action of the third cam 64. The processes during the movement of the sinker unit 8 from the position O-F to the position O-G are the same as those for forming the low-pile stitch $P_1$. Thus, the detailed description is omitted.

The operation of the circular knitting machine 1 during the reverse rotation (rotation in the opposite direction to the direction X in FIG. 8) of the knitting-needle cylinder 2 is the same or substantially the same as that for forming the plain stitch $P_0$. That is, the same or substantially the same processes described for the forward rotation are also performed during the reverse rotation of the knitting-needle cylinder 2.

A series of operations for forming the low-pile stitch $P_1$, the high-pile stitch $P_2$, and the plain stitch $P_0$ described above are achieved by the actuator 50. Therefore, those three controls can be performed on a stitch-by-stitch basis.

The advantageous effects of the multi-pile knitting machine of the first preferred embodiment will now be described. According to the circular knitting machine 1 of the first preferred embodiment, the difference between the knitting structures, i.e., the sinker loop lengths correspond to the distances from the contact points between the pile yarn 91 and the ground yarn 92 and the low-pile sinker 21 and the high-pile sinker 25 to the contact point between the pile yarn 91 and the ground yarn 92 and the knitting needle 11. Therefore, by selecting one of the contact points between the pile yarn 91 and the ground yarn 92 and the low-pile sinker 21 and the high-pile sinker 25, i.e., selecting where to hold the pile yarn 91 and the ground yarn 92 on the low-pile sinker 21 or the high-pile sinker 25 by moving the low-pile sinker 21 and the high-pile sinker 25 forward/backward selectively, different knitting structures, i.e., the low-pile stitch $P_1$, the high-pile stitch $P_2$, and the plain stitch $P_0$ can be formed. Moreover, the control for forming the low-pile stitch in which the low-pile sinker 21 is moved forward, the control for forming the high-pile stitch in which the high-pile sinker 25 is moved, and the control for forming the plain stitch in which both the low-pile sinker 21 and the high-pile sinker 25 are not moved forward can be selectively performed by the actuator 50. Therefore, a knitted fabric in which different stitches or knitting structures are distributed on a stitch-by-stitch basis can be formed.

In addition, according to the arrangement of the circular knitting machine 1 of the first preferred embodiment, the selector butts 32*a* to 32*f* and 36*a* to 36*c* which are operable to be subjected to the action of the actuator 50 are arranged along the radial direction. Thus, even in a case where the selector butts for a plurality of steps are formed in order to improve production efficiency or stabilize the operation, the size increase of the circular knitting machine 1 in the height direction or the vertical direction can be prevented. Moreover, because that size increase can be prevented, reduction in workability and operability can be avoided.

According to the arrangement of the circular knitting machine 1 of the first preferred embodiment, both in the state where the low-pile sinker 21 has moved forward and in the state where the high-pile sinker 25 has moved forward, the rear ends 21*b* and 25*b* thereof are in contact with the leading ends 31*a* and 35*a* of the low-pile selector jack 31 and the high-pile selector jack 35 and the movement of the rear ends 31*b* and 35*b* of the selector jacks 31 and 35 are limited by the first cam 62. Therefore, in the state where the low-pile sinker 21 has moved forward, it is possible to stably position the low-pile sinker 21. Also, it is possible to stably position the high-pile sinker in the state where the high-pile sinker 25 has moved forward. Thus, the possibilities of troubles occurring during stitch formation can be reduced and the circular knitting machine 1 can be stably operated.

Moreover, according to the circular knitting machine 1 of the first preferred embodiment, the sinker 20 and the selector jack are separate components from each other and the selector jack 30 is arranged on the rear end side (i.e., radially outside) of the sinker 20. Therefore, the space for the actuator 50 operable to act on the selector butt 32 can be easily provided in a radially outer portion of the stitch forming device. In other words, it is possible to arrange the actuator 50 more radially outward.

Second Preferred Embodiment

A circular knitting machine 101 (a knitting machine capable of changing the pile length) according to the second preferred embodiment of the present invention is now described. The circular knitting machine 101 of the second preferred embodiment is different from the circular knitting machine 1 of the first preferred embodiment in the arrangement of a stitch forming device 110 operable to form a plurality of different knitting structures by changing the moving amount of a sinker 120 which can be moved into and out of between reciprocating knitting needles 11. Except for that point, the circular knitting machine 101 of the second preferred embodiment is preferably the same or substantially the same as the circular knitting machine 1 of the first preferred embodiment. Thus, the detailed description is omitted here.

The stitch forming device 110 includes a plurality of sinkers 120, a plurality of selector jacks 130, an actuator 150 and a sinker cap 160. The sinker 120 holds a pile yarn 91 and a ground yarn 92 when the pile yarn 91 and the ground yarn 92 for forming a new loop are drawn into an old loop. The selector jack 130 is arranged to move the corresponding one of the sinkers 120 out. The actuator 150 is arranged to selectively act on the selector jacks 130. The sinker cap 160 includes a group of cams including the first cam 162 operable to push the selector jack 130 subjected to the action of the actuator 150 to an area between the knitting needles 11.

Figure 19A:
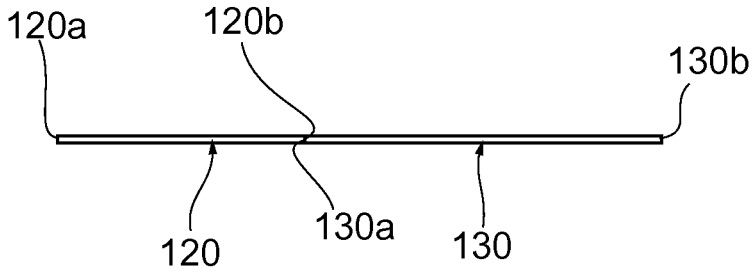
FIGS. 19A and 19B are a plan view and a side view of a sinker and a selector jack according to a second preferred embodiment of the present invention, showing an arrangement thereof.

FIG. 19A is a plan view of the sinker and the selector jack and shows the arrangement thereof. The sinker 120 is accommodated in a horizontal groove 7 provided in a sinker bed 6 shown in FIG. 2. The sinker 120 is arranged to extend along its moving direction, as shown in FIG. 19A, so that its leading end 120*a* is moved into and out of the knitting needles 11. The rear end 120*b* of the sinker 120 has a butt 124 which is arranged to be subjected to the action of the first cam 163 and the third cam 164 described later. Please note that the horizontal direction in FIG. 19A is coincident with the radial direction of the sinker bed 6 in FIG. 2 and the left in FIG. 19A is coincident with the radially inside in FIG. 2.

Figure 19B:
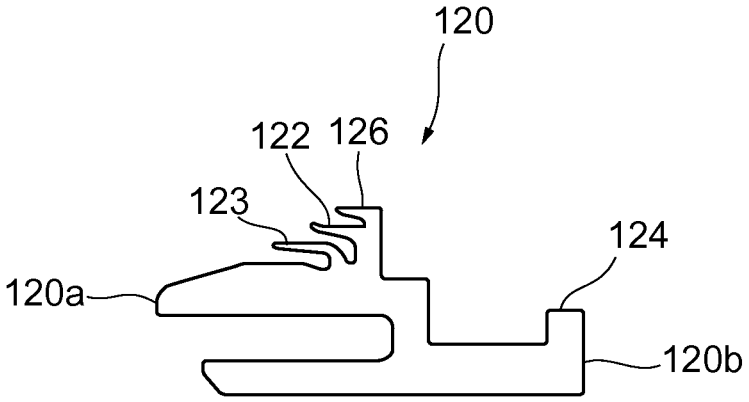

FIG. 19B is a side view of the sinker 120. The sinker 120 includes a low-pile nib 122, a small nib 123, and a high-pile nib 126 and preferably is defined by a plate-shaped member. The low-pile nib 122 and the high-pile nib 126 are portions that hold the pile yarn 91 during stitch formation and the small nib 123 is a portion that holds at least the ground yarn 92. The sinker 120 preferably has a thickness of about 0.2 mm to about 1.0 mm and is formed of steel in this example.

The selector jack 130 is accommodated in the horizontal groove 7 provided in the sinker bed 6 shown in FIG. 2. The selector jack 130 is arranged to extend along its moving direction, as shown in FIG. 19A. Moreover, the selector jack 130 is arranged on the rear end 120*b* side of the sinker 120. The selector jack 130 is preferably defined by a plate-shaped member. Like the sinker 120, the selector jack 130 preferably has a thickness of about 0.2 mm to about 1.0 mm and is formed of steel in this example.

Figure 20A:
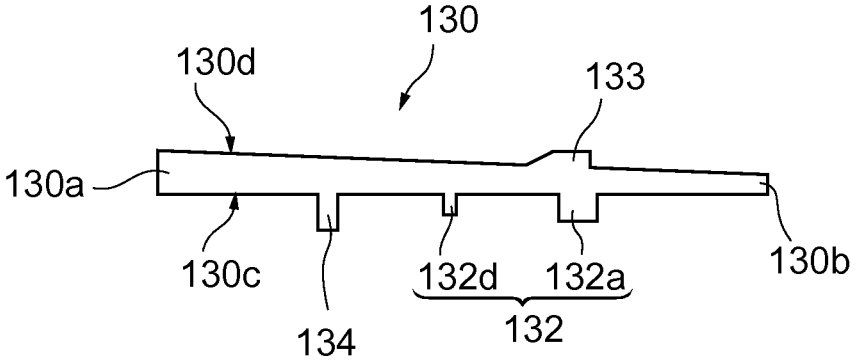
FIGS. 20A, 20B, and 20C are side views of the selector jacks of the second preferred embodiment of the present invention, showing the types of the selector jacks.
Figure 20B:
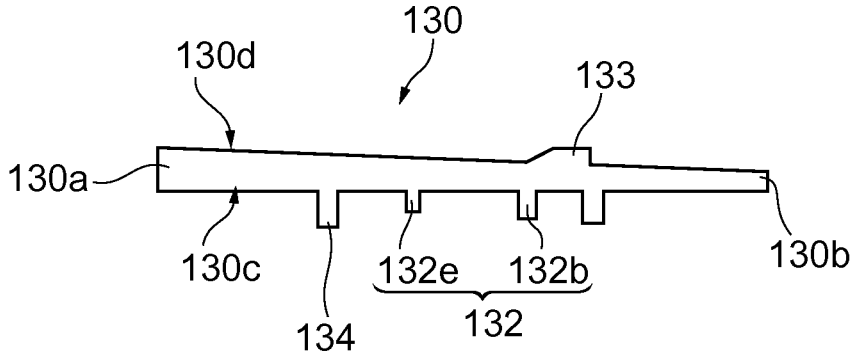
Figure 20C:
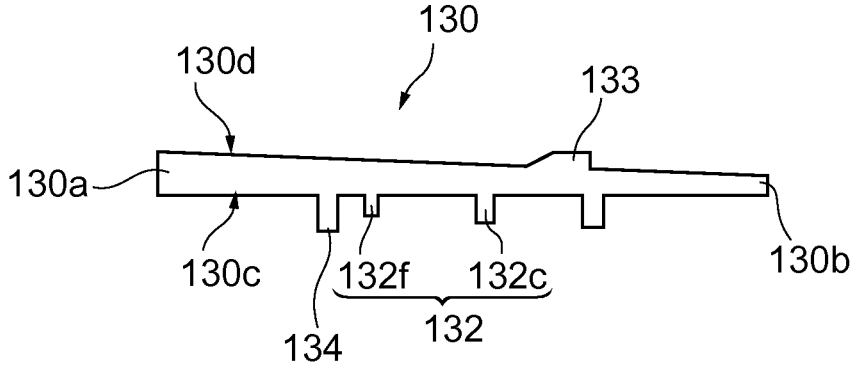

FIGS. 20A, 20B, to 20C are side views of different types of the selector jack 130. The selector jack 130 includes selector butts 132. More specifically, as shown in FIGS. 20A, 20B and 20C, each selector jack 130 includes two selector butts 132*a* and 132*d*, 132*b* and 132*e*, and 132*c* and 132*f*. The selector butts 132 are arranged to be subjected to the action of the actuator 150. The selector butts 132*a*, 132*b*, and 132*c* serve as low-pile selector butts used for low-pile stitch formation, while the selector butts 132*d*, 132*e*, and 132*f* serve as high-pile selector butts used for high-pile stitch formation.

The selector jack 130 includes the aforementioned selector butts 132, a leading end 130*a* operable to push the sinker 120 arranged radially inside the selector jack 130, a rear end 130*b* which is an opposite end to the leading end 130*a*, and a butt 134 operable to be subjected to the action of the fifth cam 166 described later. The selector butt 132 is provided on the bottom 130*c* of the extending portion of the selector jack 130 to project downward. Also, a selector boss 133 is provided on the top 130*d* of the extending portion of the selector jack 130 to be subjected to the action of the first cam 162 described later. The selector boss 133 is provided to project upward from the top 130*d* of the extending portion of the selector jack 130.

In the first horizontal groove 7 (701) of the sinker bed 6 shown in FIG. 2, the sinker 120 and the selector jack 130 including the first-step selector butt 132*a* and the fourth-step selector butt 132*d* shown in FIG. 20A are accommodated. In the second horizontal groove 7 (702) of the sinker bed 6 shown in FIG. 2, the sinker 120 and the selector jack 130 including the second-step selector butt 132*b* and the fifth-step selector butt 132*e* shown in FIG. 20B are accommodated. In the third horizontal groove 7 (703) of the sinker bed 6 shown in FIG. 2, the sinker 120 and the selector jack 130 including the third-step selector butt 132*c* and the sixth-step selector butt 132*f* shown in FIG. 20C are accommodated.

For the subsequent horizontal grooves 7 of the sinker bed 6 shown in FIG. 2, the arrangement described for the first to third horizontal grooves is repeated. An example where the number of the selector-butt steps is preferably three is described here, but the number of the steps is not limited three. If the rotation speed of the knitting-needle cylinder 2 corresponds to the response speed of the actuator 50 in response to an electronic control signal, the number of the steps may be one or more than three.

Figure 21A:
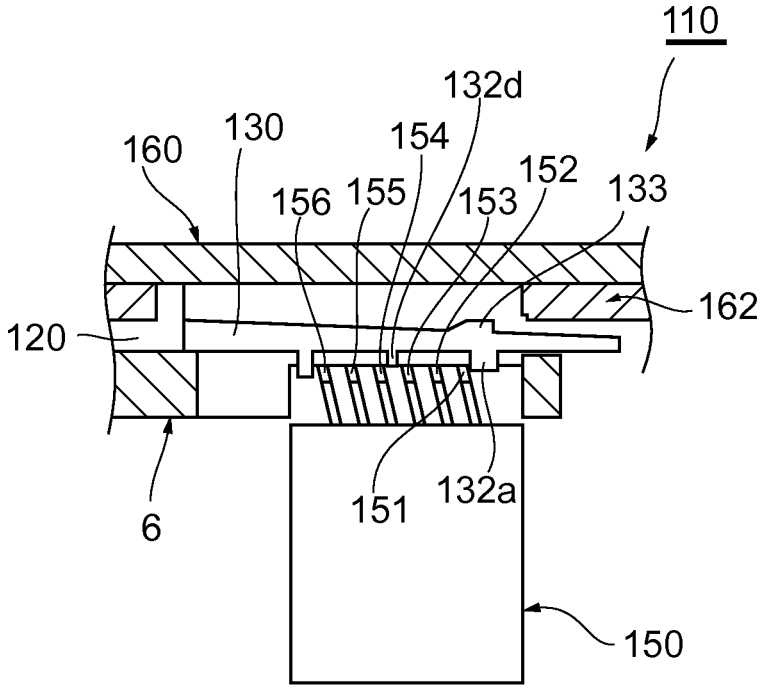
FIG. 21A is a cross-sectional view of a portion of a stitch forming device of a circular knitting machine according to the second preferred embodiment of the present invention, which includes an actuator.

FIG. 21A is a cross-sectional view of a portion of the stitch forming device in which the actuator is arranged. FIG. 21A shows the selector jack shown in FIG. 20A located above the actuator 150. The actuator 150 is arranged below the sinker bed 6, as shown in FIG. 21A, and is operable to selectively act on the selector butts 132 of the selector jacks 130. The actuator 150 includes heads 151, 152, 153, 154, 155, and 156 provided to correspond to the selector butts 132*a*, 132*b*, 132*c*, 132*d*, 132*e*, and 132*f* (see FIGS. 20A to 20C), respectively.

Figure 21B:
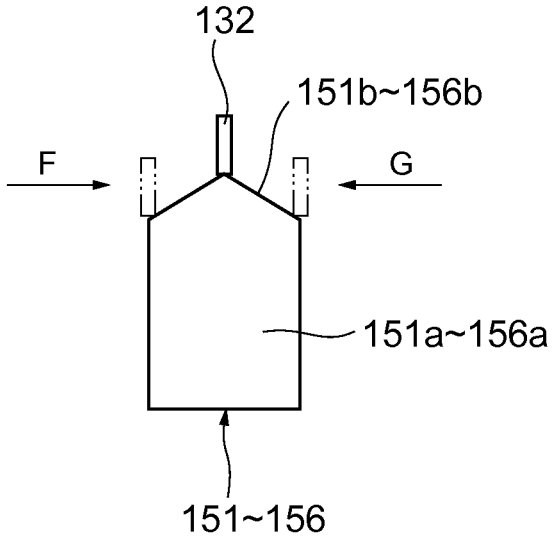
FIG. 21B is a front view of a head included in the actuator.

FIG. 21B is a front view of one of the heads of the actuator 150. Please note that the heads 151 to 156 preferably have the same or substantially the same structure. The head 151 to 156 of the actuator 150 preferably is a plate-shaped member including a main surface 151*a* to 156*a* arranged to be perpendicular or substantially perpendicular to the extending direction of the selector jack 130 which is movable in a direction F (a direction of reverse rotation) and in a direction G (a direction of forward rotation), as shown in FIG. 21B. When a top end portion 151*b* to 156*b* of the head 151 to 156 comes into contact with the selector butt 132 of the selector jack 130, the actuator 150 acts on the selector jack 130.

The top end portion 151*b* to 156*b* is symmetrical with respect to the center line extending vertically on FIG. 21B. Thus, both during forward rotation of the knitting-needle cylinder 2 in which it rotates in counterclockwise direction and during reverse rotation in which it rotates in clockwise direction when the circular knitting machine 101 is seen from above, the actuator 150 can act on the selector butt 132 in the same manner. Thus, even during reciprocating rotation of the knitting-needle cylinder 2 in which one-revolution of the forward rotation and one-revolution of the reverse rotation are alternately repeated, the same control as that for forward rotation only and that for reverse rotation only can be performed.

Figure 22:
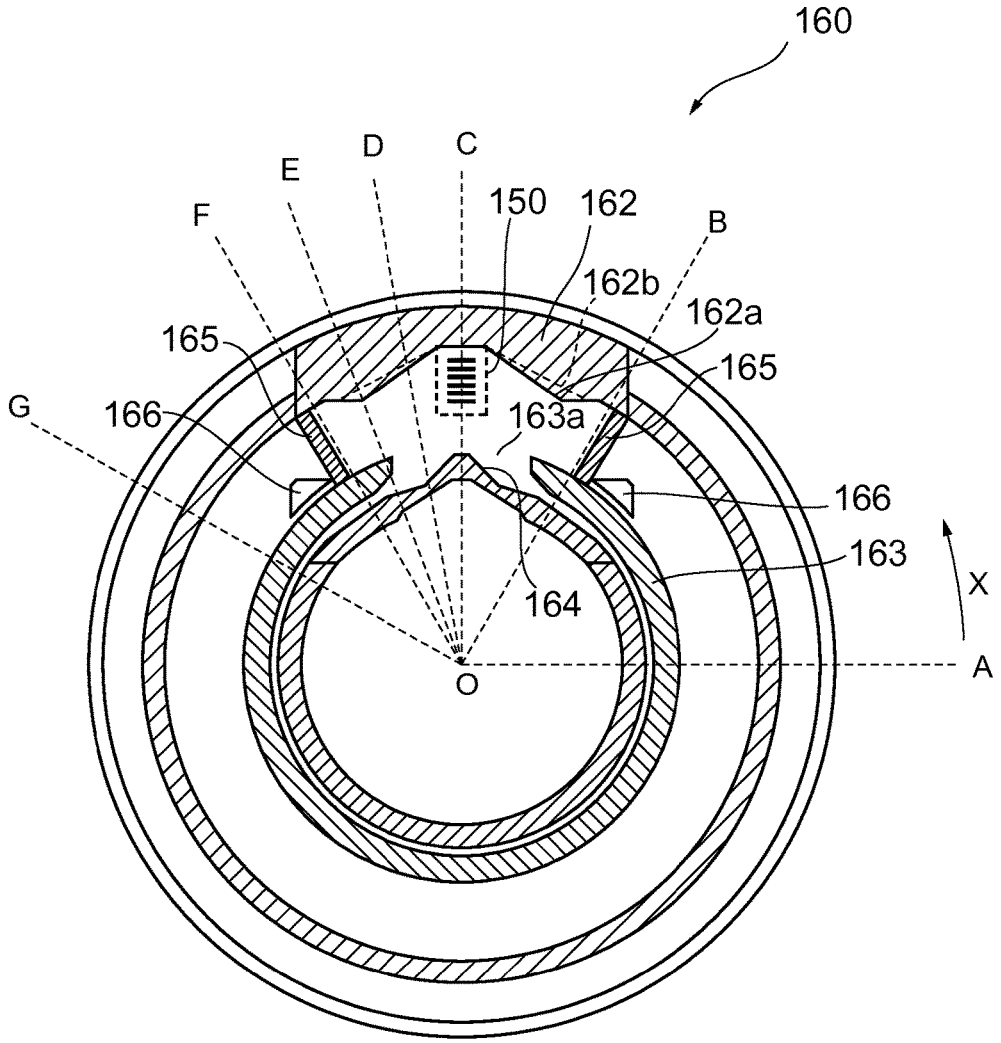
FIG. 22 is a plan view of a sinker cap of the circular knitting machine according to the second preferred embodiment of the present invention, showing an arrangement of a group of cams provided in the sinker cap.

FIG. 22 shows the arrangement of the cams provided on the sinker cap 160. The disk-shaped sinker cap 160 is arranged above the sinker bed 6 (see FIG. 2) with a cam-containing surface 161 facing down. The sinker cap 160 is supported by a machine table (not shown) not to be rotatable. FIG. 22 shows the sinker cap 160 when seen from above, but the cams provided on the bottom side of the sinker cap 160 are shown with solid lines. Also, the actuator 150 arranged on the bottom side of the sinker cap 160 when the sinker cap 160 is seen from above is shown with broken line.

The group of cams includes at least the first cam 162 at a radially outer position, the second cam 163 arranged radially inside the first cam 162 in form of a ring including an opening 163*a*, the third cam 164 in form of an approximate ring arranged radially inside the second cam 163, the fourth cam 165 arranged between the first cam 162 and the second cam 163 in the radial direction near the opening 163*a* of the second cam 163, and the fifth cam 166 arranged between the first cam 162 and the second cam 163 in the radial direction and adjacent to the fourth cam 165.

The first cam 162 is operable to act on the outside of the selector boss 133 of the selector jack 130. The second cam 163 is operable to act on the outside of the butt 124 of the sinker 120. The third cam 164 is operable to act on the inside of the butt 124 of the sinker 120. The fourth cam 165 is operable to act on the upper portion of the selector boss 133 of the selector jack 130. The fifth cam 166 is operable to act on the butt 134 of the selector jack 130.

Figure 23:
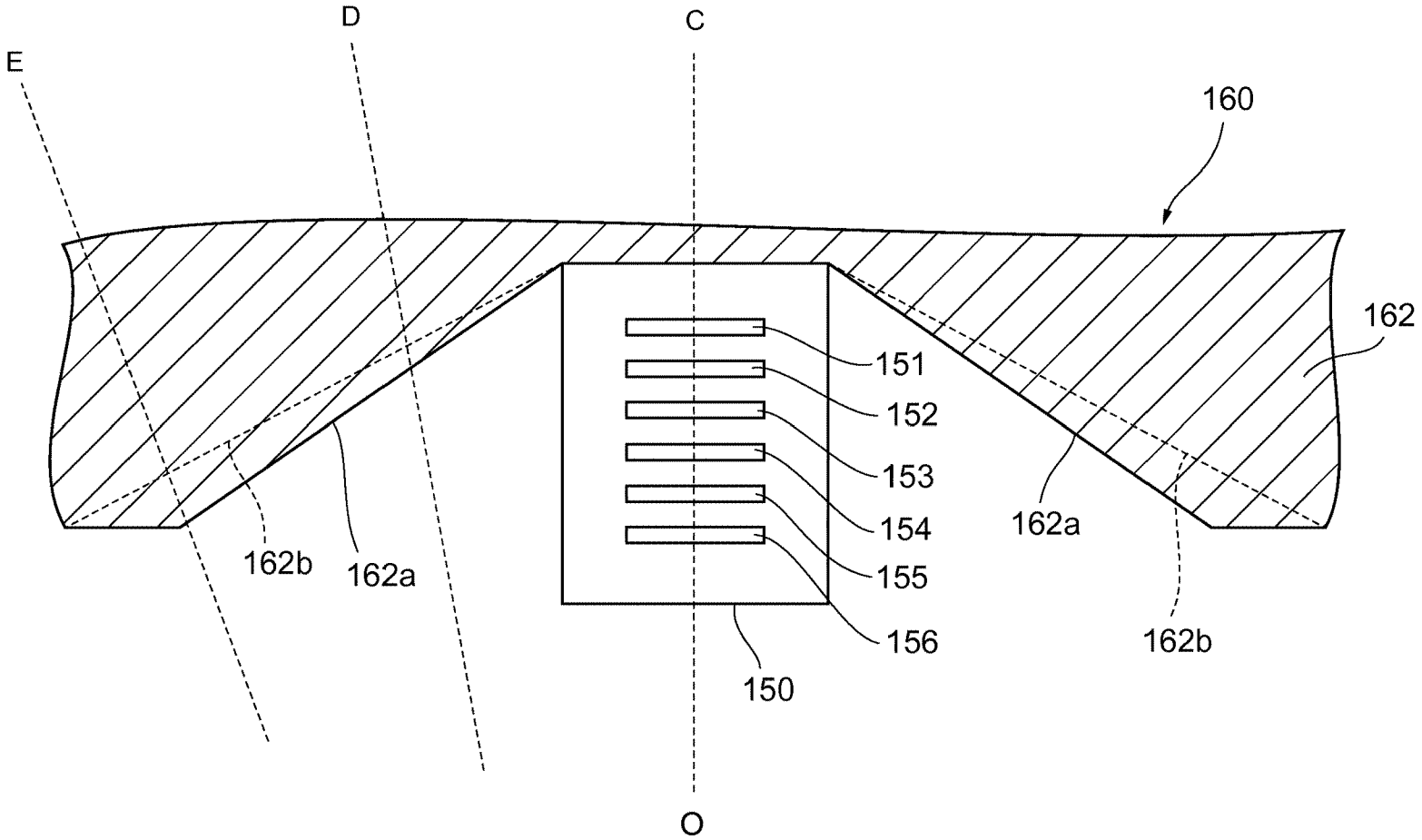
FIG. 23 is an enlarged view of a portion of the sinker cap of FIG. 22, showing an arrangement of a stepped portion.
Figure 24A:
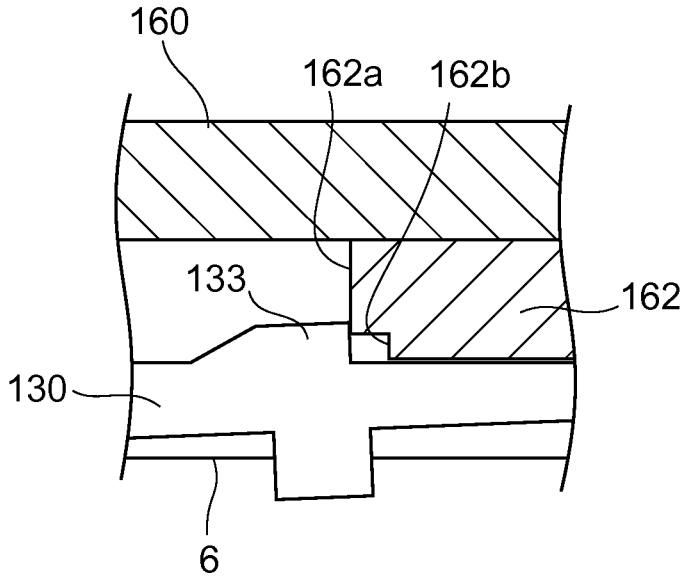
FIGS. 24A and 24B show a portion of the cam group shown in FIG. 22.
Figure 24B:
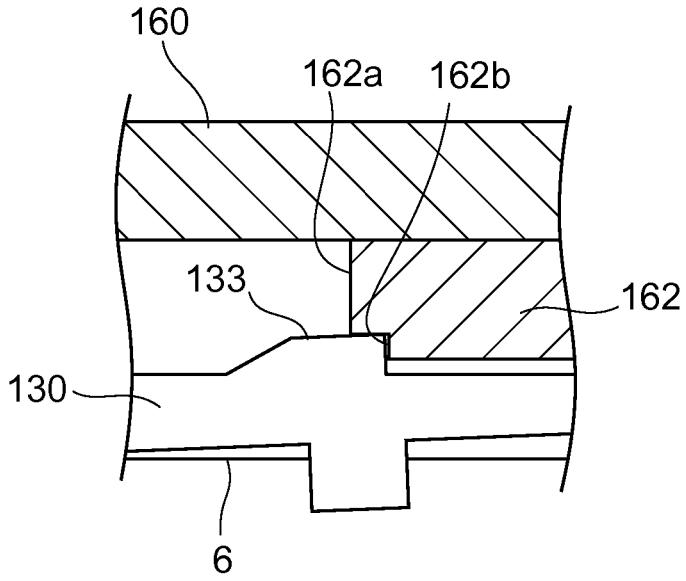

FIG. 23 is an enlarged view of a portion of the cam group shown in FIG. 22, especially showing the arrangement of the stepped portion. FIGS. 24A and 24B are cross-sectional views of the first cam, showing the stepped portion thereof. As shown in FIGS. 23, 24A and 24B, a stepped portion (the first pushing portion) 162*b* for low-pile stitch formation is provided at a corner on the bottom side of the radially inner surface of the first cam 162. The stepped portion 162*b* is concave radially outward on the bottom of the first cam 162. The stepped portions 162*b* are arranged on both sides of the actuator 50 in the circumferential direction.

FIG. 24A shows the selector boss 133 of the selector jack 130 in contact with a front end portion (the second pushing portion) 162*a* of the first cam 162. FIG. 24B shows the selector boss 133 in contact with the stepped portion 162*b*. The pushed amount L1 of the selector boss 133 when the selector boss 133 is pushed out by the contact with the stepped portion 162*b* is smaller than the pushed amount L2 of the selector boss 133 when the selector boss 133 is pushed out by the contact with the front end portion 162*a*.

Figure 25:
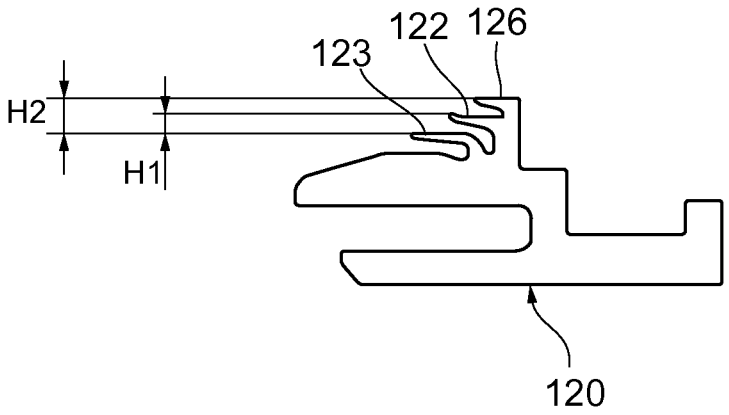
FIG. 25 shows a level difference between nibs provided in the sinker in the second preferred embodiment of the present invention.

The arrangement of the circular knitting machine 101 (see FIG. 2) which allows a plain stitch $P_0$, a low-pile stitch $P_1$, and a high-pile stitch $P_2$ shown in FIG. 1 to be formed is now described. FIG. 25 shows the level difference between the nibs provided in the sinker. The low-pile nib 122, the small nib 123, and the high-pile nib 126 of the sinker 120 are different in position in the vertical direction, as shown in FIG. 25. The distance H2 between the small nib 123 and the high-pile nib 126 is longer than the distance H1 between the small nib 123 and the low-pile nib 122. The circular knitting machine 101 of this preferred embodiment is arranged to form different knitting structures by using that difference between the distances (level distance). In this example, the difference between the distances (H2–H1) preferably is from about 0.5 mm to about 2.5 mm.

During stitch formation, the sinker loop lengths are determined depending on the distances from contact points $P_{122}$, $P_{123}$, and $P_{126}$ of the pile yarn 91 and the ground yarn 92 with the respective nibs 122, 123, and 126 to a contact point $P_{11}$ of the pile yarn 91 and the ground yarn 92 with the knitting needle 11. In other words, it is possible to change which one of the knitting structures to be formed by selecting which one(s) of the low-pile nib 122, the small nib 123, and the high-pile nib 126 hold the pile yarn 91 and the ground yarn 92. Selection of the nib to hold the pile yarn 91 and the ground yarn 92 can be achieved by selectively moving the sinker 120, as shown in FIGS. 26A to 26C.

Figure 26A:
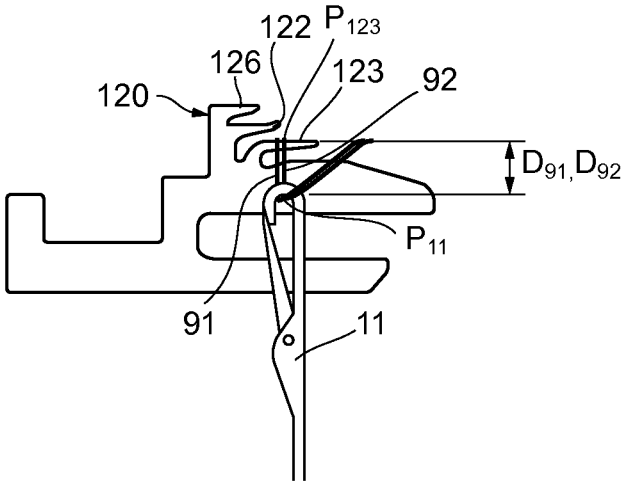
FIGS. 26A, 26B and 26C show how to hold a pile yarn and a ground yarn during formation of a plain stitch, a low-pile stitch, and a high-pile stitch, respectively.

As shown in FIG. 26A, in a case where the sinker 120 is not moved from a predetermined position (not moved forward), both the pile yarn 91 and the ground yarn 92 are held by the small nib 123 of the sinker 120. In this case, the distance $D_{91}$ from the contact point $P_{123}$ between the pile yarn 91 and the small nib 123 to the contact point $P_{11}$ between the pile yarn 91 and the knitting needle 11 is equal to the distance $D_{92}$ from the contact point $P_{123}$ between the ground yarn 92 and the small nib 123 to the contact point $P_{11}$ between the ground yarn 92 and the knitting needle 11. Thus, in this state shown in FIG. 26A, when the knitting needle 11 draws the pile yarn 91 and the ground yarn 92 into an old loop, a plain stitch $P_0$ is formed in which the sinker loop length of the pile yarn 91 and that of the ground yarn 92 are the same.

Figure 26B:
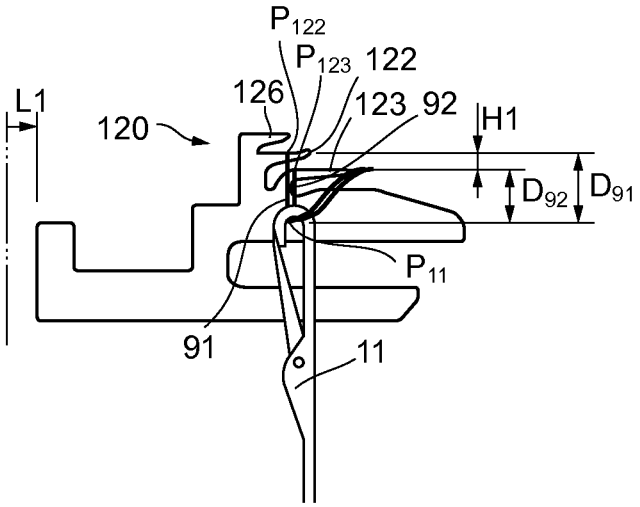

As shown in FIG. 26B, in a case where the sinker 120 has been moved from the predetermined position (shown with two-dot chain line in FIG. 26B) toward the knitting needle 11 by a distance L1 (i.e., the sinker 120 has been moved forward by the distance L1), the pile yarn 91 is held by the small-pile nib 122 of the sinker 120 and the ground yarn 92 is held by the small nib 123. In this case, the distance $D_{91}$ from the contact point $P_{122}$ between the pile yarn 91 and the low-pile nib 122 to the contact point $P_{11}$ between the pile yarn 91 and the knitting needle 11 is different from the distance $D_{92}$ from the contact point $P_{123}$ between the ground yarn 92 and the small nib 123 to the contact point $P_{11}$ between the ground yarn 92 and the knitting needle 11 by the distance H1. Thus, when the knitting needle 11 draws the pile yarn 91 and the ground yarn 92 into an old loop in the state shown in FIG. 26B, a low-pile stitch $P_1$ is formed in which the sinker loop length of the pile yarn 91 is longer than that of the ground yarn 92 by a length preferably equal to twice or about twice the distance H1.

Figure 26C:
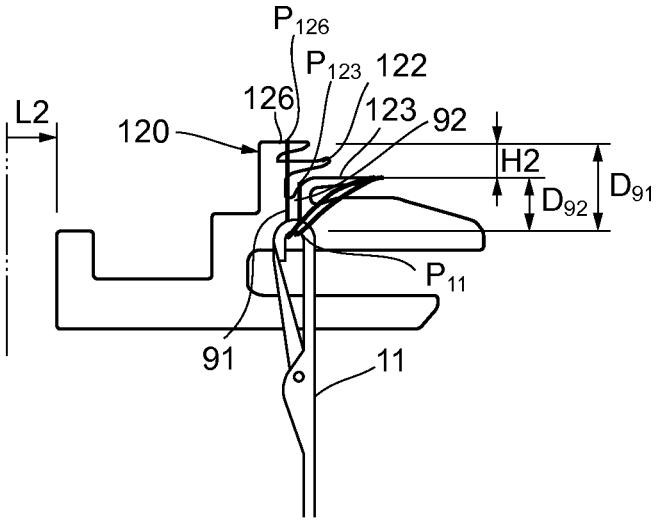

As shown in FIG. 26C, in a case where the sinker 120 has been moved from the predetermined position (shown with two-dot chain line in FIG. 26C) toward the knitting needle 11 by a distance L2, the pile yarn 91 is held by the high-pile nib 126 of the sinker 120 and the ground yarn 92 is held by the small nib 123. In this case, the distance $D_{91}$ from the contact point $P_{126}$ between the pile yarn 91 and the high-pile nib 126 to the contact point $P_{11}$ between the pile yarn 91 and the knitting needle 11 is different from the distance $D_{92}$ from the contact point $P_{122}$ between the ground yarn 92 and the small nib 123 to the contact point $P_{11}$ between the ground yarn 92 and the knitting needle 11 by the distance H2. The distance H2 is longer than the distance H1. Thus, when the knitting needle 11 draws the pile yarn 91 and the ground yarn 92 into an old loop in the state shown in FIG. 26C, a high-pile stitch $P_2$ is formed in which the sinker loop length of the pile yarn 91 is longer than that of the ground yarn 92 by a length preferably equal to twice or about twice the distance H2.

Operations of the circular knitting machine 101 of this preferred embodiment are now described referring to FIGS. 27A to 34B respectively showing cross sections of portions of the stitch forming device including the sinker 120 and the selector jack 130. In the following description, the sinker 120 and the selector jack 130 which are accommodated in the same horizontal groove 7 may be collectively referred to as a sinker unit 108.

The sinker unit 108 rotates together with the sinker bed 6. The sinker bed 6 is opposed to the cam-containing surface 161 of the sinker cap 160. In this arrangement, the sinker unit 108 moves from positions O-A to O-G on the sinker cap 160 (see FIG. 22) in that order. The sinker unit 108 accommodated in the first horizontal groove 701 of the sinker bed 6, which includes the selector jack 130 shown in FIG. 20A, is described as an example.

Figure 27A:
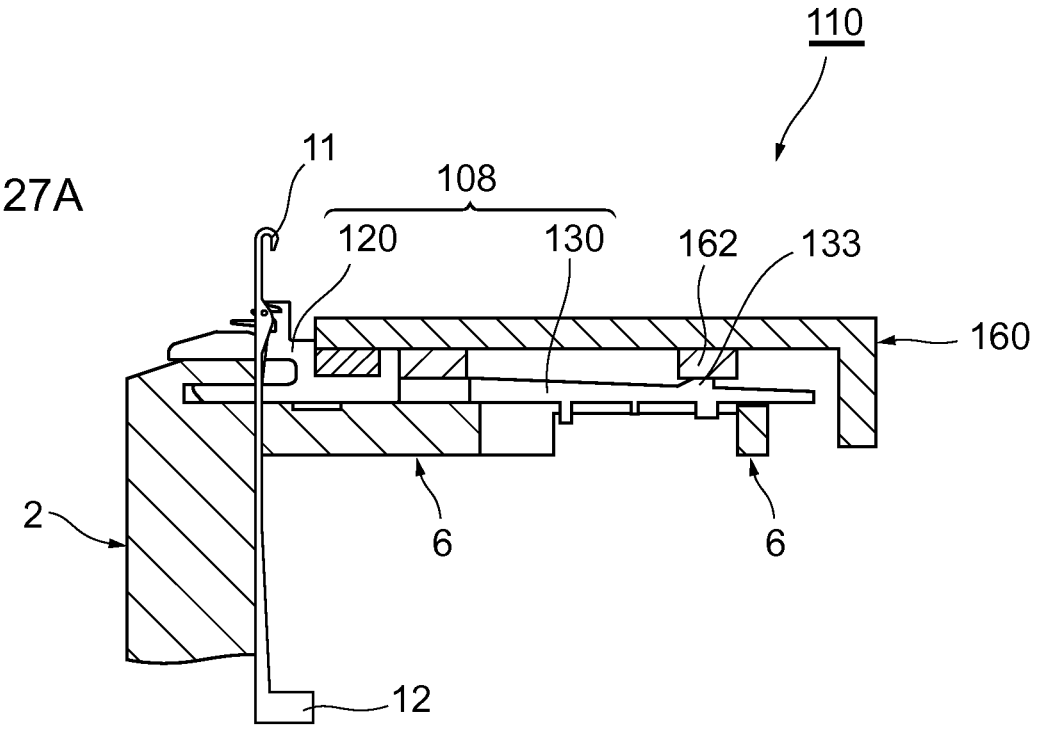
FIGS. 27A and 27B are cross-sectional views of a portion of the stitch forming device in the second preferred embodiment of the present invention, taken along line O-A and line O-B in FIG. 22, respectively.
Figure 27B:
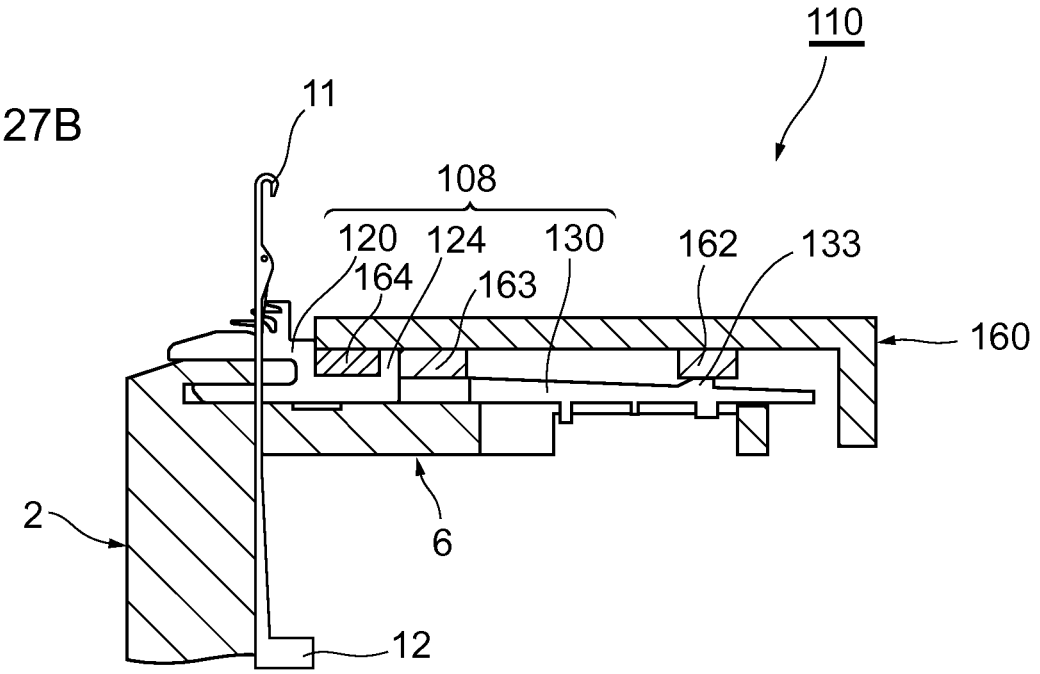

The operation of the circular knitting machine 101 for forming a low-pile stitch $P_1$ in association with forward rotation (rotation in a direction X in FIG. 22) of the knitting-needle cylinder 2 will now be described. FIGS. 27A and 27B show states of the sinker unit 108 when it is located at the positions O-A and O-B, respectively.

When the sinker unit 108 is located at the position O-A, the sinker 120 and the selector jack 130 are spaced away from each other. During the movement of the sinker unit 108 from the position O-A to the position O-B in association with rotation (in the direction X) of the knitting-needle cylinder 2, a knitting-needle butt 12 integrally formed with the knitting needle 11 is subjected to the action of a stitch cam 80 (see FIG. 2), so that the knitting needle 11 is moved up. Thus, the pile yarn 91 and the ground yarn 92 both for forming a new loop (both not shown) are placed at and held by the knitting needle 11. When the sinker unit 108 has reached the position O-B, the knitting-needle butt 12 is subjected to the action of the stitch cam 80 (see FIG. 2) and the knitting needle 11 holding the pile yarn 91 and the ground yarn 92 starts moving down.

When the sinker unit 108 is located at the position O-B, the sinker 120 and the selector jack 130 are spaced away from each other. In this state, the selector boss 133 of the selector jack 130 is located below the first cam 162. Thus, the first cam 162 does not act on the selector boss 133 at this time.

Figure 28A:
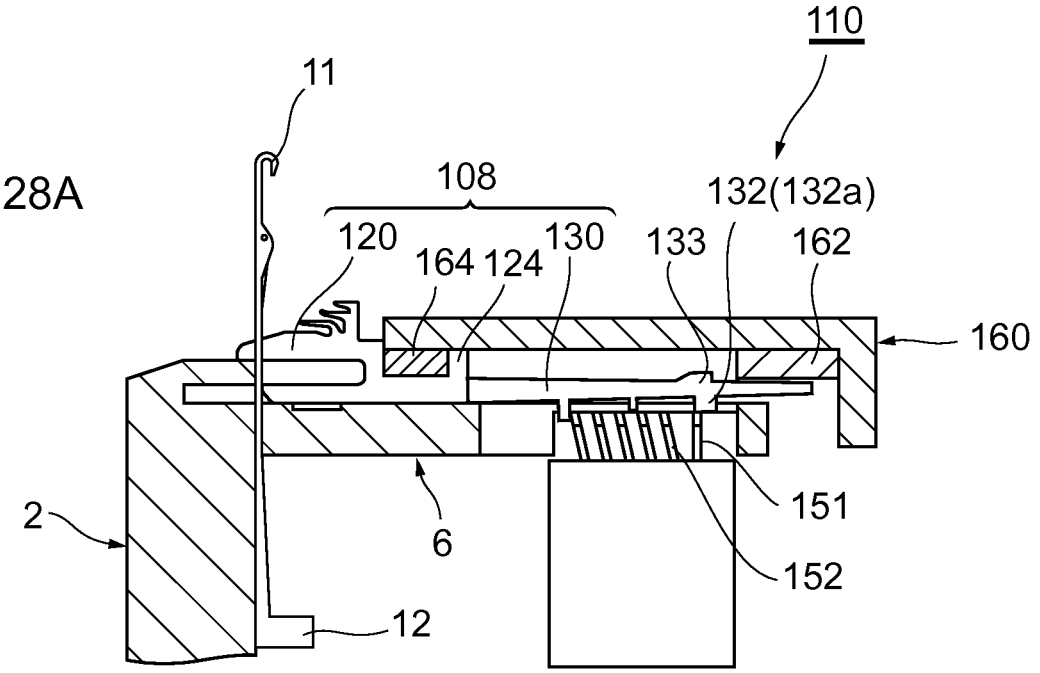
FIGS. 28A and 28B are cross-sectional views of a portion of the stitch forming device in the second preferred embodiment of the present invention, taken along line O-C and line O-D in FIG. 22, respectively.

FIG. 28A shows the sinker unit 108 at the position O-C. With rotation of the knitting-needle cylinder 2, the sinker unit 108 moves closer to the position O-C. During this movement, the inside of the butt 124 of the sinker 120 is subjected to the action of the third cam 164 so as to be moved radially outward. Also, if the actuator 150 receives a signal input from a selection signal output device which is not shown, the head 151 which is arranged to be pivotable is changed from an inclined state to a standing state. Please note that the head 151 shown in FIG. 28A is in the standing state, while the head 152 adjacent to the head 151 is in the inclined state.

When the sinker unit 108 has reached the position O-C, the selector butt 132*a* of the selector jack 130 is subjected to the action of the head 151 in the standing state (first step). The selector jack 130 thus subjected to the action of the head 151 is moved upward. At this time, the first cam 162 is located outside the selector boss 133 of the selector jack 130.

Figure 28B:
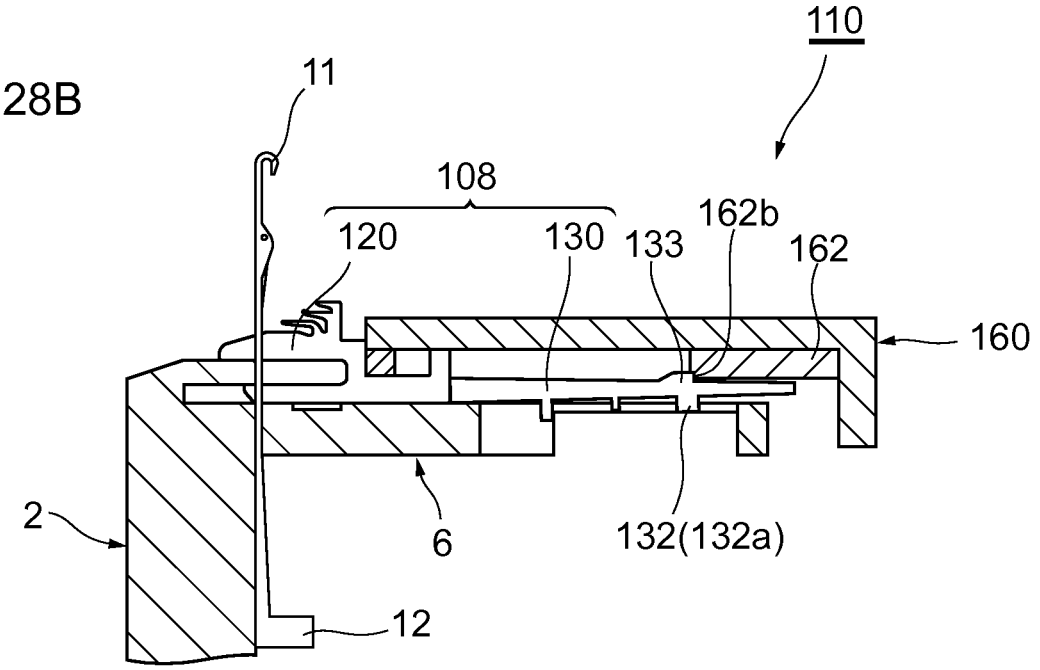

FIG. 28B shows the sinker unit 108 at the position O-D. When the sinker unit 108 has reached the position O-D, the first cam 162 engages with the outside of the selector boss 133 of the selector jack 130 which has been moved up so as to act on the selector boss 133 radially inwardly. At this time, the selector boss 133 of the selector jack 130 comes into contact with the stepped portion 162*b* of the first cam 162 (see FIG. 24B) and is therefore pushed out radially inwardly.

Figure 29A:
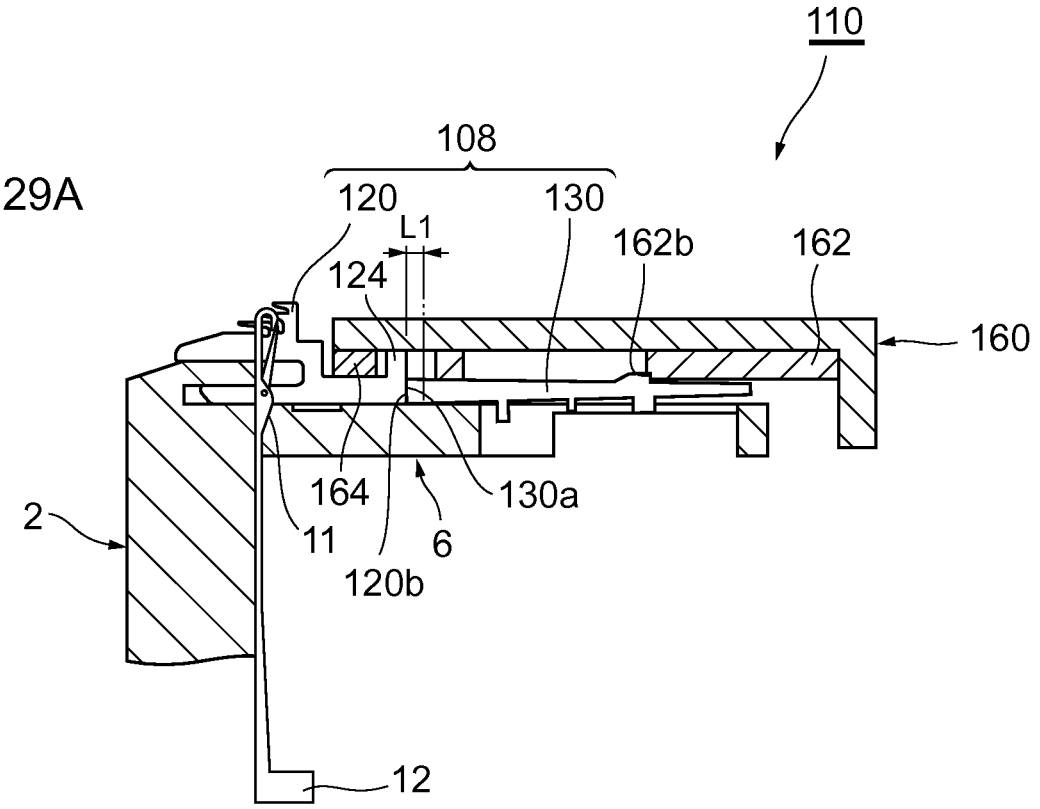
FIGS. 29A and 29B are cross-sectional views of a portion of the stitch forming device in the second preferred embodiment of the present invention, taken along line O-E and line O-F in FIG. 22, respectively.

FIG. 29A shows the sinker unit 108 at the position O-E. When the sinker unit 108 has reached the position O-E, the leading end 130*a* of the selector jack 130 which has been moved radially inwardly comes into contact with the rear end 120*b* of the sinker 120 and therefore moves the sinker 120 radially inwardly. At this time, the moved amount of the sinker 120 moved by the selector jack 130 is L1. The moved amount L1 is shorter than the moved amount L2 which will be described later.

Figure 29B:
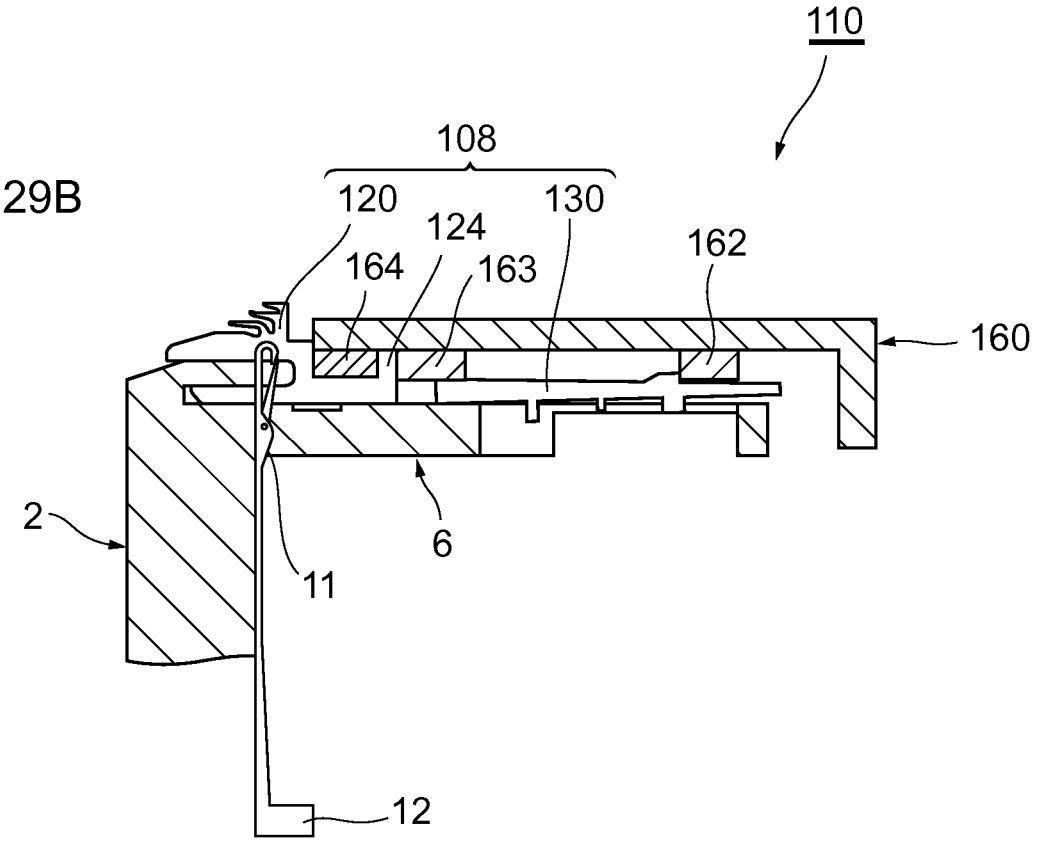

FIG. 29B shows the sinker unit 108 at the position O-F. During the movement of the sinker unit 108 from the position O-D to the position O-E, the knitting needle 11 moves down because of the action of the stitch cam 80 (see FIG. 2) simultaneously with the aforementioned movement of the sinker 120. At this time, the sinker 120 is located at a position spaced away from the predetermined position (shown with two-dot chain line in FIG. 26B) toward the knitting needle 11 by the distance L1. Thus, as shown in FIG. 26B, the pile yarn 91 is placed at and held by the low-pile nib 122 of the sinker 120 and the ground yarn 92 is placed at and held by the small nib 123. Then, during the movement of the sinker unit 108 from the position O-E to the position O-F, the knitting needle 11 is further moved down. Thus, while the pile yarn 91 is held by the low-pile nib 122 of the sinker 120 and the ground yarn 92 is held by the small nib 123, the pile yarn 91 and the ground yarn 92 are drawn into an old loop to form a low-pile stitch $P_1$.

During the movement of the sinker unit 108 from the position O-E to the position O-F, the butt 124 of the sinker 102 is subjected to the action of the second cam 163 from the outside. Therefore, the sinker 120 is pushed out radially inward.

Figure 30:
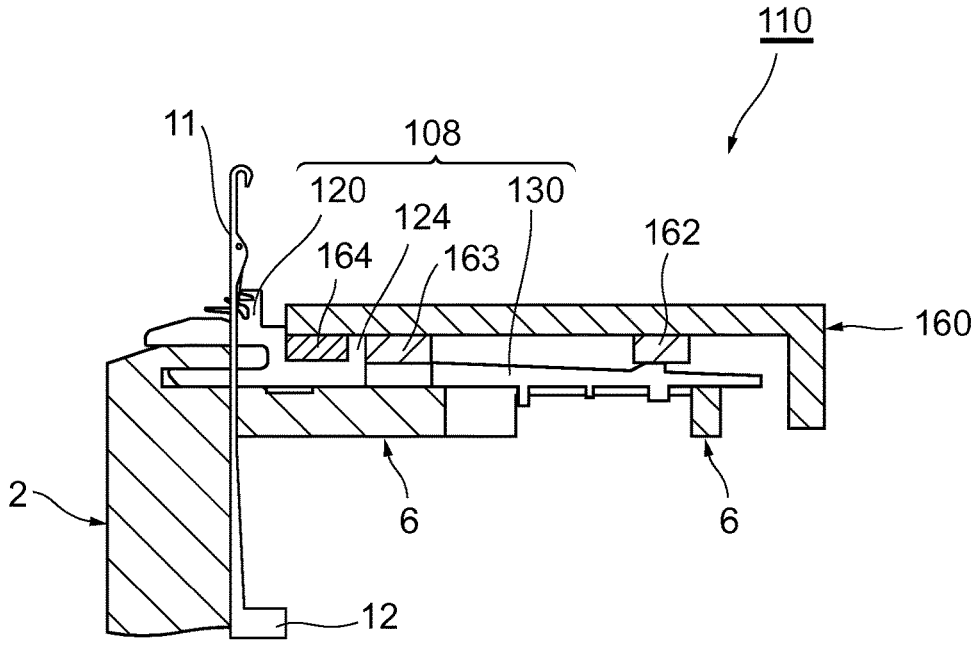
FIG. 30 is a cross-sectional view of a portion of the stitch forming device in the second preferred embodiment of the present invention, taken along line O-G in FIG. 22.

FIG. 30 shows the sinker unit 108 at the position O-G. During movement of the sinker unit 108 from the position O-F to the position O-G, the selector boss 133 is subjected to the action of the fourth cam 165 (see FIG. 22), so that the selector jack 130 is pushed down. Also, the butt 134 is subjected to the action of the fifth cam 166 (see FIG. 22), so that the selector jack 130 is moved radially outward to be placed at the position before it is selected.

The operation for forming the low-pile stitch $P_1$ in association with reverse rotation (rotation in the opposite direction to the direction X in FIG. 22) of the knitting-needle cylinder 2 is the same or substantially the same as the aforementioned operation. That is, the aforementioned processes for forward rotation are also performed for reverse rotation of the knitting-needle cylinder 2.

The operation for forming a high-pile stitch $P_2$ will now be described. The states of the sinker unit 108 when it is located at the positions O-A and O-B are the same as those in the operation for forming the low-pile stitch $P_1$. Therefore, the detailed description is omitted.

Figure 31A:
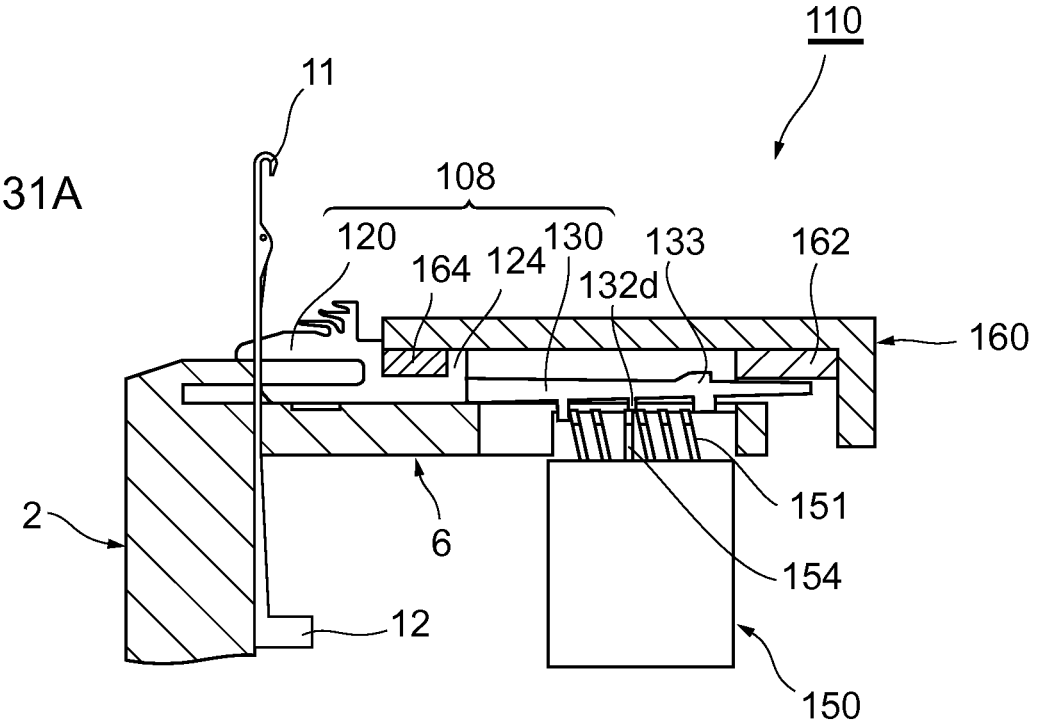
FIGS. 31A and 31B are cross-sectional views of the portion of the stitch forming device in the second preferred embodiment of the present invention, taken along line O-C and line O-D in FIG. 22, respectively.

FIG. 31A shows the sinker unit 108 at the position O-C. As the knitting-needle cylinder 2 rotates, the sinker unit 108 moves closer to the position O-C. During this, the inside of the butt 124 of the sinker 120 is subjected to the action of the third cam 164, so that the sinker 120 is moved radially outward. Also, if the actuator 50 receives a signal input from the selection signal output device which is not shown at this time, the head 154 which is arranged to be pivotable is changed from the inclined state to the standing state.

When the sinker unit 108 has reached the position O-C, the selector butt 132*d* of the selector jack 130 is subjected to the action of the standing head 154 (first step). Thus, that selector jack 130 is moved upward.

Figure 31B:
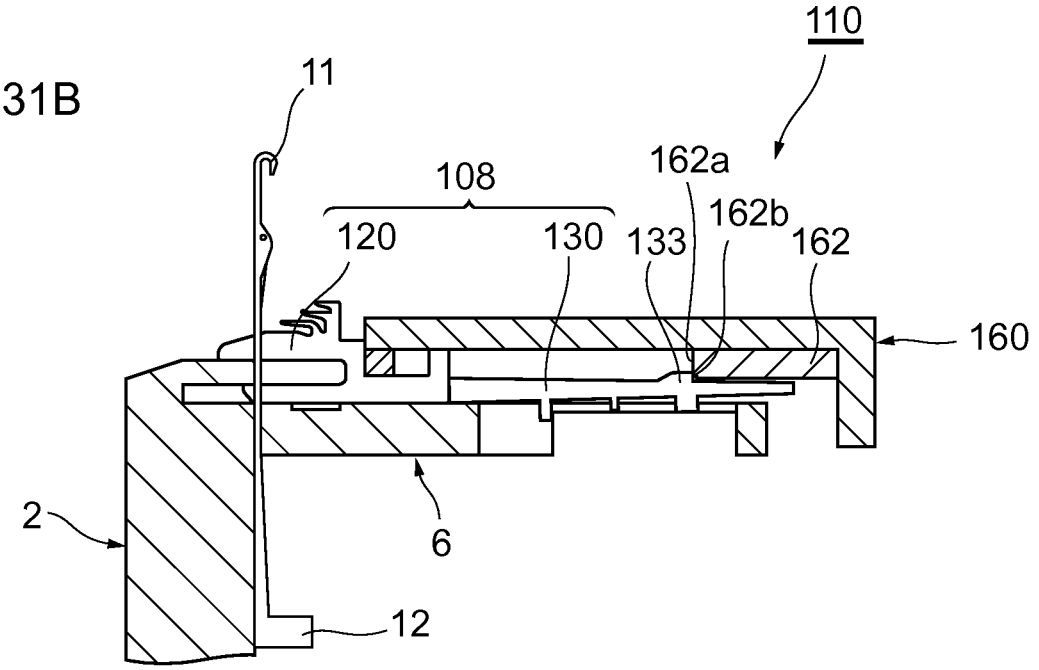

FIG. 31B shows the sinker unit 108 at the position O-D. When the sinker unit 108 has reached the position O-D, the first cam 162 engages with the outside of the selector boss 133 of the selector jack 130 and acts the selector boss 133 radially inwardly. At this time, the selector boss 133 comes into contact with the front end portion 162*a* of the first cam 162 (see FIG. 24A) so as to be moved radially inwardly (second step).

Figure 32A:
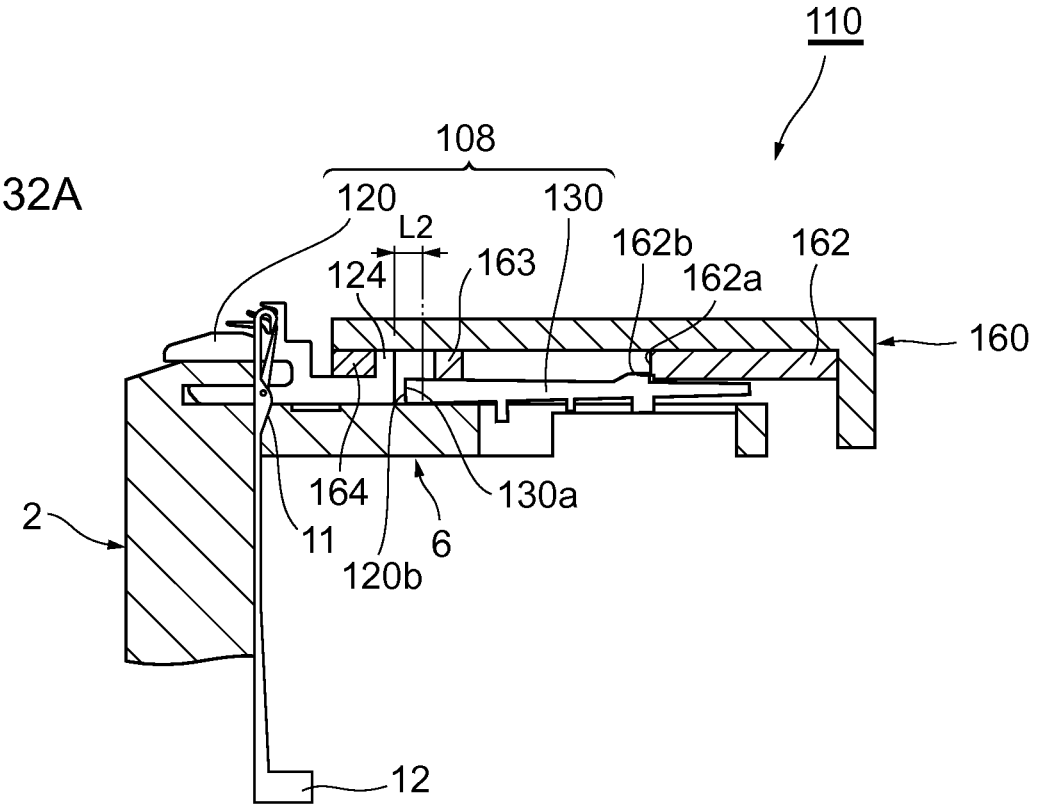
FIGS. 32A and 32B are cross-sectional views of the portion of the stitch forming device in the second preferred embodiment of the present invention, taken along line O-E and line O-F in FIG. 22, respectively.

FIG. 32A shows the sinker unit 108 at the position O-E. When the sinker unit 108 has reached the position O-E, the leading end 130*a* of the selector jack 130 which has been moved radially inward comes into contact with the rear end 120*b* of the sinker 120 and moves the sinker 120 radially inward. At this time, the moved amount of the sinker 120 is L2. The moved amount L2 is larger than the aforementioned moved amount L1.

During the movement of the sinker unit 108 from the position O-D to the position O-E, the knitting needle 11 is moved down because of the action of the stitch cam 80 (see FIG. 2) simultaneously with the movement of the sinker 120. At this time, the sinker 120 is located at a position spaced away from the predetermined position (shown with two-dot chain line in FIG. 26C) toward knitting needle 11 by the distance L2. Therefore, as shown in FIG. 26C, the pile yarn 91 is held by the high-pile nib 126 of the sinker 120 and the ground yarn 92 is held by the small nib 123. Then, during the movement of the sinker unit 108 from the position O-E to the position O-F, the knitting needle 11 is further moved down. Thus, while the pile yarn 91 is held by the high-pile nib 126 and the ground yarn 92 is held by the small nib 123, the pile yarn 91 and the ground yarn 92 are drawn into an old loop so as to form a high-pile stitch $P_2$.

Figure 32B:
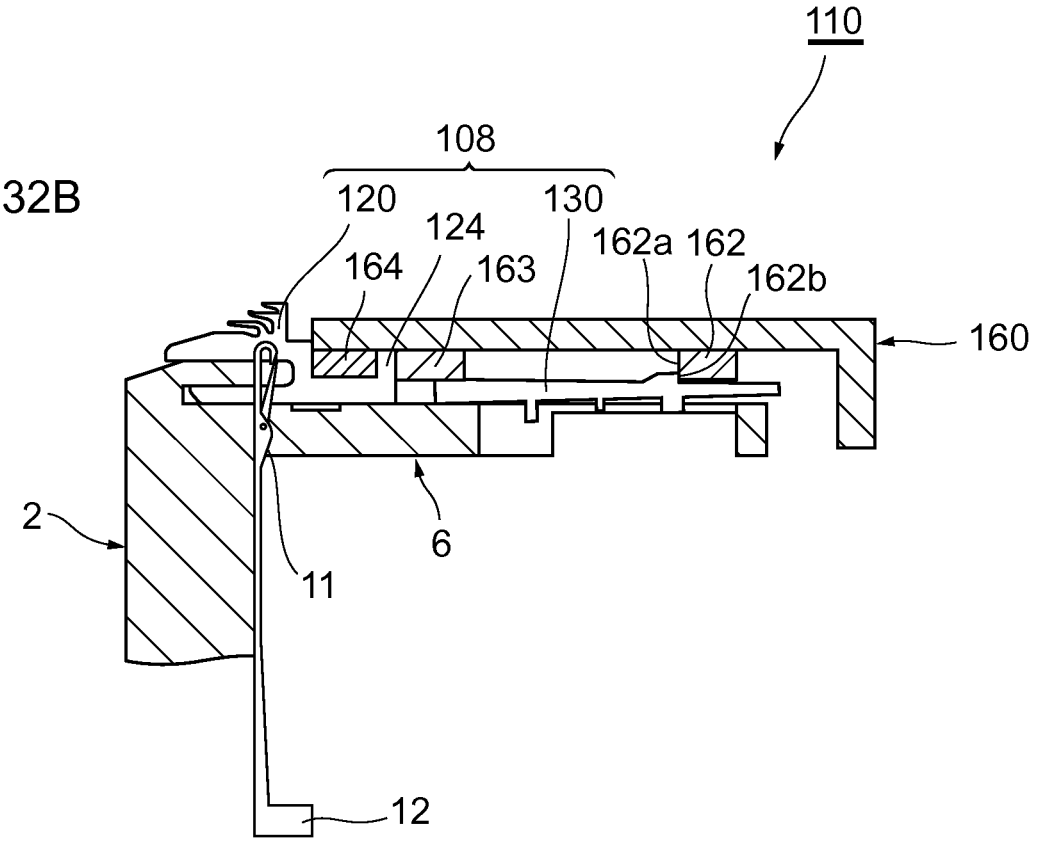

FIG. 32B shows the sinker unit 108 at the position O-F. During the movement of the sinker unit 108 from the position O-E to the position O-F, the butt 124 of the sinker 120 is subjected to the action of the second cam 163 from the outside. Therefore, the sinker 120 is moved radially inward. The processes during the movement of the sinker unit 108 from the position O-F to the position O-G are the same as those described for formation of the low-pile stitch $P_1$. Therefore, the detailed description is omitted.

The operation for forming the high-pile stitch $P_2$ during reverse rotation (rotation in the opposite direction to the direction X in FIG. 8) of the knitting-needle cylinder 2 are the same as those described above. That is, the same processes as those described for forward rotation are also performed for reverse rotation of the knitting-needle cylinder 2.

Next, the operation for forming a plain stitch $P_0$ will be described. The states of the sinker unit 108 when it is located at the positions O-A and O-B are the same as those described for formation of the low-pile stitch $P_1$. Therefore, the detailed description is omitted.

Figure 33A:
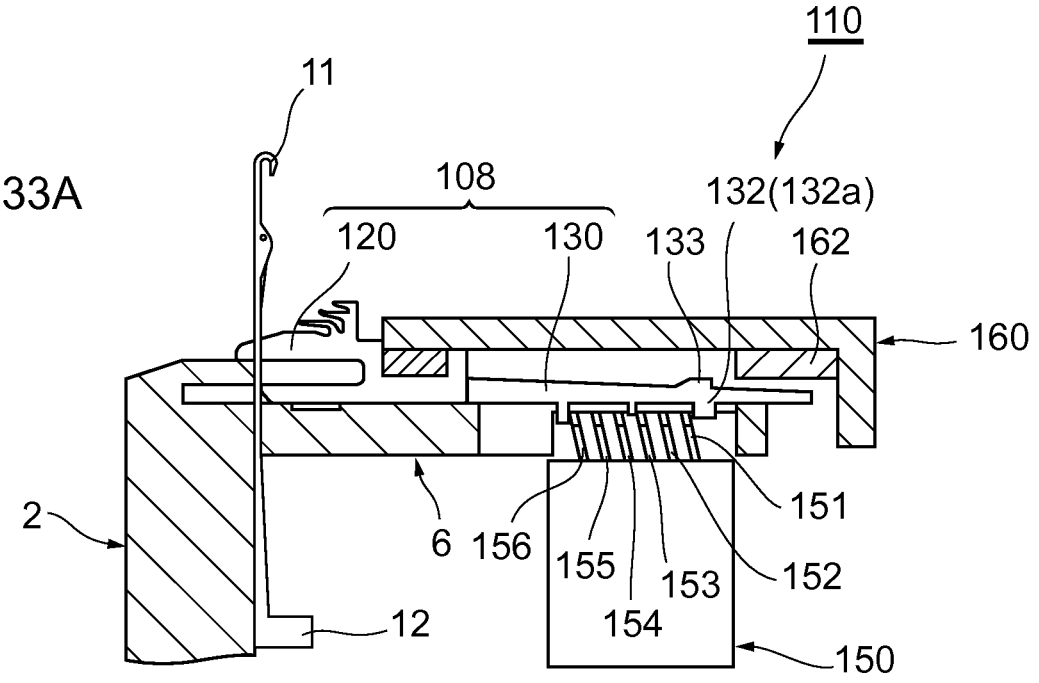
FIGS. 33A and 33B are cross-sectional views of the portion of the stitch forming device in the second preferred embodiment of the present invention, taken along line O-C and line O-D in FIG. 22, respectively.

FIG. 33A shows the sinker unit 108 at the position O-C. As the knitting-needle cylinder 2 rotates, the sinker unit 108 moves closer to the position O-C. During this movement, the inside of the butt 124 of the sinker 120 is subjected to the action of the third cam 164, so that the sinker 120 is moved radially outward. At this time, if no signal is input to the actuator 50 from the selection signal output device which is not shown, the heads 151 to 156 which are arranged to be pivotable remain inclined.

In this state, even when the sinker unit 108 has reached the position O-C, the selector butts 132*a* and 132*d* of the selector jack 130 are not subjected to any action. At this time, the first cam 162 is located outside the selector boss 133 of the selector jack 130.

Figure 33B:
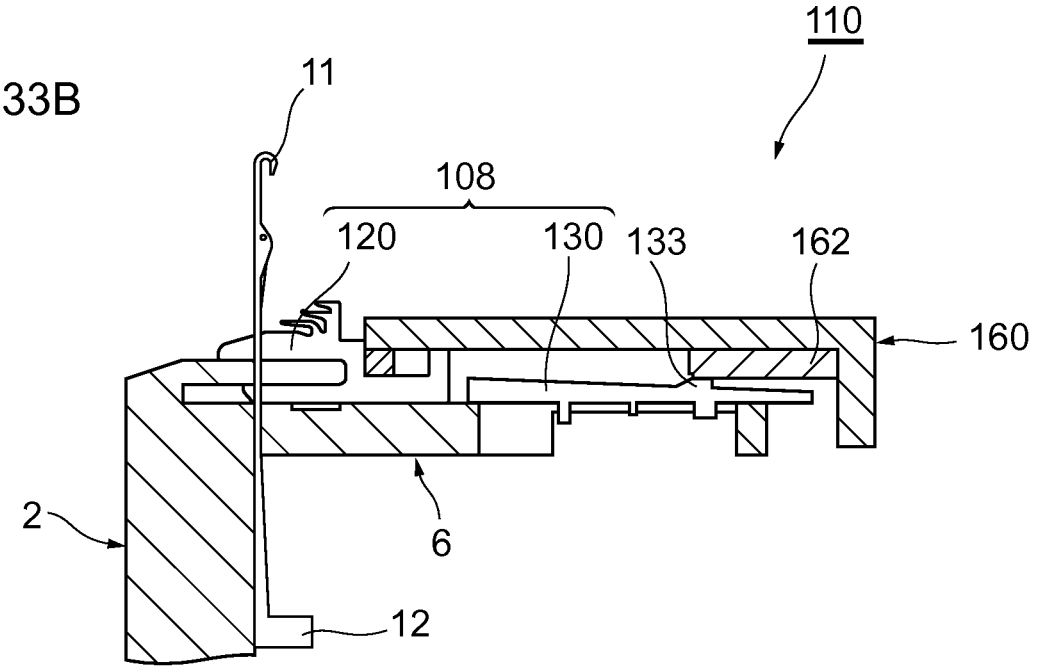

FIG. 33B shows the sinker unit 108 at the position O-D. Even when the sinker unit 108 has reached the position O-D, the first cam 162 does not engage with the outside of the selector boss 133 of the selector jack 130. Also, the selector boss 133 is not subjected to the radially inward action (first step). Thus, the selector jack 130 remains unchanged.

Figure 34A:
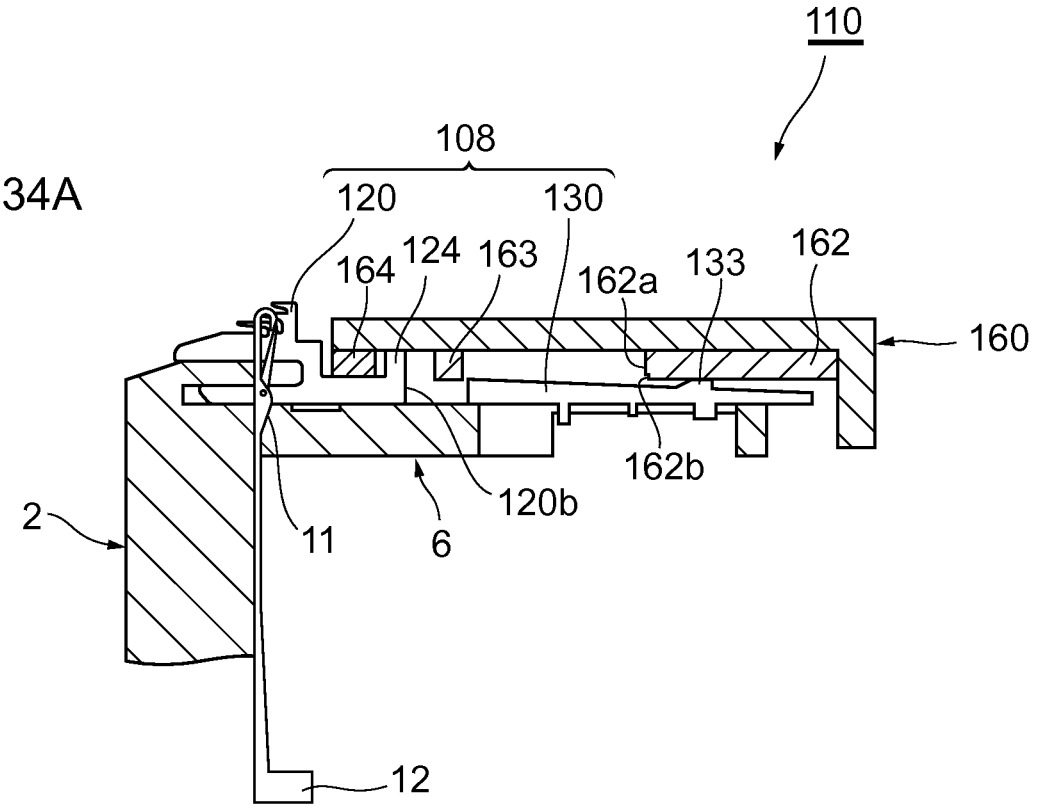
FIGS. 34A and 34B are cross-sectional views of the portion of the stitch forming device in the second preferred embodiment of the present invention, taken along line O-E and line O-F in FIG. 22, respectively.

FIG. 34A shows the sinker unit 108 at the position O-E. Even when the sinker unit 108 has reached the position O-E, the first cam 162 does not engage with the selector boss 133. Also, the selector jack 130 is not moved radially inward. Therefore, the rear end 120*b* of the sinker 120 is not subjected to any action (second step). Thus, as shown in FIG. 34A, the sinker 120 remains unchanged.

Moreover, during the movement of the sinker unit 108 from the position O-D to the position O-E, the knitting needle 11 is moved down because of the action of the stitch cam 80 (see FIG. 2). At this time, the sinker 120 is placed in its original state. Thus, as shown in FIG. 26A, both the pile yarn 91 and the ground yarn 92 are placed at and held by the small nib 123 of the sinker 120.

Figure 34B:
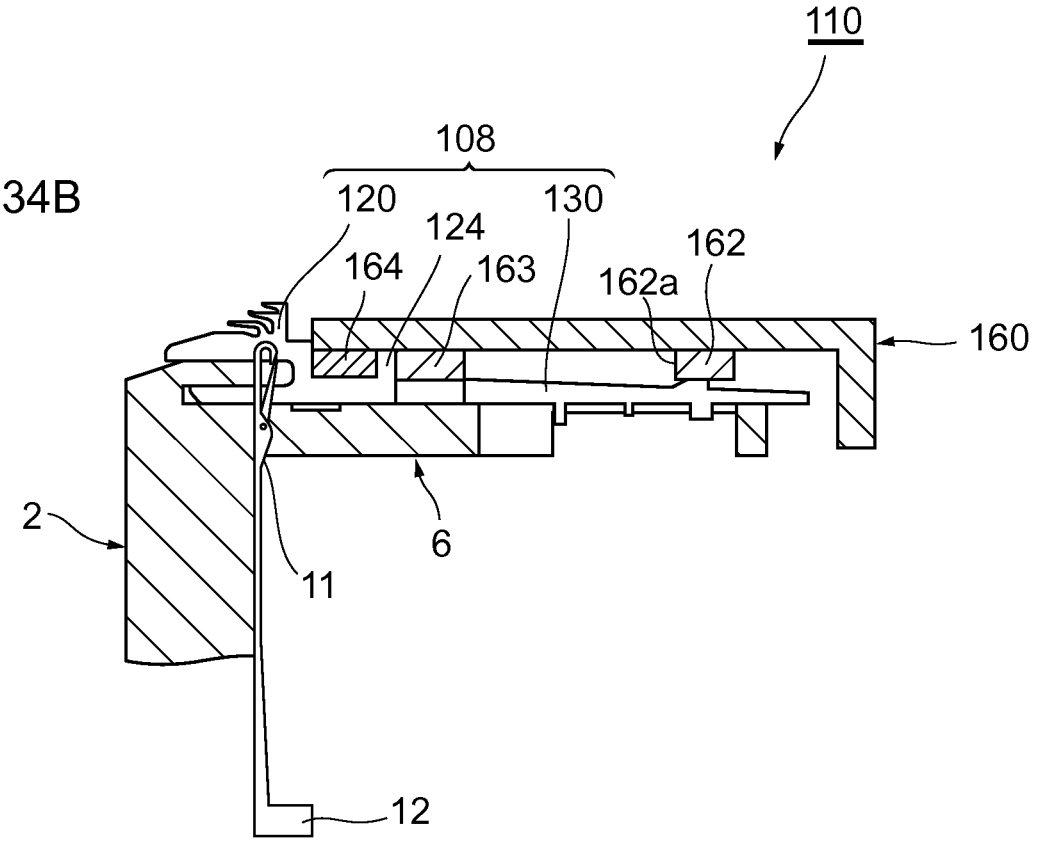

FIG. 34B shows the sinker unit 108 at the position O-F. During the movement of the sinker unit 108 from the position O-E to the position O-F, the knitting needle 11 is further moved down. Thus, while the pile yarn 91 and the ground yarn 92 are held by the small nib 123 of the sinker 120, the pile yarn 91 and the ground yarn 92 are drawn into an old loop so as to form a plain stitch $P_0$.

During the movement of the sinker unit 108 from the position O-E to the position O-F, the butt 124 of the sinker 120 is subjected to the action of the second cam 163 from the outside. Therefore, the sinker 120 is pushed out radially inward. The processes during the movement of the sinker unit 108 from the position O-F to the position O-G are the same as those described for forming the low-pile stitch $P_1$. Therefore, the detailed description is omitted.

The operation for forming the plain stitch $P_0$ during reverse rotation (rotation in the opposite direction to the direction X in FIG. 8) of the knitting-needle cylinder 2 is the same as that described above. That is, the same processes described for forward rotation are also performed for reverse rotation of the knitting-needle cylinder 2.

A series of operations for forming the low-pile stitch $P_1$, the high-pile stitch $P_2$, and the plain stitch $P_0$ are achieved by the actuator 150. Therefore, the aforementioned three types of control can be selectively carried out on a stitch-by-stitch basis.

Next, the advantageous effects of the circular knitting machine 101 of the second preferred embodiment are described. According to the arrangement of the circular knitting machine 101 of the second preferred embodiment, the difference between the knitting structures, i.e., the sinker loop lengths correspond to the distances from the contact points of the pile yarn 91 and the ground yarn 92 and the sinker 120 to the contact point between the pile yarn 91 and the ground yarn 92 and the knitting needle 11. Therefore, by changing the moved amount (L1, L2) of the sinker 120 to change which portion(s) (the low-pile nib 122, the high-pile nib 126, and the small nib 123) of the sinker 120 is to hold the pile yarn 91 and the ground yarn 92, the different knitting structures, i.e., the low-pile stitch $P_1$, the high-pile stitch $P_2$, and the plain stitch $P_0$ can be formed. Moreover, all the three types of control, i.e., the low-pile stitch formation in which the sinker 120 is moved by the distance L1, the high-pile stitch formation in which the sinker 120 is moved by the amount longer than the moved amount in the low-pile stitch formation, i.e., the distance L2, and the plain stitch formation in which the sinker 120 is not moved can be selectively performed by the actuator 150. Thus, it is possible to form the knitted fabric 90 in which the different knitting structures or stitches are distributed on a stitch-by-stitch basis.

According to the circular knitting machine 101 of the second preferred embodiment, the selector butts 132*a* to 132*f* which are operable to be subjected to the action of the actuator 150 are arranged along the radial direction. Thus, the selector butts 132 for a plurality of steps are arranged in the radial direction. Consequently, even in a case where the selector butts for a plurality of steps are provided to improve the production efficiency of the circular knitting machine 101 or stabilize the operation state, the size increase of the circular knitting machine 101 in the height direction or the vertical direction can be prevented. Moreover, by preventing that size increase, reduction in workability and operability can avoided.

According to the arrangement of the circular knitting machine 101 of the second preferred embodiment, both in a case where the sinker 120 has moved by the distance L1 and a case where the sinker 120 has moved by the distance L2, the leading end 130*a* of the selector jack 130 is in contact with the rear end 120*b* of the sinker 120 and the movement of the rear end 130*b* of the selector jack 130 is limited by the first cam 62. Thus, it is possible to position the sinker 120 stably in the state where the sinker 120 has moved by the distance L1. Also, it is possible to position the sinker 120 stably in the state where the sinker 120 has moved by the distance L2. Therefore, the possibilities of troubles occurring during stitch formation can be reduced, thus enabling the stable operation of the circular knitting machine 101.

According to the arrangement of the circular knitting machine 101 of the second preferred embodiment, the sinker 120 and the selector jack 130 preferably are separate components and the selector jack 130 is arranged on the rear side of the sinker 120. Thus, the space for the actuator 150 operable to act on the selector butts 132 can be ensured in a radially outside portion. That is, it is possible to arrange the actuator 150 more radially outside.

The first and second preferred embodiments of the present invention are described above. However, the present invention is not limited thereto but can be modified within the scope of the present invention.

An exemplary arrangement of the circular knitting machine 1 is described above in which some selector butts 32 and 36 of a pair of selector jacks 30 are preferably arranged at the same radial position, i.e., the selector butts as common components are provided. However, the present invention is not limited thereto. Instead, an exclusive selector butt 32 may be provided in the low-pile selector jack 31, an exclusive selector butt 36 may be provided in the high-pile selector jack 35, and the actuator 50 may be arranged to selectively act on the selector butts 32 and 36, for example. Also in this case, it is possible to move the low-pile sinker 21 and the high-pile sinker 25 forward selectively via the selector jacks 31 and 35 selectively subjected to the action. Therefore, the same effects as described in the first preferred embodiment can be obtained.

In the above description of the circular knitting machine 1 of the first preferred embodiment, an example is described in which when the high-pile stitch formation is carried out, both the selector butts 32*d* and 36*a* as the common components and the selector butt 32*a* as the single component are subjected to the action, as shown in FIG. 15A. However, the present invention is not limited thereto. For example, only the selector butts 32*d* and 36*a* as the common components may be subjected to the action.

In the above description of the circular knitting machine 1 of the first preferred embodiment, an example is described in which the low-pile selector jacks 31 and the high-pile selector jacks 35 are arranged in the first to third horizontal grooves 7 (701 to 703) of the sinker bed 6 so that the selector butts 32 of the low-pile selector jacks 31 in the first to third horizontal grooves 7 are arranged at different radial positions from one another and the selector butts 36 of the high-pile selector jacks 35 are arranged at different radial positions from one another, and the arrangement for the first to third horizontal grooves 7 is repeated after the fourth horizontal groove. In other words, an exemplary arrangement of the selector jacks is described in which a group of three pairs of the low-pile selector jack 31 and the high-pile selector jack 35, in which the radial positions of the selector butts 32 are different from one another and the radial positions of the selector butts 36 are different from one another, preferably is repeatedly arranged. However, the present invention is not limited thereto. For example, a group of two pairs of the low-pile selector jack 31 and the high-pile selector jack 35 in which the selector butts 32 are arranged at different radial positions from each other and the selector butts 36 are arranged at different radial positions from each other may be repeatedly arranged. Also, a group of four or more pairs of the low-pile selector jack 31 and the high-pile selector jack 35 may be repeatedly arranged.

Similarly, in the circular knitting machine 101 of the second preferred embodiment, a group of two selector jacks 130 including the selector butts 132 at different radial positions may be repeatedly arranged. Also, a group of four or more selector jacks 130 may be repeatedly arranged.

In the above description of the circular knitting machine 1 of the first preferred embodiment, an example is described in which, when the low-pile selector jack 31 and the high-pile selector jack 35 are arranged, a pair of the low-pile selector jack 31 shown in FIG. 5A and the high-pile selector jack 35 shown in FIG. 5D, a pair of the low-pile selector jack 31 shown in FIG. 5B and the high-pile selector jack 35 shown in FIG. 5E, and a pair of the low-pile selector jack 31 shown in FIG. 5C and the high-pile selector jack 35 shown in FIG. 5F are arranged. In this example, when the actuator 50 selectively acts on the low-pile selector jack 31 shown in FIG. 5A and the high-pile selector jack 35 shown in FIG. 5D, control of the actuator 50 is performed by selectively move the head 51 corresponding to the first-step selector butt and the head 54 corresponding to the fourth-step selector butt in a pivotal manner.

The combination of the low-pile selector jack 31 and the high-pile selector jack 35 is not limited to the above. For example, it is possible to form a pair of selector jacks 30 by the low-pile selector jack 31 shown in FIG. 5A and the high-pile selector jack 35 shown in FIG. 5F. In this case, control of the actuator 50 when the actuator 50 selectively acts on the respective selector jacks 31 and 35 can be performed by selectively moving the head 51 corresponding to the first-step selector butt and the head 56 corresponding to the sixth-step selector butt in a pivotal manner.

In the above description of the circular knitting machine 1 of the first preferred embodiment, an example is described in which the low-pile sinker 21, the high-pile sinker 25, the low-pile selector jack 31 and the high-pile selector jack 35 are preferably arranged in each horizontal groove 7 of the sinker bed 6 and the separator 40 is arranged between the low-pile sinker 21 and the high-pile sinker 25 and between the low-pile selector jack 31 and the high-pile selector jack 35. However, the present invention is not limited thereto. For example, two horizontal grooves may be provided between each knitting needle 11 and the adjacent knitting needle 11, the low-pile sinker 21 and the low-pile selector jack 31 may be arranged in one of the two horizontal grooves, and the high-pile sinker 25 and the high-pile selector jack 35 may be arranged in the other horizontal groove. In this case, the wall between the two horizontal grooves serves as a separating portion. This separating portion can provide the same effects as those described in the first preferred embodiment.

In the above preferred embodiments, plain-stitch formation is described as an example. However, the present invention is not limited thereto. For example, formation of a varied stitch, e.g., a float stitch, a tuck stitch, and a cut-boss stitch, the high-pile stitch formation and the low-pile stitch formation can be combined. Alternatively, formation of knitting structures which include at least two of the plain stitch, the float stitch, the tuck stitch and the cut-boss stitch, the high-pile stitch formation and the low-pile stitch formation can be combined.

In the above description, examples are described in which the knitting machine of preferred embodiments of the present invention capable of changing the pile length is preferably applied to the circular knitting machine. However, the knitting machine of the present invention can be also applied to a flat knitting machine. In a case where the knitting machine of the present invention is applied to the circular knitting machine, it can be applied to a hosiery circular knitting machine, for example.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A knitting machine capable of changing a pile length, comprising:

a cylinder arranged to hold knitting needles so that the knitting needles extend in a vertical direction parallel or substantially parallel to an axis of the cylinder;

a sinker bed including a disk-shaped horizontal surface arranged perpendicular or substantially perpendicular to the axis of the cylinder;

a plurality of sinkers including a low-pile sinker and a high-pile sinker arranged on the sinker bed to radially extend and to be movable in a radial direction of the cylinder, the low-pile sinker and the high-pile sinker being different and non-identical structural elements with a structure and an outer peripheral shape of the low-pile sinker being different from a structure and an outer peripheral shape of the high-pile sinker, respectively, the low-pile sinker and the high-pile sinker being opposed to each other, the low-pile sinker including a low-pile nib to hold a pile yarn when a low-pile stitch is formed, the high-pile sinker including a high-pile nib to hold the pile yarn when a high-pile stitch in which a sinker loop length of the pile yarn is longer than that in the low-pile stitch is formed;

a plurality of selector jacks arranged on the sinker bed radially outside the sinkers to correspond thereto, respectively, and to extend radially, the selector jacks including a low-pile selector jack and a high-pile selector jack arranged to be opposed to each other and be selectively movable in the radial direction to act on the low-pile sinker and the high-pile sinker corresponding thereto;

an actuator arranged to selectively act on the selector jacks so that, when one of the knitting needles draws in the pile yarn and a ground yarn, a first control in which the actuator acts on the low-pile selector jack, a second control in which the actuator acts on the high-pile selector jack, and a third control in which none of the low-pile selector jack and the high-pile selector jack is subjected to an action of the actuator are selectively performed;

a sinker cap arranged above the sinker bed to cover the sinker bed, the sinker cap including a cam arranged to act on the sinkers and the selector jacks selectively, the cam being arranged to move at least one of the selector jacks which is subjected to the action of the actuator radially inward to bring the at least one selector jack into contact with a corresponding sinker and to move the corresponding sinker to an area between the knitting needles; wherein at least one of the low-pile sinker and the high-pile sinker includes a small nib to hold the ground yarn during stitch formation, a distance between the high-pile nib and the small nib being larger than a distance between the low-pile nib and the small nib in the vertical direction;

a distance between the low-pile nib and the high-pile nib in the vertical direction is from about 0.5 mm to about 2.5 mm;

when the low-pile sinker is pushed out by the first control, the pile yarn and the ground yarn are drawn in by one of the knitting needles while the pile yarn is held by the low-pile nib and the ground yarn is held by the small nib;

when the high-pile sinker is pushed out by the second control, the pile yarn and the ground yarn are drawn in by one of the knitting needles while the pile yarn is held by the high-pile nib and the ground yarn is held by the small nib;

when none of the low-pile sinker and the high-pile sinker is pushed out by the third control, the pile yarn and the ground yarn are drawn in by one of knitting needles while both the pile yarn and the ground yarn are held by the small nib;

the low-pile selector jack and the high-pile selector jack have different and non-identical structural elements with a structure and an outer peripheral shape of the low-pile selector jack being different from a structure and an outer peripheral shape of the high-pile selector jack, respectively; and the low-pile selector jack is defined by a first one-piece monolithic member and the high-pile selector lack is defined by a second one-piece monolithic member.

2. A knitting machine according to claim 1, wherein each of the selector jacks includes selector butts arranged to be subjected to the action of the actuator, the selector butts include common selector butts as common components which are provided in both the low-pile selector jack and the high-pile selector jack at the same radial position to be opposed to each other, and a single selector butt as a single component which is provided in the low-pile selector jack at a position different from the common selector butts; and in the first control the actuator acts on the single selector butt, in the second control the actuator acts on the common selector butts or both the common selector butts and the single selector butt, and in the third control none of the common selector butts and the single selector butt is subjected to the action of the actuator.

3. A knitting machine according to claim 2, wherein the selector jacks include a plurality of groups of selector jacks;

in each of the groups, the common selector butts of each of the selector jacks are arranged at different radial positions from those of other selector jacks and the single selector butt of each of the selector jacks is arranged at a different radial position from those of other selector jacks;

the selector jacks are arranged so that the common selector butt at one radial direction repeatedly occurs and the single selector butt at one radial direction repeatedly occurs; and the actuator includes a plurality of heads provided to correspond to the selector butts.

4. A knitting machine according to claim 1, wherein the low-pile selector jack includes a low-pile selector butt operable to be subjected to the action of the actuator, and the high-pile selector jack includes a high-pile selector butt operable to be subjected to the action of the actuator;

in the first control, the actuator acts on the low-pile selector butt;

in the second control, the actuator acts on the high-pile selector butt or both the low-pile selector butt and the high-pile selector butt; and in the third control, none of the low-pile selector butt and the high-pile selector butt is subjected to the action of the actuator.

5. A knitting machine according to claim 4, wherein the selector jacks include a plurality of low-pile selector jacks and a plurality of high-pile selector jacks, a radial position of the low-pile selector butt of each of the low-pile selector jacks is different from those of adjacent ones of the low-pile selector jacks, and a radial position of the high-pile selector butt of each of the high-pile selector jacks is different from those of adjacent ones of high-pile selector jacks;

the low-pile selector jacks are arranged so that the low-pile selector butt at one radial position occurs repeatedly, and the high-pile selector jacks are arranged so that the high-pile selector butt at one radial position occurs repeatedly; and the actuator includes a plurality of heads provided to correspond to the low-pile and high-pile selector butts.

6. A knitting machine according to claim 1, wherein the small nib is provided in the low-pile sinker.

7. A knitting machine according to claim 1, further comprising a separating portion arranged between the low-pile sinker and the high-pile sinker and between the low-pile selector jack and the high-pile selector jack to prevent the low-pile sinker and the low-pile selector jack from adhering to the high-pile sinker and the high-pile selector jack.

8. A knitting machine according to claim 7, wherein the separating portion includes a flat planar separator.

9. A knitting machine according to claim 1, wherein the actuator includes a flat planar head including a top end and is arranged to act on one of the selector jacks which is to be selected by bringing the top end of the head into contact with the one of the selector jacks; and the head includes a main surface which is perpendicular or substantially perpendicular to the one of the selector jacks and symmetric about a center line extending vertically across the main surface of the head.

10. A knitting machine according to claim 1, wherein the low-pile selector jack acts on only the low-pile sinker and the high-pile selector jack acts on only the high-pile sinker.

11. A knitting machine according to claim 1, wherein the low-pile selector jack includes two selector butts and the high-pile selector jack includes only one selector butt.

12. A knitting machine according to claim 7, wherein the separating portion, the low-pile sinker, the high-pile sinker, the low-pile selector jack, and the high-pile selector jack are all arranged within a horizontal groove defined in the sinker bed.

13. A knitting machine according to claim 12, wherein the low-pile sinker and the low-pile selector jack are provided directly adjacent to a first side of the separating portion;

the high-pile sinker and the high-pile selector jack are provided directly adjacent to a second side of the separating portion; and the first side of the separating portion and the second side of the separating portion are directly opposite to one another.

* * * * *